US008847840B1

(12) United States Patent
Diaz

(10) Patent No.: US 8,847,840 B1
(45) Date of Patent: Sep. 30, 2014

(54) PSEUDO-CONDUCTOR ANTENNAS

(75) Inventor: Rodolfo E. Diaz, Phoenix, AZ (US)

(73) Assignee: General Atomics, San Diego, CA (US)

( * ) Notice: Subject to any disclaimer, the term of this patent is extended or adjusted under 35 U.S.C. 154(b) by 126 days.

(21) Appl. No.: 13/407,694

(22) Filed: Feb. 28, 2012

(51) Int. Cl.
*H01Q 9/16* (2006.01)

(52) U.S. Cl.
USPC ..... 343/793; 343/795

(58) Field of Classification Search
USPC ..... 343/793, 795, 741, 742, 866, 867
See application file for complete search history.

(56) References Cited

U.S. PATENT DOCUMENTS

| | | | | |
|---|---|---|---|---|
| 5,675,306 | A | 10/1997 | Diaz | |
| 5,993,164 | A | 11/1999 | Diaz | |
| 6,492,956 | B1 | 12/2002 | Fischer et al. | |
| 2004/0051666 | A1 * | 3/2004 | Aisenbrey | 343/700 MS |
| 2007/0013599 | A1 * | 1/2007 | Gaucher et al. | 343/795 |
| 2009/0073548 | A1 * | 3/2009 | Youngs | 359/321 |
| 2009/0121948 | A1 * | 5/2009 | Nysen | 343/702 |

OTHER PUBLICATIONS

Kaplan, B. Z., "A new interpretation of the relationship existing between demagnetizing factor and inductance," IEEE Transactions on Magnetics, 30(5):2788-2794, Sep. 1994.

Kaplan, B. Z., et al., "Treatment of extremely low frequency magnetic and electric field sensors via the rules of electromagnetic duality," IEEE Transactions on Magnetics, 34(4):2298-2305, Jul. 1998.

Kaplan, B. Z., et al., "Duality of the electric covering fieldmill and the fluxgate magnetometer," IEEE Transactions on Magnetics, 34(4):2306-2315, Jul. 1998.

Kaplan, B. Z., et al., "Evaluation of inductance for various distributions of windings on straight ferromagnetic cores: an unusual approach," IEEE Transactions on Magnetics, 38(1):246-249, Jan. 2002.

Meloling, J. H., et al., "A transmit mast-clamp current probe for shipboard HF communications," SPAWAR Syst. Center San Diego, California, United States, Antennas and Propagation Society International Symposium IEEE Conference Publication, 1B:17-20, Jul. 2005.

Kennedy, T. F., et al., "Modification of properties of long monopole antennas using dielectric and magnetic beads," IEEE Antennas and Wireless Propagation Letters, 3(1):165-168, Dec. 2004.

* cited by examiner

*Primary Examiner* — Hoanganh Le
(74) *Attorney, Agent, or Firm* — Perkins Coie LLP

(57) ABSTRACT

Techniques, devices and systems use pseudo-conductor materials as antennas to receive or radiate electromagnetic energy for communications and other applications. Methods of configuring an antenna can include, in some implementations, selecting a pseudo-conductor material having an electromagnetic constitutive property, wherein the electromagnetic constitutive property comprises a real part of the electromagnetic constitutive property that is greater than a corresponding imaginary part of the electromagnetic constitutive property; and forming the pseudo-conductor material into an antenna shape configured, upon being excited, to radiate emissions that satisfy a predefined antenna performance, such that the pseudo-conductor material formed in the antenna shape weakly guides an electromagnetic wave on the pseudo-conductor material using a leaky mode that is below cutoff to establish a field structure to radiate the emissions from the pseudo-conductor material that satisfy the antenna performance.

39 Claims, 29 Drawing Sheets

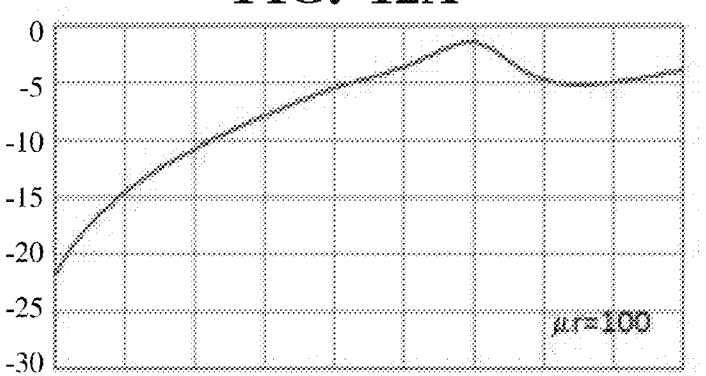
FIG. 12A
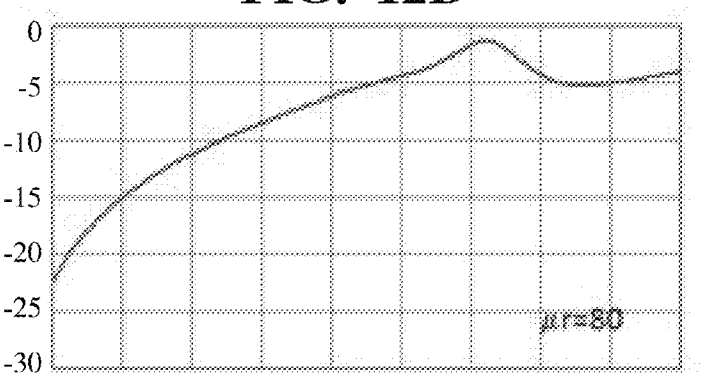
FIG. 12B
FIG. 12C
FIG. 12D

PSEUDO-CONDUCTOR ANTENNAS

TECHNICAL FIELD

This patent document relates generally to antennas for transmitting or receiving electromagnetic energy or signals in various applications including wireless communications.

BACKGROUND

An antenna used in many radar systems, radio or communication devices is an electrically conductive device made of one or more electrically conductive materials and interfaces with a circuit and a medium surrounding the antenna, such as air or other dielectric medium, to either transmit an electromagnetic wave from the circuit into the medium or to receive an electromagnetic wave from the medium into the circuit. In transmitting the electromagnetic wave from the circuit into the medium, the circuit operates to generate an alternating current distribution at one or more alternating radio frequencies in the antenna which in turn radiates an electromagnetic wave at the one or more radio frequencies into the medium. In receiving an electromagnetic wave from the medium into the circuit, the antenna interfaces with the incoming electromagnetic wave at one or more radio frequencies to produce an alternating current distribution at one or more alternating radio frequencies in the antenna which is received by the circuit. In both transmitting and receiving operations, the antenna operates as a conversion device that performs conversion between the electromagnetic wave and the alternating current distribution.

Many antennas are made of electrically conductive materials such as metals. Electrically conductive materials are materials with high electrical permittivity such that the imaginary part of the electrical permittivity $\in''$ is much greater than the real part of the electrical permittivity $\in'$ (i.e., $\in''>>\in'$). Magnetically conductive materials can also be used to construct antennas. Magnetically conductive materials are materials with high magnetic permeability that can be magnetized or de-magnetized under a magnetic field and tend to have the imaginary part of the magnetic permeability $\mu''$ much greater than the real part of the magnetic permeability $\mu'$ (i.e., $\mu''>>\mu'$), e.g., alloys of Fe, Ni and Co, or nickel zinc ferrite above the ferromagnetic resonance frequency.

SUMMARY

In this document, materials having an electromagnetic constitutive property that has a real component that is greater than the imaginary component are referred to as pseudo-conductors. This document provides techniques, devices and systems for using pseudo-conductor materials as antennas to receive or radiate electromagnetic energy for communications and other applications.

In one aspect, the pseudo-conductor material is configured to weakly guide displacement currents on the pseudo-conductor material to radiate or receive electromagnetic energy. This device includes an antenna circuit coupled to the pseudo-conductor material and configured to excite the pseudo-conductor material to radiate the electromagnetic energy or to receive the electromagnetic energy received by the pseudo-conductor material.

In another aspect, an antenna device can include a pseudo-conductor material that is not electrically conductive and exhibits either (1) a material permeability having a real part greater than a corresponding imaginary part and a relative permeability greater than a relative permittivity, or (2) a material permittivity having a real part greater than a corresponding imaginary part and having the relative permittivity greater than the relative permeability; an electrical conductor positioned relative to the pseudo-conductor material to electromagnetically couple to the pseudo-conductor material; and an antenna circuit coupled to the pseudo-conductor material and the electrical conductor to supply a signal of electromagnetic energy to (1) excite one or more weakly guided electromagnetic modes in the pseudo-conductor material to cause radiation of the weakly guided electromagnetic energy or (2) receive electromagnetic energy that is received by the antenna circuit.

In another aspect, a method of configuring an antenna is provided to include selecting a pseudo-conductor material having an electromagnetic constitutive property having a real part greater than a corresponding imaginary part of the electromagnetic constitutive property; and forming the pseudo-conductor material into an antenna shape configured, upon being excited, to radiate emissions that satisfy a predefined antenna performance. In some embodiments, the pseudo-conductor material is formed such that the pseudo-conductor material formed in the antenna shape weakly guides an electromagnetic wave on the pseudo-conductor material using a leaky mode that is below a cutoff to establish a field structure to radiate the emissions from the pseudo-conductor material that satisfy the antenna performance.

In yet another aspect, a method of wirelessly communicating is provided to include exciting an antenna with one or more communication signals, wherein the antenna comprises a pseudo-conductor material having an electromagnetic constitutive property, where the electromagnetic constitutive property comprises a real part of the electromagnetic constitutive property that is greater than a corresponding imaginary part of the electromagnetic constitutive property; inducing electromagnetic currents on the pseudo-conductor material of the antenna, such that the pseudo-conductor material weakly guides an electromagnetic wave on the pseudo-conductor material in a leaky mode that is below cutoff; and radiating emissions from the pseudo-conductor material that meet a predefined antenna performance. In one implementation, inducing the electromagnetic currents comprises providing wave propagation of the electromagnetic wave in a TE01, transverse electric, mode in a magnetic pseudo-conductor, establishing a longitudinal and radial magnetic field in the magnetic pseudo-conductor, and the electromagnetic constitutive property may include permeability, such that a real part of the permeability is greater than the imaginary part of the permeability. In another implementation, inducing the electromagnetic currents may include providing wave propagation of the electromagnetic wave in a TM01, transverse magnetic, mode in an electric pseudo-conductor, and establishing a longitudinal and radial electric field in the electric pseudo-conductor and the electromagnetic constitutive property may include permittivity, such that a real part of the permittivity is greater than an imaginary part of the permittivity.

The above and other aspects, and associated implementations are described in greater detail in the description, the drawings and the claims.

BRIEF DESCRIPTION OF THE DRAWINGS

FIGS. 12A-12D show graphs of the efficiency relative to frequency of the conformal magnetic pseudo-conductor linear dipole antenna as permeability is varied.

Figure 1:
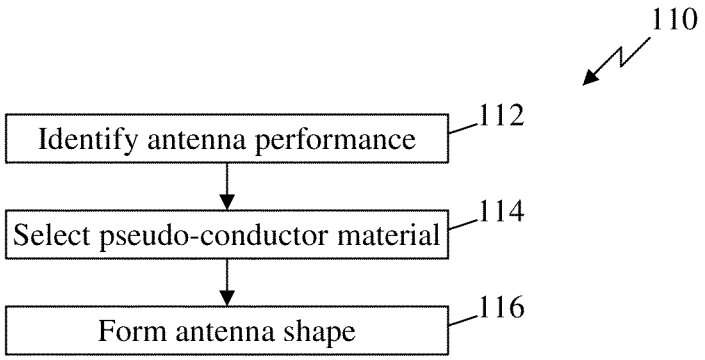
FIG. 1 depicts a simplified flow diagram of a process based on some embodiments of configuring an antenna to at least meet antenna performances and/or characteristics.

Corresponding reference characters indicate corresponding components throughout the several views of the drawings. Elements in the figures are illustrated for simplicity and clarity and have not necessarily been drawn to scale. For example, the dimensions of some of the elements in the figures may be exaggerated relative to other elements to help to improve understanding of various embodiments.

DETAILED DESCRIPTION

Examples provided below illustrate designing, configuring, shaping, constructing, assembling and/or using antennas constructed at least partially from one or more pseudo-conductors or pseudo-conductive materials. A pseudo-conductor material is generally designed, manufactured and/or selected to have electromagnetic constitutive property where a real part of the electromagnetic constitutive property is greater than a corresponding imaginary part of the electromagnetic constitutive property (e.g., real permittivity ($\in'$)>imaginary permittivity ($\in''$); or real permeability ($\mu'$)>imaginary permeability ($\mu''$)), and in many implementations the real part of the electromagnetic constitutive property is significantly greater than a corresponding imaginary part of the electromagnetic constitutive property. In some instances, the real part of the electromagnetic constitutive properties are five, tens or even hundreds of times greater than the corresponding imaginary electromagnetic constitutive property. Some embodiments utilize a material having a ratio of real part to imaginary part of about 3:1 or greater to minimize signal loss. A ratio of 10:1 of real part to imaginary part is appropriate for many applications, at least with respect to signal loss. Further, the ratio of real part to imaginary part can, in some instances, be significantly high, while in many embodiments the permeable materials would rarely exceed a ratio of 1000:1. As described further below, at least with some pseudo-conductor material in some implementations, the higher the real part of electromagnetic constitutive property generally the thinner the cross section of the pseudo-conductor material can be.

When implemented into a desired antenna configuration and effectively excited, the pseudo-conductor material of the antenna in accordance with some embodiments weakly guides an electromagnetic wave on the pseudo-conductor material such that emissions are radiated from the pseudo-conductor material that satisfies a predefined antenna performance.

At least some pseudo-conductor dielectric materials (generally where the real permittivity $\in'$ is greater than the corresponding imaginary permittivity $\in''$) and/or pseudo-conductor magnetically permeable materials (generally where the real permeability $\mu'$ is greater than the corresponding imaginary permeability $\mu''$) can be configured to partially and/or weakly guide electromagnetic waves even when electrical dimensions of the material are not large enough to guarantee the propagation of a slow-wave eigenmode. This partial guidance property can be used to lead an electromagnetic wave from a feed region, and generally along the surface(s) of the material, to one or more terminations or other discontinuities where electromagnetic waves radiate. Some embodiments form antennas using one or more pseudo-conductive materials to form what are referred to as pseudo-conductor antennas where the emitted radiation is emitted from the pseudo-conductive material. Further, in some implementations, these pseudo-conductor antennas provide a mechanism of radiation and the appearance of feed impedance that are generally analogous to the phenomena associated with conventional electrically conducting (e.g., $\in''>>\in'$) or magnetically conducting ($\mu''>>\mu'$) antennas.

The use of pseudo-conductor antennas in some embodiments can be implemented in areas, conditions or environments that are not particularly advantageous to electrically conductive antennas. Additionally, some embodiments can be utilized conformal to electrically conductive materials while avoiding many of, not all of, the adverse affects and/or additional design characteristics associated with electrically conductive antennas attempting to be positioned conformal to an electrically conductive surface. Additionally, some of these conformal embodiments can be implemented with the pseudo-conductor antenna structure embedded in a conducting channel, indentation or the like on the conductive surface so that the outer mold-line of the structure remains unaltered.

FIG. 1 depicts a simplified flow diagram of a process 110 in some embodiments of configuring an antenna to at least meet antenna performances and/or characteristics. In step 112, antenna performance, parameters and/or characteristics intended to be met or exceeded are identified. The antenna performance and/or characteristics can be predefined for one or more intended applications and/or implementations. In some embodiments the antenna performance can be characterized by achieving an intended communication bandwidth at one or more RF or microwave carrier frequencies and a desired gain within that bandwidth for the one or more carrier frequencies. Other antenna parameters and/or characteristics that can be considered and/or identified as characteristics that might be considered can include efficiency, directivity, signal polarization, radiation pattern, input impedance, physical size, orientation, environment in which the antenna is intended to operate, surrounding materials, and/or other such characteristics or combinations of such characteristics.

In step 114, a pseudo-conductor material is selected having an electromagnetic constitutive property, where the electromagnetic constitutive property comprises a real part of the electromagnetic constitutive property that is greater than a corresponding imaginary part of the electromagnetic constitutive property. For example, in some implementations, a magnetic pseudo-conductive material is selected to have a real part of the permeability greater than a corresponding imaginary part of the permeability while the relative permeability is greater than the relative permittivity of the material. As a specific example, pseudo-conductor materials having ratios of real permeability to real permittivity of 3:1, or 5:1, or higher can be utilized to form magnetic pseudo-conductor antennas where the magnetic permeability properties significantly affect the antenna performance. In such magnetic pseudo-conductor antennas, the permittivity of a magnetic pseudo-conductor antenna can be kept relatively small to keep the ratio of the real permeability to real permittivity large, e.g., 5, 10 or greater, to achieve a relatively large bandwidth. In various practice implementations, a large permittivity in a magnetic pseudo-conductor antenna can be undesirable in part because it reduces the ratio of the real permeability to real permittivity and, accordingly, the frequency at which guided modes come out of cut-off. Therefore, a large permittivity may undesirably limit the bandwidth over which leaky modes are available to radiate.

Similarly, an electric pseudo-conductive material can be used to form an antenna which has a real part of the permittivity greater than a corresponding imaginary part of the permittivity while the relative permittivity is greater than the relative permeability of the material. Materials with ratios of permittivity to permeability at 3:1, or 5:1, or higher can be used to form antennas whose performance is dominated by the dielectric properties. In many instances the real electromagnetic constitutive property is selected to be greater than a corresponding imaginary part of the electromagnetic constitutive property by a factor of 5, 10 or more.

Many materials are anisotropic so that the constitutive properties differ along different directions, e.g., three Cartesian coordinates or principal axes of the structure. The restriction of the ratios of permeability to permittivity can be understood to mean those components of the permeability and permittivity tensor that are being used to guide the desired leaky-mode. For instance a long and thin magnetic-pseudo-conductor lying directly on an electrically conductive metal ground plane and being used as a linear antenna would be selected to have a relatively high axial permeability. The permittivity generally parallel to the ground plane may be relatively high while the permittivity normal to the ground plane is relatively low (e.g., in some embodiments less than about 10 and generally less than about 5) without affecting the intended performance and provided the desired longitudinal magnetic field mode is excited at the feed of the antenna.

Referring to FIG. 1, in step 116, the pseudo-conductor material is formed into an antenna shape configured to radiate emissions that at least meet the specified antenna performance in step 112 when the pseudo-conductor material is excited. Additionally, the formed pseudo-conductor antenna shape typically weakly guides an electromagnetic wave on the pseudo-conductor material using a leaky mode that is below cutoff to establish a field structure to radiate the emissions from the pseudo-conductor material that at least meet the intended antenna performance when excited. In implementations, the design of a pseudo-conductor antenna can be varied via any one or more of steps 112, 114 and 116 and the design may vary based on factors, selections, conditions and the like that are taken into consideration in performing one or more of steps 112, 114 and 116. Furthermore, the designing, constructing and implementing of a pseudo-conductor antenna in accordance with some embodiments may include repeating or looping back to one or more of steps 112, 114 and/or 116 based on the factors, selections, conditions and the like performed in one or more of steps 112, 114 and/or 116.

The operations of various electrically conductive antennas depend on the ability of the electric conductor or conductors to guide electromagnetic waves to an end discontinuity where radiation and reflection occur. Alternatively, implementations of antennas based on pseudo conductors described in this document provide pseudo-conductor antennas formed at least in part from a magneto-dielectric material or objects ($\in'>\in''$; or $\mu'>\in''$) that weakly guide electromagnetic waves and can be used to effectuate radiated emissions that are analogous to emissions produced from corresponding electrically conducting antennas.

Terminating admittance theories have been used to derive closed-form models of the behavior of various electrically conductive antennas. The terminating admittances theories can similarly be considered as a basis for deriving a closed-form model of the behavior for at least some pseudo-conductor antennas, which can provide at least in part a basis for the functionality of pseudo-conductor antennas.

Further, various antennas, such as electrically conductive conformal antennas positioned relative to a conductive surface or back plane, can be designed to utilize dielectric materials or other materials having a net high impedance and positive reflection coefficient properties in attempts to compensate for the negative effects the conductive surface can have on the radiation. For example, some antenna designs employ an artificial magnetic conductor (AMC) substrate with conformal wire antennas. In effect, these substrates are interposed between the tangential wire antenna and a nearby conducting surface such that the radiation from the antenna undergoes approximately a 360 degree shift by the time it is reflected back to the plane of the antenna, which can in some instances result in an increased gain instead of the cancellation of the field by the current images in the conducting surface.

Although this approach may in some instances provide some beneficial effects, the high index dielectric substrate has at least two shortcomings. First, the higher the dielectric constant, typically the narrower the bandwidth over which the quarter wave effect holds. Second, high dielectric constant substrates tend to trap and guide surface waves that subsequently scatter off the ends of the structure and interfere with the intended antenna pattern. In some cases of low profile patch antennas, this surface wave guidance effect means that the substrate tends to effectively steal a significant portion of the power (e.g., 90%) away from the antenna unless field chokes, cavities or careful mode selection is used to suppress the surface waves. The bottom-line is that shallow dielectric substrates are typically not conducive to wideband conformal applications. Some substrate materials, such as the Sievenpiper AMC metamaterial with a mushroom surface structure, were intended to solve this problem of surface waves by explicitly including TE and TM surface wave suppression. However, the typical resulting bandwidth with antennas employing such substrate material is still limited by the permittivity of the material in the substrate. The broadest bandwidth of such an antenna is generally of the order of about 1.8:1, when it is approximately one quarter of a free space wavelength thick.

Similarly, when the high-index of a substrate is attained by using a material with a high permeability that significantly exceeds its permittivity (a so-called high impedance material) the bandwidth of the quarter wave effect may, in some instances, actually be increased instead of decreased. This bandwidth enhancement typically is proportional to the ratio of the permeability to the permittivity, where the higher the ratio typically the better.

Most natural non-conducting magnetically permeable materials, however, are heavy, fragile ceramic ferrites with frequency bands of operation limited by Nature. As such, they have very limited applicability and cannot be used in many instances. For example, Manganese ferrites ($\mu'$ in the 1000's) can be utilized for some implementations in the KHz to low MHz range, Nickel Zinc ferrites ($\mu'$ in the 100's) may provide permeabilities in the VHF range; while approaching 1 GHz, hexaferrites (e.g. Co2Z) have sizeable permeabilities in the 10 to 30 range, but often become lossy from the high UHF and up. Since most low lossy ferrite ceramics have a permittivity of the order of 10, this means that as the GHz range is approached the highest $\mu/\in$ ratio attained by a ferrite is of the order of 3:1 by aligned Co2Z.

As such, many of these materials, such as natural ferrites, suffer from naturally limited bandwidths usually associated with broad loss peaks that introduce excess unwanted loss into many of these conformal applications and from a naturally limited range of high impedance properties. Materials can be engineered to have $\mu'>>\in'$ which is useful as a magnetic pseudo-conductor.

Consider for example conformal antennas intended to operate over relatively wide instantaneous bands of frequency from High Frequency (HF) to Ultra High Frequency (UHF). A wide instantaneous bandwidth could allow a single antenna to be used for many functions in this frequency range, thus minimizing the number of radiators needed on the platform. Many antennas based on metals and other electrically conductive materials do not have such a wide instantaneous bandwidth and are operated by dynamically tuning the antennas to operate with high efficiency over a narrow band of frequencies.

The subject of the efficiency performance of an antenna over a wide band of frequencies is not as commonly understood as the narrow band operation. It is known that the gain-bandwidth product is limited by the Fano-Chu (FCh) Gain-Bandwidth Product limit.

The minimum radiation quality factor (Q) of an electrically small antenna, linearly polarized, existing within a sphere of radius a is defined by:

$$Q_{FCh} = \frac{1}{(ka)^3} + \frac{1}{ka}, \quad \text{(Equation 1)}$$

where this is typically a valid estimate up to ka=1 (the so-called radian sphere), and the bandwidth ~1/Q~$(ka)^3$. Assuming a typical dipole antenna has a gain of the order of 1.5, the Fano-Chu Gain-bandwidth product limit is defined as:

$$GBWP_{FCh} = 1.5\left(\frac{1}{(ka)^3} + \frac{1}{ka}\right)^{-1}. \quad \text{(Equation 2)}$$

Theoretically, when considering electrically small antennas covering more than a 3:1 bandwidth, the fractional bandwidth in the FCh limit can be set to 1, which can provide the gain-bandwidth product (GBWP) curve into a theoretical maximum attainable gain versus frequency curve.

Performance of practical antennas, however, generally cannot achieve this curve because the FCh limit is attained by a spherical antenna fully occupying the volume of radius a. A conformal antenna in substantially all practical applications is limited to less than the spherical antenna. For example, many practical conformal antennas are configured as a disk (or similar to a disk) of radius a on a surface, and this configuration does not make maximum use of the spherical volume. As such, an attainable gain-bandwidth product limit is typically at least −6 dB below the FCh limit. This fact that the 2D FCh limit is about −6 dB below the 3D limit can readily be proven, for example, by calculating the gain-bandwidth product of an annular slot antenna or that of a circular waveguide aperture terminated on effectively an infinite conducting plane.

However, the reality for typical metal conformal antennas is that the gain-bandwidth product is typically much worse than the theoretical limit. As discussed above, most surfaces onto which conformal antennas are to be mounted are electrically conducting. The currents on the antenna, at a height h over the conductive ground plane, excite image currents in the ground plane that oppose the antenna currents, and as a result reduce the radiation resistance, typically by a factor of the form:

$$\sin^2(kh). \quad \text{(Equation 3)}$$

Thus, an electrically small conformal antenna is typically expected to have a gain-bandwidth product (GBWP) limit proportional to the fifth power of the frequency, which is relatively much worse than the third power dependence expected from the FCh limit. In other words, various conformal antennas (such as patches) are narrowband antennas, operating well below the FCh limit. As such, the modification of such conformal antennas to incorporate a permeable substrate can increase bandwidth. Although providing some improvement, for example with a patch antenna, such improvements are typically not a significant step in the direction of attaining the maximum physically realizable GBPW in the available surface area.

It is to sidestep this problem of the image currents that artificial substrates, such as AMCs, have been proposed. Such AMC substrates tend to be impractical for many applications in part because elimination of the image currents would demand that the high impedance substrate cover an area that exceeds the radian sphere. Elementary physical optics arguments can be used to present that the performance improvement generally cannot be expected to be directly proportional to the plane wave reflection coefficient properties of the high-impedance material substrate if the area occupied by the substrate is smaller than the radian sphere. Thus, for example, in dealing with electrically small antennas at relatively low frequencies on realistic platforms, it may not be practical to coat the entire platform with an AMC. For another example, requirements in many applications are to minimize the area occupied by the antenna and any substrate, to reduce the weight of the antenna and any substrate, and/or other such factors that prevent or at least limit the size of a substrate.

As such, the entire surface in many practical applications is not a high-impedance surface. This results in limited effectiveness and performance improvements obtained by placing under the conformal antenna a finite-sized high-impedance substrate slab, particularly when both the antenna and the substrate slab are smaller than the radian sphere. A high permeability material that is properly configured and excited can produce radiations to meet and/or exceed predefined antenna performance and/or parameters.

Figure 2:
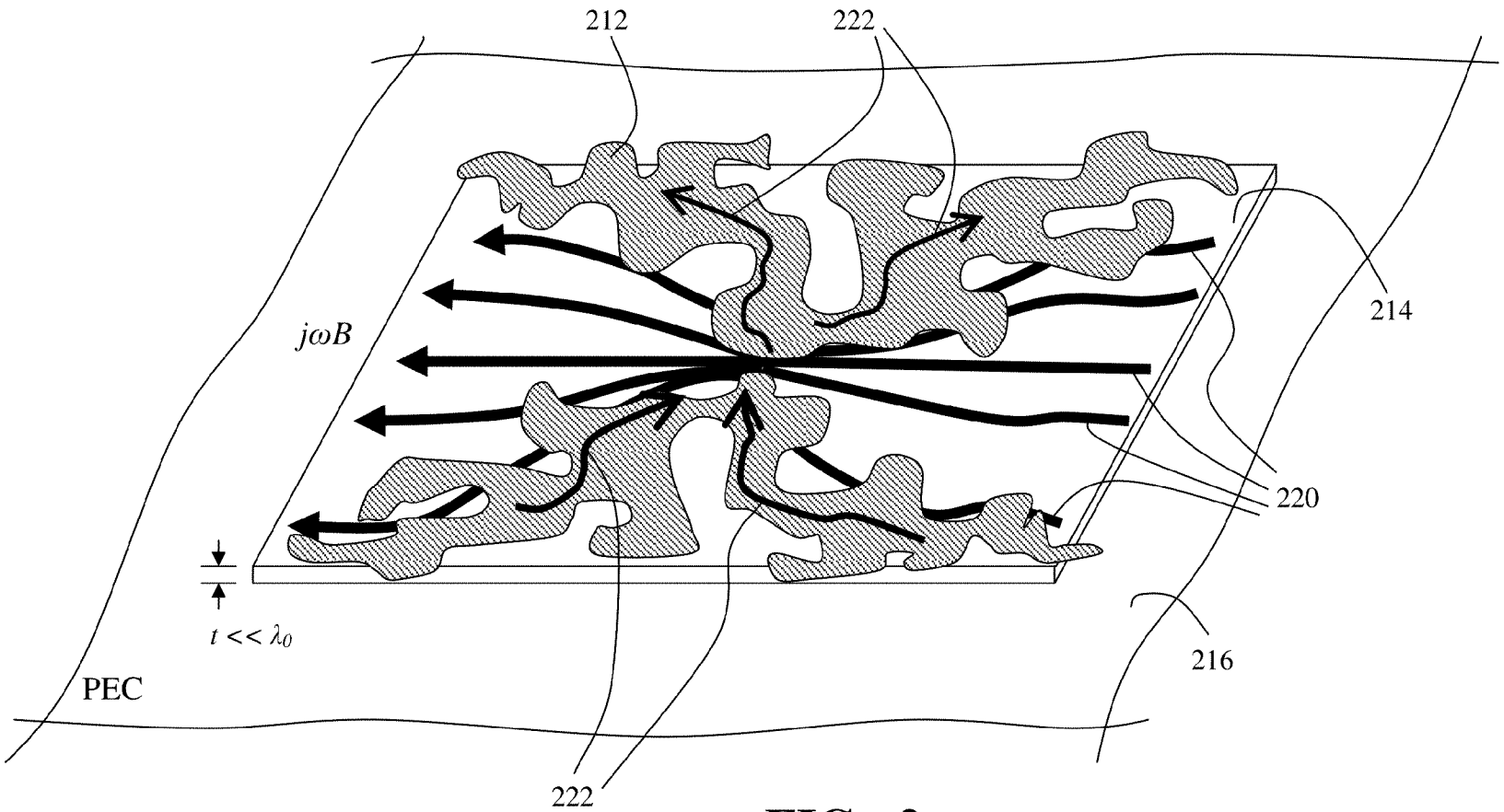
FIG. 2 depicts a simplified block diagram representation of an arbitrarily shaped trigger or actuator constructed from electrically conductive material positioned relative to a high permeability structure.

FIG. 2 depicts a simplified block diagram representation of an arbitrary shaped trigger or actuator 212 constructed from electrically conductive material positioned relative to a high permeability structure 214 of thickness or height $t \ll \lambda_0$ and finite area. The high permeability structure 214 is further positioned proximate to an electrically conductive surface or ground plane 216, which for some considerations can be considered a perfect electric conductor (PEC).

The structure in FIG. 2 can be viewed to have two potential sources of radiation, the electric currents on the electrically conductive material (e.g., metal) 212 and the volumetric magnetic displacement currents 220 in the high permeability structure substrate 214. The volumetric magnetic displacement currents 220 can be excited in the high permeability structure 214 from electric currents 222 ($J_e$) in the electrically conductive actuator 212. The volumetric magnetic displacement currents 220 in the high permeability structure 214 are defined by:

$$J_m = j\omega\mu_0(\mu_r - 1)H. \quad \text{(Equation 4)}$$

By the volume equivalence principle, the high permeability substrate can be removed, and the combination of these currents should completely account for the entire electromagnetic field outside the source. Removing the ground plane, by invoking the method of images, it has been identified that the images of the electric currents being anti-linear and at small distance 2t from their sources effectively cancel the radiation from the electrically conductive material 212. As such, the effective radiators contributing to the electromagnetic field in the upper half space above the high permeability structure 214 are the magnetic currents 220 and their co-linear images of the permeable slab of thickness 2t and carrying the current Jm.

The performance limit of such an antenna can be estimated by considering antennas that are relatively electrically small. Based on the theory of elementary dipoles, the radiation resistance of a realistic dipole (of length l) carrying a triangular current distribution (vanishing at the ends) is of the order of 200 $(l/\lambda)^2$. If a current on that dipole can be forced to be nearly uniform (e.g., by loading the ends of the dipole with a top-hat) then the radiation resistance can effectively quadruple to a maximum of about 800 $(l/\lambda)^2$. Knowing this radiation resistance and the capacitance allows the quality factor (Q) of this dipole to be defined by:

$$Q_{dipole} = \frac{1}{\omega C R_{rad}}. \quad \text{(Equation 5)}$$

Assuming the linear dipole capacitance is of the order of $\pi\in_0(l/2)$ (Schelkunoff's zeroth order approximation) and letting a=(l/2), it is illustrative to compare the bandwidth to the FCh limit:

$$\mathrm{Max}\left(\frac{1}{Q_{dipole}}\right) \approx 0.676(ka)^3. \quad \text{(Equation 6)}$$

Thus, assuming a uniform current is attained, a dipole in free space can achieve a performance that closely approaches the FCh limit. With a relatively uniform magnetic current over the high permeability structure 214, the quality factor (Q), bandwidth and attainable wideband efficiency can be calculated. In considering these characteristics or factors, the problem may be reduced to calculating (a) a radiation resistance of a high permeability structure 214 carrying uniform current and (b) its capacitance.

For example, assuming a square high permeability structure 214 of thickness 2t, having a side length s, while carrying substantially a uniform current density, $J_e$ Amps/m$^2$, and invoking the theory of duality to consider the evaluation from an electric analogue of the problem, the radiated far field can be readily calculated in terms of sinc functions. Once this is done, the total power radiated may be calculated and set equal to ½ $I^2R$ in accordance with:

$$P_{rad} = \frac{1}{2}(J_e t s)^2 R_{rad}. \quad \text{(Equation 7)}$$

For the case of a square high permeability aperture structure 214 radiating into a half space the resulting radiation resistance is closely fit by the equation:

$$R_{rad} = 377\left(\frac{(ks)^2}{\frac{3.5^2}{1+\frac{(ks)^2}{10}} + (ks)^2}\right). \quad \text{(Equation 8)}$$

Similarly, to calculate the capacitance of the current-carrying high permeability structure 214 an expression is obtained that includes the constitutive property of the high permeability structure 214, which avoids the assumption that the structure 214 is a perfect conductor and takes into consideration the effects of the material permeability on the performance of the antenna. An approximation to this capacitance can be obtained by noting the relationship between the capacitance of a hypothetical perfect electrically conductive (PEC) spherical antenna and its induced dipole moment in the presence of a uniform ambient electric field, where:

$$p=\alpha E=4\pi a^3\in_0 E; \text{ and} \quad \text{(Equation 9)}$$

$$C_{sph} = \frac{3\pi}{2}\varepsilon_0 a. \quad \text{(Equation 10)}$$

When it is further assumed that the voltage across the sphere is:

$$V=E\cdot s,$$

where s=2a, and that the effective charges of the induced dipole are separated by a distance:

$$d = \frac{2}{3}s$$

that the following relationship can be established:

$$p=Qd=2\pi a^2\in_0 V. \quad \text{(Equation 11)}$$

Because $$C = \frac{Q}{V} = C_{sph}, \quad \text{(Equation 12)}$$

the capacitance can be calculated as:

$$C \approx \frac{\alpha}{\frac{2}{3}s}. \quad \text{(Equation 13)}$$

By analogy, the capacitance of a material sphere with $\in_r\neq\infty$ follows from knowing that the polarizability, α, is that of a PEC sphere derated by a factor $(\in_r-1)/(\in_r+2)$. Since the polarizability of an oblate ellipsoid in a uniform ambient field is known, this approach can be used to estimate the capacitance of a square (or rectangular or other relevant shape) high permeability material structure 214.

Following Fricke, the polarizability of an oblate spheroid is obtained as follows. Let the constitutive property of the material be k2 and that of the surrounding space be k1 (nominally=1) and define the aspect ratio as:

$$ar=\text{thickness/sidelength}=2t/s,$$

then:

$$\phi=a\cos(ar),$$

$$M = \frac{\varphi - \frac{1}{2}sig(2\varphi)}{\sin^3(\varphi)}\cos(\varphi), \quad \text{(Equation 14)}$$

$$\beta = \frac{1}{3}\left[\frac{2}{1+\left(\frac{k2}{k1}-1\right)\frac{M}{2}} + \frac{1}{1+\left(\frac{k2}{k1}-1\right)(1-M)} + \right]\left(\frac{k2}{k1}-1\right). \quad \text{(Equation 15)}$$

Accordingly, the polarizability can be calculated from:

$$\alpha=\beta\cdot\mathrm{Vol}=\beta\cdot 2t\cdot s^2. \quad \text{(Equation 16)}$$

As such, the capacitance can be calculated in accordance with Equation 13 above. In considering conformal antennas radiating into a half space, where the radiation resistance was also calculated for a half space, the effective capacitance generally is also half this value in accordance with:

$$C \approx \frac{\alpha}{\frac{4}{3}s^2}. \quad \text{(Equation 17)}$$

As an example, consider an antenna intended to operate from 30 MHz to above 300 MHz. Size limitations are defined such that a high permeability structure 214 is defined by a thickness of about 0.5 inches (i.e., t=0.5 inches) and of rectangular shape with dimensions of about 24 inches by 15 inches. It is noted that an equivalent square has the mean side length s that is about equal to 19 inches. First, for a realistic estimate it is assumed that the electrically conductive actuator 212 does not attain a uniform current distribution, and thus, it is further assumed that a resulting radiation resistance is half of that given by Equation 8 above.

Figure 3A:
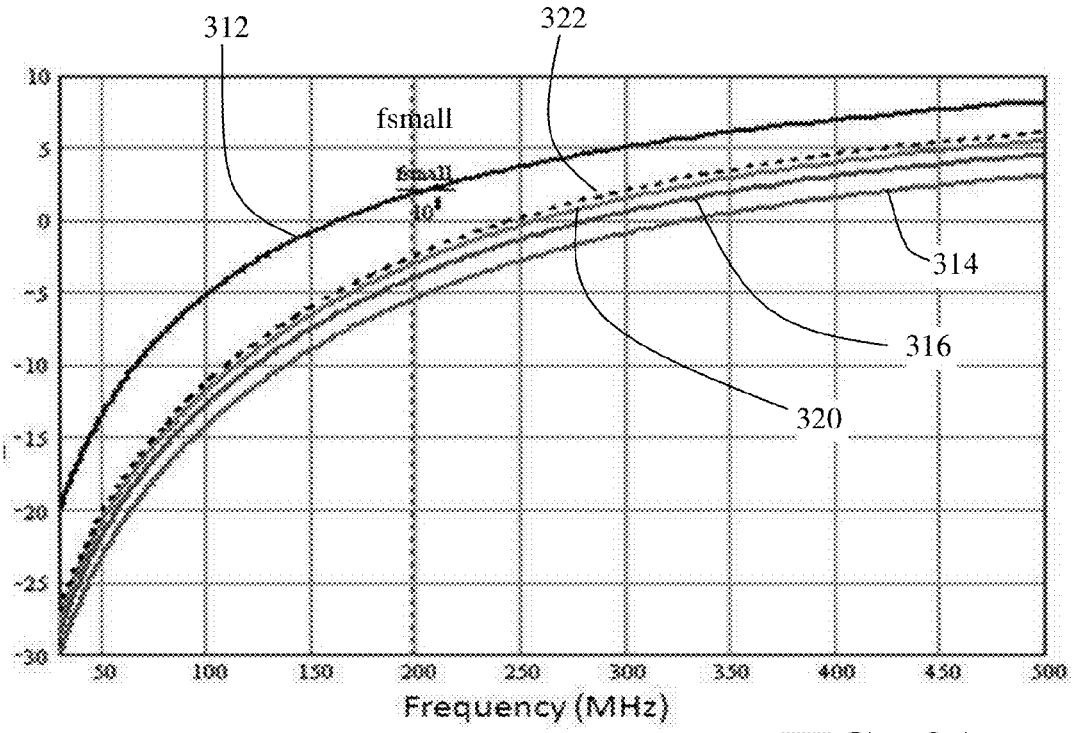
FIG. 3A shows a graphic relationship of gain to frequency relative to the Fano-Chu 2D limit for the high permeability structures of varying permeabilities.

FIG. 3A shows a graphic relationship of gain to frequency relative to the FCh 2D limit for the high permeability structures 214 of varying permeabilities (e.g., 20, 40, 80, and 160). Additionally, FIG. 3A compares a maximum attainable wideband gain in dB to the FCh limit by letting bandwidth=1, and assuming the "elementary dipole" directivity is of the order of 3 (as a result of radiating into a half space).

The theoretical FCh 2D limit is identified by reference numeral 312. The frequency at which the proposed antenna is the size of the radian sphere is marked as fsmall. A first curve 314 corresponds to the proposed high permeability structure 214 theoretically having a permeability of 20; curve 316 corresponds to a theoretical permeability of 40; curve 320 corresponds to a theoretical permeability of 80; and curve 322 corresponds to a theoretical permeability of 160. As can be seen in FIG. 3A, there is a 2 dB benefit in going from a permeability of 20 to a permeability of 40. The transition between the other permeabilities provides less of a change, while achieving an additional 2 dB at a permeability of 160. It is predicted that going to the limit of a theoretical perfect magnetic conductor (PMC) will reach the asymptotic limit of the proposed aperture, which is approximately −5 dB below the FCh 2D limit.

Figure 3B:
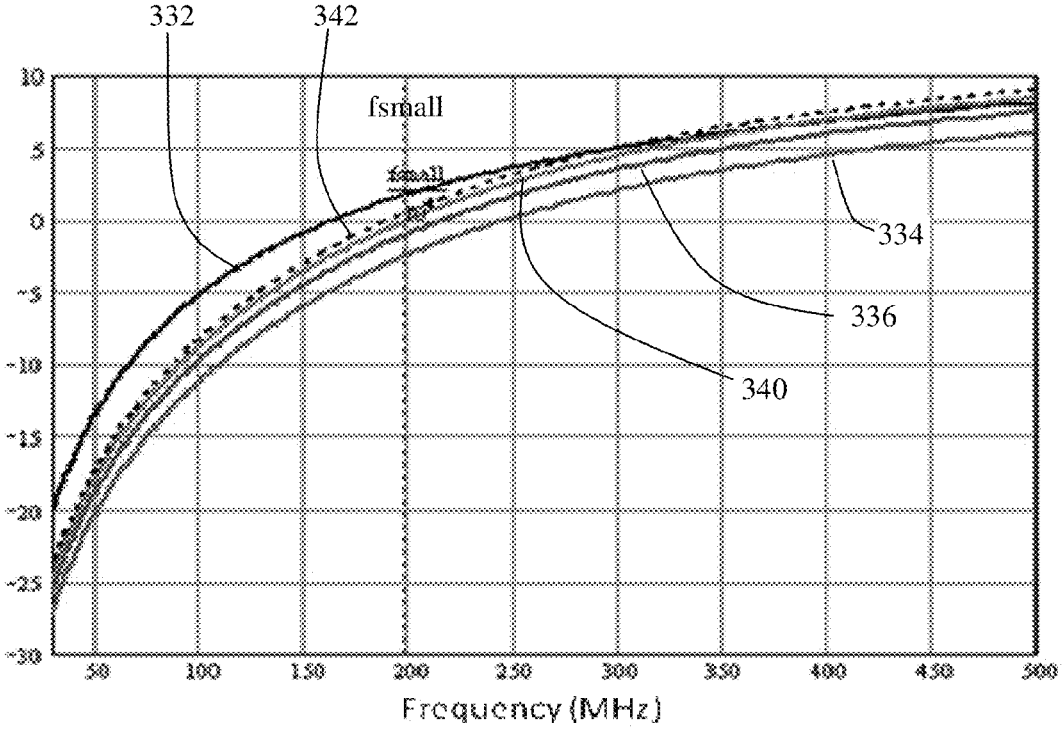
FIG. 3B shows an alternative graphic relationship of gain to frequency relative to the Fano-Chu 2D limit for the high permeability structures of varying permeabilities when it is assumed that the actuator is designed to attain a uniform magnetic current distribution over the high permeability structure.

FIG. 3B shows an alternative graphic relationship of gain to frequency relative to the FCh 2D limit for the high permeability structures 214 of varying permeabilities when it is assumed that the actuator 212 is designed to attain a uniform magnetic current distribution over the high permeability structure 214. With this assumption the full radiation resistance of Equation 8 is applicable.

The theoretical FCh 2D limit is identified by reference numeral 332. A first curve 334 corresponds to the proposed high permeability structure 214 theoretically having a permeability of 20; curve 336 corresponds to a theoretical permeability of 40; curve 340 corresponds to a theoretical permeability of 80; and curve 342 corresponds to a theoretical permeability of 160. As can be seen in FIG. 3B, the performance is improved by about 3 dB and approaches the FCh 2D limit. The fact that some of the curves exceed the FCh limit above the fsmall frequency can be considered unimportant since the FCh limit is derived assuming that the sphere of concern is smaller than the radian sphere. Above fsmall other limits can be used, for instance the limit of the directive gain of a uniform aperture.

The above analysis provides a relatively simple guideline or process for designing high-impedance substrate conformal antennas. In this design process, the closed-form expressions can be used to determine minimum dimensions for a given high impedance structure to attain a given Gain-Bandwidth Product performance. The optimization of the electrically conductive actuator 212 is made to yield a uniform current in the high permeability structure 214. This optimization can include optimizing a shape and feeding mechanism of the actuator 212. With a resulting radiation quality factor (Q) at the feed of the conductive actuator 212, the Bode-Fano criterion can be used to determine an approximate achievable input match for the desired bandwidth and efficiency.

The above analysis suggests that a conformal antenna using high impedance materials can approach the physically realizable 2D Fano-Chu limit. The fact that this performance limit, in some instances, may be −6 dB below the 3D limit is a consequence of restricting the antenna to exist on a surface and not due to the materials or the antenna design. Therefore, the area needed by a conformal antenna to attain the same gain-bandwidth product as an antenna free to be shaped in three dimensions is essentially four times larger (6 dB). Fortunately most non-conformal antennas to be replaced by conformal antennas do not come close in performance to the 3D FCh limit. In some implementations, a conformal version meeting the same performance and/or criteria may be at least twice as large as a 3D antenna. Conformal antennas need a sufficient surface area ("real estate") to attain their optimal performance. This surface area is the cost associated with utilizing a conformal antenna. The pay-off is the potential for truly conformal radiators realized with high impedance materials.

The radiation properties of an antenna composed of metal surfaces can be closely approximated by a similar antenna composed of metal wires that trace the perimeter of the original antenna's metal surfaces. This realization led to the development of wire log periodic and spiral antennas.

Since, as shown above, the GBWP limit of 2D surfaces can be approached by a high impedance surface, it would expect that an antenna consisting of a high-impedance perimeter outlining the same surface area would attain essentially the same or similar performance. Accordingly, going from an area paradigm to a perimeter paradigm can lead to savings in the cost and weight of the antennas.

As described above, the use of pseudo-conductor technology in accordance with some embodiments is based on the realization that dielectric ($\in'>\in''$) or magnetically permeable objects ($\mu'>\mu''$) can partially guide electromagnetic waves even when electrical dimensions of these objects are not large enough to guarantee the propagation of a slow-wave eigenmode. This partial guidance property can be used to lead an electromagnetic wave from a feed region, generally over the object's surface, to the termination of the object where the wave radiates. Antennas constructed from such materials or objects are referred to as pseudo-conductor antennas because the mechanism of radiation and the appearance of a feed impedance can be analogous to the phenomena associated with antennas formed by electrically conducting materials such as metals ($\in''>>\in'$) or perfect magnetic conductors ($\mu''>>\mu'$).

By the theory of electromagnetic duality, the descriptions and theories presented below relative to embodiments utilizing dielectric objects equally apply to magnetically permeable objects, and vice versa. As such, for simplicity much of the description below is directed to one of a dielectric object or a magnetically permeable object, but by duality the descriptions, theories and results similarly apply to a magnetically permeable object or dielectric object, respectively. Therefore wherever a conduction current is mentioned it is understood to represent either an electric current or a magnetic current as applied to the respective dielectric or magnetically permeable pseudo-conductor objects.

Similarly the concepts of the polarization current, capacitance, inductance, resistance and so forth, exist both as the conventional electric quantities and as magnetically dual quantities. The difference between them lies in the units: electric current is measured in Amps, magnetic current is measured in Volts. Electric resistance is measured in Ohms; and magnetic resistance is measured in Mhos or Siemens. Electric inductance is measured in Henries and capacitance in Farads; the converse is true for the magnetic quantities. U.S. Pat. Nos. 5,675,306 and 5,993,164, which are incorporated herein by reference in their entirety, provide description of this duality.

Figure 4A:
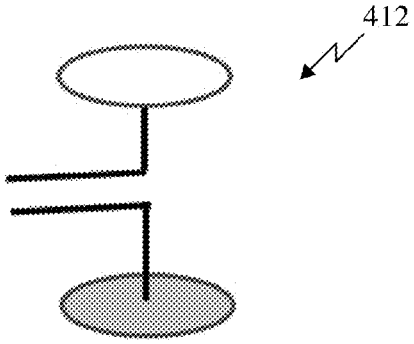
FIG. 4A shows a simplified block diagram of an elementary electric dipole antenna.
Figure 4B:
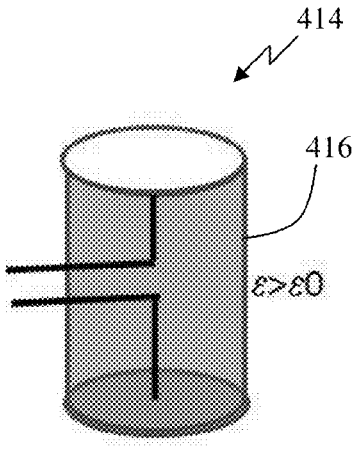
FIG. 4B shows a simplified block diagram of an elementary electric dipole antenna with dielectric material between terminals of the antenna.
Figure 4C:
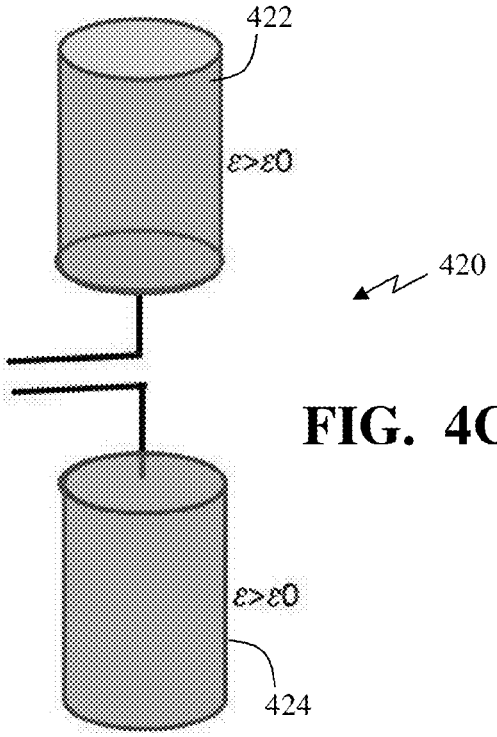
FIG. 4C shows a simplified block diagram of an elementary electric dipole antenna with dielectric material positioned outside of the dipole elements.

Various antenna design methods tend not to take account of effects of pseudo-conductor materials as radiating elements in antenna. FIGS. 4A, 4B and 4C show one example using materials with high permittivity or permeability for improving the performance of electrically small antennas. Schelkunoff first showed that winding a coil around a ferrite rod increases the radiation efficiency of the coil by increasing the radiating dipole moment. Then Schelkunoff further asserted that in the case of a dipole antenna or a capacitor antenna loaded with a dielectric, the effect is the opposite and that the density $j\omega(\in-\in 0)E$ of the polarization current in the dielectric is in the direction opposite to that of the current in the dipole. As such, Schelkunoff concluded that the radiating current is reduced.

FIG. 4A shows a simplified block diagram of an elementary electric dipole antenna 412, similar to that considered by Schelkunoff, where two circular metal plates are attached to the ends of the two metal wires of the dipole antenna as the capacitor terminals. FIG. 4B shows a simplified block diagram of an elementary electric dipole antenna 414 with dielectric material 416, as recommended by Schelkunoff, between the capacitor terminals of the antenna 414. In such a configuration, as asserted by Schelkunoff the radiation efficiency is reduced as a result of the dielectric load with the density $j\omega(\in-\in 0)E$ of the polarization current in the dielectric is in the direction opposite to that of the current in the dipole resulting in reduced radiating current.

FIG. 4C shows a simplified block diagram of an elementary electric dipole antenna 420 where two dielectric material 422 and 424 are positioned outside of the dipole elements and are, respectively, attached to the two circular metal plates. In this configuration, the polarization current in the dielectric material now points in the same direction as the antenna currents. Therefore, there is an increase in the dipole moment of the dipole antenna 420.

The configuration as shown in FIG. 4C for placing dielectric materials 422 and 424, instead of using two metal materials, outside the dipole elements in the dipole antenna deviates from the conventional metal antenna design methods that further electrically conductive material, rather than dielectric material, should be positioned outside the dipole elements. In other words, the metal of the dipole elements or "capacitor" plates is proposed to extend in both directions into a rod-like shape to form a classic dipole antenna. Under conventional metal antenna design methods, metal is generally a guiding surface of electric field and a metal antenna is an open transmission line that guides the fundamental transmission line mode to its extremities where discontinuities cause the creation of higher order modes that radiate power off. When a conductor is a biconical antenna, the guided transmission line mode is most strongly attached to the metal. When the cross section deviates from the biconical along the length (as in a cylindrical rod antenna), the wave sheds as it travels. The extreme of shedding happens, for example, when the metal is curved continually as in a spiral antenna. In the case of a spiral antenna, when the wave reaches a distance from the origin that enables strong coupling to the higher order radiating modes, the energy leaves the metal guiding surface efficiently.

Pseudo-conductor antennas disclosed in this document operate based on weakly wave guiding surfaces of a pseudo-conductor material and use the pseudo-conductor material to replace the metal in electrically conductive antennas. For example, a dielectric or permeable rod or other shaped material may be structured in such a way that the weakly guided radially polarized mode is excited in the dielectric or permeable structure. Such a weakly guided wave propagates along the dielectric or permeable structure in analogy to the waves guided by electric conductors. As such, in some implementations, antennas can be designed and constructed using pseudo-conductor material, such as dielectrics (e.g. plastics), with configurations that were previously thought to be only applicable to metal antennas while still meeting antenna parameters and/or performance and in some instances exceeding antenna parameters and/or performance of the metal antennas. In addition, magnetically permeable objects and/or structures (e.g., rods) can similarly be used to construct antennas that were previously implemented with metal. Such magnetic pseudo-conductor antennas can be used adjacent to and/or in contact with an electrically conducting surface, which in some instances, can provide a symmetry plane where half the magnetic pseudo-conductor structure, conformal on the metal, becomes the antenna. As such, in utilizing a conductive surface effectively as a symmetry plane, free-space pseudo-conductor antenna designs can be implemented, in some embodiments, in cooperation with an electrically conductive surface by only utilizing half of the antenna (effectively cutting the antenna in half), where the electrically conductive surface effectively mirrors the radiation in the direction away from the conductive surface enhancing or aiding the radiation of the pseudo-conductor antenna.

The pseudo-conductor antenna technology and implementations described in this document are based on the realization that dielectric ($\in'>\in''$) or magnetically permeable objects ($\mu'>\mu''$) can partially guide electromagnetic waves from a feed region, generally over the object's surface, to the termination of the object where the wave radiates. Pseudo-conductor antennas can be constructed from such materials.

In the limit when an element is electrically small, a closed-form circuit model of the pseudo-conductor antenna can be used to explain how its behavior differs from that of a conventional conductor antenna. The following sections provide an analysis of an electrically small pseudo-conductor dipole antenna using the viewpoint of the electrically small approximation model of conventional conductor (PEC) antennas by Schelkunoff.

Following the theories of Schelkunoff, a wave guided over an electrically conductive elementary wire antenna is considered to be the principle wave or TEM (transverse electromagnetic) mode of the transmission line, where an end discontinuity can be modeled as a terminating admittance (or impedance) located at an open end of the antenna.

Consistent with Schelkunoff, an impedance of an electrically conductive antenna with a length equal to 2l can be defined as:

$$Z_a(kl)=R_a+jX_a, \qquad \text{(Equation 18)}$$

where:

$$R_a=60Cin(2klq)+30[2Cin(2kl)-Cin(2kl(1-q))-Cin(2kl(1+q))]\cos(2kl)+30[-2Si(2kl)+Si(2kl(1-q))+Si(2kl(1+q))]\sin(2kl)$$

$$X_a=60Si(2klq)+30\{Si(2kl(1-q))-Si(2kl(1+q))]\cos(2kl)+30[2\ln(1+q)+Cin(2kl(1-q))-Cin(2kl(1+q))]\sin(2kl)$$

where $q=\sin(\theta_o/2)$, and $\theta_o$ equals an angle between arms. An end capacitance of the antenna can further be defined by:

$$j\omega C_t = \frac{ja_t}{30\lambda}, \quad \text{(Equation 19)}$$

such that:

$$Y_t = \frac{Z_a(kl)}{Z_0^2} + j\omega C_t; \quad \text{(Equation 20)}$$

where $a_t$ is the logarithmic mean cross-sectional radius of the antenna. In Equation 20, $Z_0$ is the characteristic impedance of the transmission line that represents the antenna. The above model is stated by Schelkunoff to be accurate for antennas with characteristic impedance of about 500 Ohms or higher, and approximately applicable to antennas of impedances as low as about 300 Ohms.

The input impedance seen at the feed of the antenna is then given by rolling this terminating load back to the feed through the length of the arm. For the case of biconical antennas the closed form formula is given by:

$$Y_{input} = Y_0 \frac{Y_t\cos(kl) + jY_0\sin(kl)}{Y_0\cos(kl) + jY_t\sin(kl)}, \text{ or inverting} \quad \text{(Equation 21)}$$

$$Z_{input} = Z_0 \frac{Z_0\cos(kl) + jZ_a + j\omega C_t Z_0^2)\sin(kl)}{(Z_a + j\omega C_t Z_0^2)\cos(kl) + jZ_0\sin(kl)}.$$

It is additionally noted that a guided wave on a metal antenna travels nearly at the speed of light, and therefore, it qualifies as a guided wave on an "open" waveguide. By contrast the waves supported by some dielectric rods are not necessarily guided. The lowest order mode (HE11), like the wave on a metal antenna, typically exhibits substantially no cutoff and travels nearly at the speed of light at low frequencies. The HE11 mode, however, carries a field inside the dielectric that is linearly polarized transverse to a rod axis. This is not of the same form as the field carried on the exterior of a conventional conductor antenna which is generally radial, and perpendicular to the surface of the conductor. The mode that carries a radial field relative in a dielectric (or permeable) rod is the first transverse electric (TE) or transverse magnetic (TM) mode and they have a definite cutoff frequency. The onset of propagation occurs when the rod diameter is of the order of the wavelength inside the rod. Below this frequency the waves are typically leaky and relatively poorly guided by the dielectric boundary.

Thus, with pseudo-conductor antennas the guided current wave is typically rapidly attenuated along the length of the antenna at low frequencies. Above cutoff the wave resembles more closely the guided current wave on conventional conductor antennas. In some instances, if the pseudo-conductor is electrically too thick, then there typically would be a higher frequency at which the structure transitions to a tightly guided wave and acts like a polyrod.

Further, as Schelkunoff points out, the terminating impedance represents the effect of radiation and local storage of energy near the end of the antenna. Therefore if the electromagnetic field delivered to an antenna termination by a dielectric (permeable) object is geometrically similar to the field that would be delivered by a conventional conductor antenna, the terminating impedance is similar or essentially the same for both cases.

In further understanding the pseudo-conductor antenna, an electrically small antenna is considered below. A conventional conductor electrically small dipole is a capacitive object. Schelkunoff defines the capacitance of a small biconical antenna by integration of the distributed capacitance of the near field as:

$$C_{an} = \frac{\pi\varepsilon l}{\ln\left(\frac{2l}{a}\right) - \ln 2} + 2\varepsilon a. \quad \text{(Equation 22)}$$

In considering the terminating admittance, the total capacitance generally has to equal the parallel sum of the capacitance of the principle wave of the TEM line plus the capacitance in the terminating admittance:

$$C_{TEM} = \frac{l}{c_0 z_0}; \; C_t = \frac{Im(Y_t)}{\omega}. \quad \text{(Equation 23)}$$

Here, $z_0$ is the TEM impedance of the biconical transmission line and c0 is the speed of light.

Figure 5:
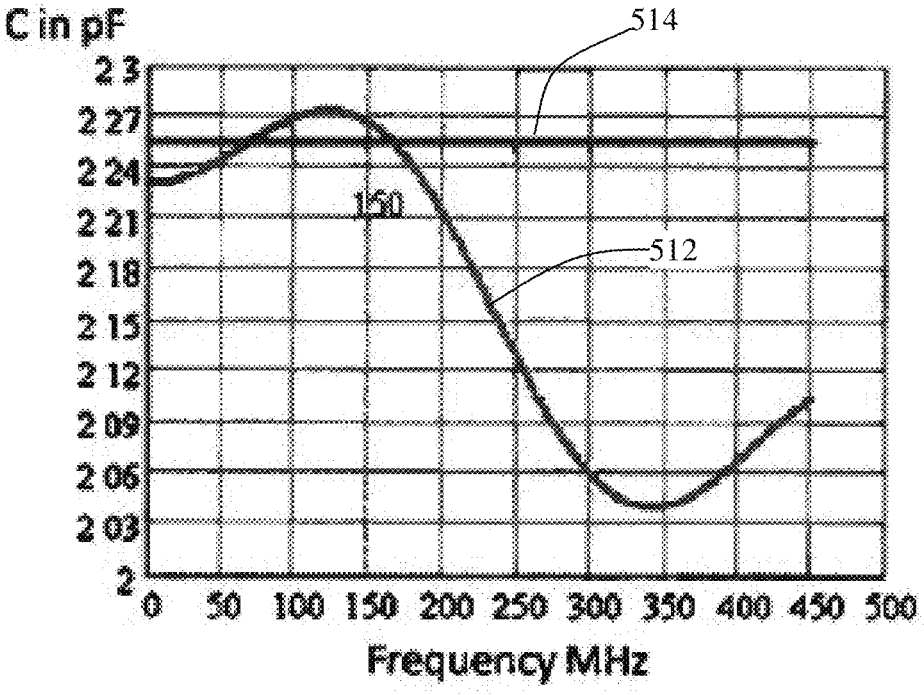
FIG. 5 shows a simplified graphical relationship between the sum of the TEM capacitance and the terminating capacitance relative to frequency, and antenna capacitance relative to frequency.

FIG. 5 shows a simplified graphical relationship between the sum of the TEM capacitance and the terminating capacitance relative to frequency, identified by reference numeral 512, and antenna capacitance, identified by reference numeral 514, relative to frequency, for a 1 meter conventional electrically conductive dipole (resonant at about 150 MHz), with a=0.001 m. As can be seen, the sum of the TEM capacitance and the terminating capacitance relative to frequency is within about 1% of the electrically small approximation (see Equation 22 above) up to frequencies above the half wave resonance.

This degree of agreement typically holds for 1 m dipoles as thick as about a=0.1 m, provided the end correction, 2 ∈a, of Equation 22 above is modified to about 1.33 ∈a. This slight change with over two orders of magnitude change in the cross sectional radius highlights the fact that the expression of Equation 22 is a fairly accurate approximation at least when the end capacitance effect is a perturbation of the total capacitance.

With this background it is possible to develop the theory of pseudo-conductor antennas to any degree of approximation required by the practitioner. For simplicity, the below discussion is described with reference to a dielectric object; however, by duality (as further described below) a similar analysis, considerations and results applies to a magnetically permeable materials. A pseudo-conductor antenna differs in at least two ways from conventional metal antennas. First, because the material is penetrable (e.g., when its skin depth is greater than the cross sectional radius), it contains an internal inductance per unit length that is usually neglected in metal or PEC antennas. Second, the current flowing in a dielectric antenna is not the integration of the electric current density over the cross section, $I=\iint J dS$. Instead, the current flowing in a dielectric antenna is defined, at least in some implementations, by the integration of the polarization current (flowing through the material which in general has a complex permittivity):

$$I = \int\int \frac{\partial P}{\partial t} dS.$$

Therefore, in series with the inductance of the electrically small dipole model, there is also the internal susceptance of the dielectric object.

Figure 6:
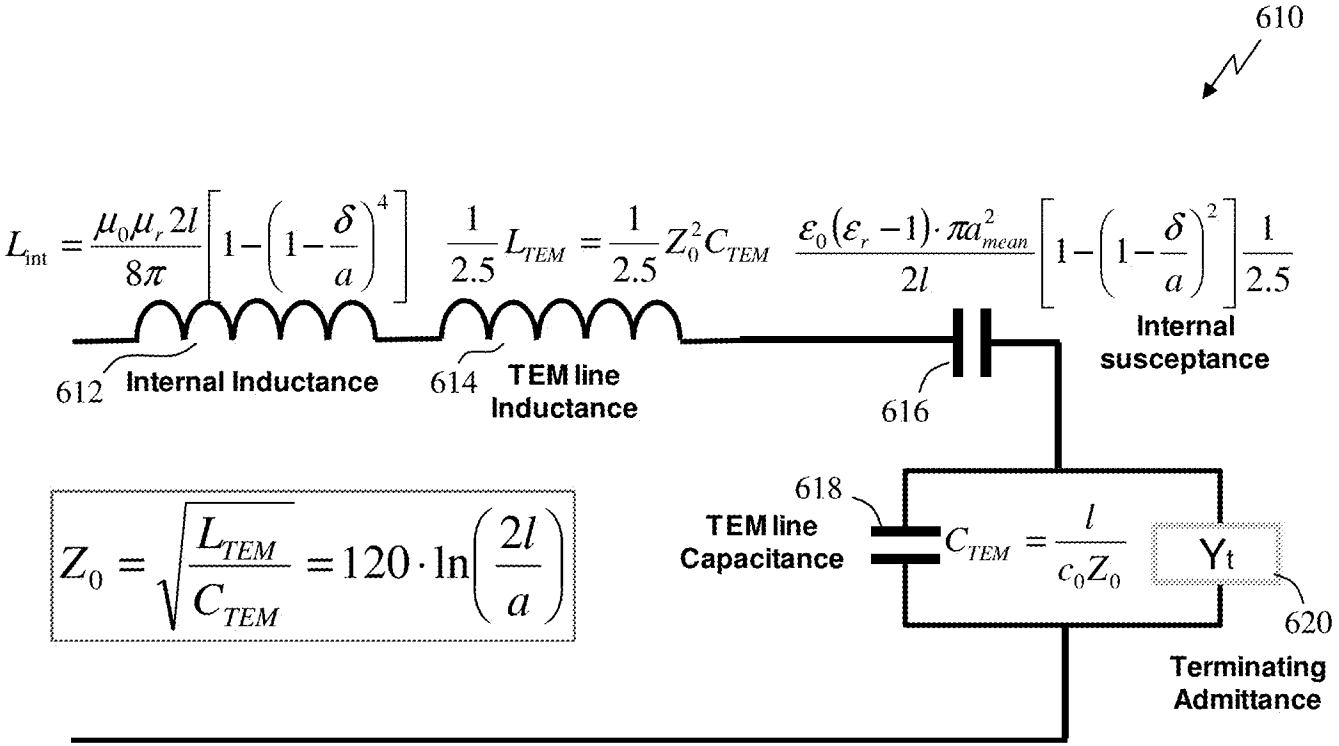
FIG. 6 shows a circuit model in the electrically small limit of a dielectric dipole model.

FIG. 6 shows a circuit model 610 in the electrically small limit of a dielectric dipole model. In this circuit model 610 an internal inductance 612, a transverse electromagnetic (TEM) line inductance 614 and the above identified internal susceptance 616 are coupled in series with a shunt combination of the transmission line capacitance 618 coupled in parallel with a terminating admittance 620 (sometimes referred to as Schelkunoff's terminating admittance). The internal inductance 612 can be defined by:

$$L_{int} = \frac{\mu_0 \mu_r 2l}{8\pi}\left[1 - \left(1 - \frac{\delta}{a}\right)^4\right], \quad \text{(Equation 24)}$$

where δ is the skin depth, which is defined as $\delta = |\mathrm{Im}(k_0 \sqrt{\mu_r \epsilon_r})|^{-1}$.

The TEM line inductance 614 can be defined by:

$$\frac{1}{2.5} L_{TEM} = \frac{1}{2.5} Z_0^2 C_{TEM} \quad \text{(Equation 25)}$$

where $Z_0$ is defined by:

$$Z_0 = \sqrt{\frac{L_{TEM}}{C_{TEM}}} = 120 \cdot \ln\left(\frac{2l}{a}\right).$$

The internal susceptance 616 can be defined by:

$$B = \frac{\varepsilon_0(\varepsilon_r - 1) \cdot \pi a_{mean}^2}{2l}\left[1 - \left(1 - \frac{\delta}{a}\right)^2\right]\frac{1}{2.5}. \quad \text{(Equation 26)}$$

The TEM line capacitance 618 can be defined by:

$$C_{TEM} = \frac{l}{c_0 Z_0}. \quad \text{(Equation 27)}$$

The skin depth δ affects both the internal inductance 612 and the internal susceptance 616 by limiting the cross sectional area through which the current flows. To use the TEM parameters of a biconical antenna to model a small cylindrical dipole, the cross sectional radius used in the series susceptance and internal inductance is typically the mean radius, which often can be the radius at the distance l/2 from the feed thus approximating the cone assumed by Schelkunoff with a cylinder. Alternatively, in some instances Schelkunoff's concept of the logarithmic mean radius could be used.

Figure 7A:
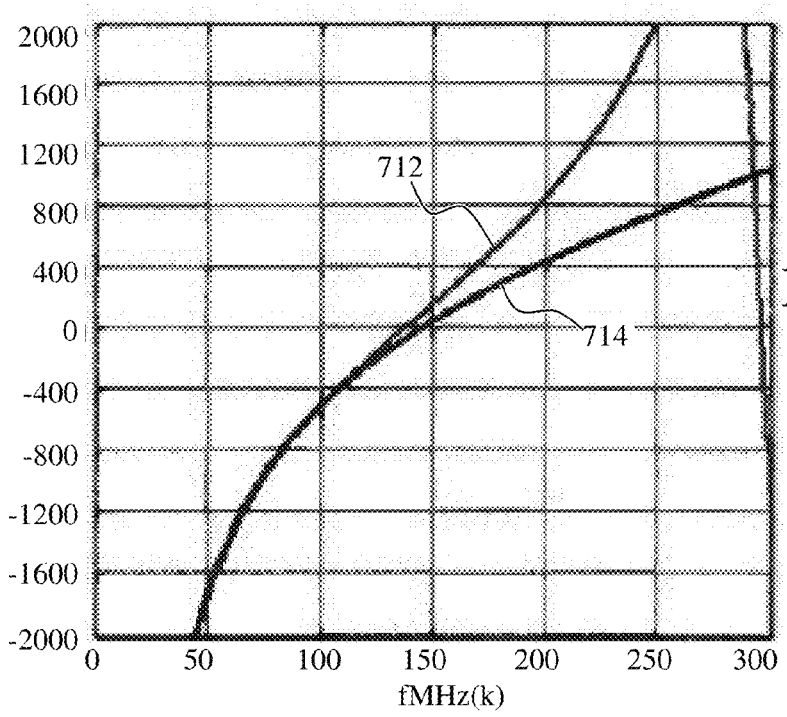
FIG. 7A depicts a graphic representation of the imaginary part of the impedance versus frequency of a metal antenna according to Schelkunoff's biconical transmission line modeling, and based on the lumped circuit model of FIG. 6.
Figure 7B:
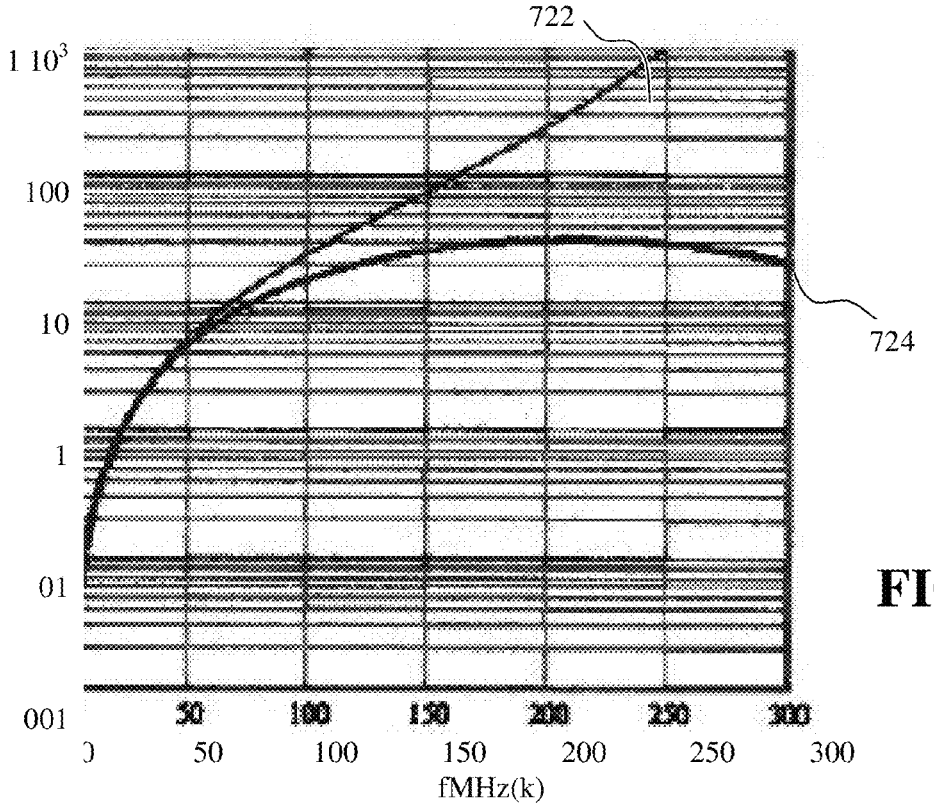
FIG. 7B depicts a graphic representation of the real parts of the impedance versus frequency based on the biconical transmission line model, and according the lump circuit model of FIG. 6.

FIG. 7A depicts a graphic representation of the imaginary part of the impedance versus frequency of a metal antenna (2l=1 m, a=0.0001 m), according to Schelkunoff's biconical transmission line model with terminating admittance (identified by reference number 712), and in the lumped circuit model 610 of FIG. 6 (identified by reference number 714) where the dielectric constant of the material of the antenna has been set to $\in = (1 - j10^{12}/\omega\in_0)$, an approximate PEC. FIG. 7B depicts a graphic representation of the real parts of the impedance versus frequency according to Schelkunoff's biconical transmission line model (identified by reference number 722), and according the lump circuit model (identified by reference number 724).

Referring back to FIG. 6, it is noted that the TEM line inductance 614 in the circuit mode 620 is generally the same as a conventional TEM inductance per unit length multiplied by the half-length of the dipole but derated by a factor of 1/2.5. Schelkunoff's low frequency approximation for this circuit inductance for PEC antennas is given by:

$$L_{an} = \frac{\mu l}{3\pi}\left(\ln\left(\frac{2l}{a}\right) - \frac{11}{6}\right),$$

which is essentially the TEM line inductance ($L_{TEM}$) 614 times ¼. As such, TEM line inductance 614 is derated by the fact that the square of the area under a triangular current distribution is one fourth that under the uniform current distribution of a line carrying a TEM wave. The factor of 1/2.5 is utilized instead of ¼ because it brings the resonance of the lumped circuit closer to the true half wave resonance of the dipole. In other words, it extends the validity of the lumped circuit model almost up to the half wave frequency. For the same reason the series susceptance 616 has been derated by the same factor. This correction factor maximizes the utility of the lumped circuit representation. Below a further antenna model is described that does not need this artifice.

The lumped circuit model 610 of FIG. 6 demonstrates one of the differences between a pseudo-conductor antenna and a metal antenna. A pseudo-conductor interposes a series capacitance (the internal susceptance 616 of the dielectric) between the transmission line wire and its termination. Since the terminating admittance of antennas below and near the half wave resonance is capacitive, this series capacitance reduces the total capacitance so that if a metal antenna of length 2l resonates near the frequency $\omega = 1/\sqrt{LC_{total}}$, this resonant frequency will be raised by the excess series capacitance. It has been confirmed that full wave simulations bear this out.

In an alternative model, that is in at least some respects more accurate, of a pseudo-conductor linear (e.g., cylindrical) dipole (having a length 2l and cross sectional radius a) is obtained by incorporating both the internal inductance and the internal susceptance into the series impedance per unit length of the transmission line and then terminating the line with Schelkunoff's terminating admittance. Because the series impedance parameters are expressed as an inductance the relationship between capacitance, inductance and impedance is used to define the effective inductance of a series capacitor:

$$Z = j\omega L,\ Z = \frac{1}{j\omega C} \therefore L_{eff} = -\frac{1}{\omega^2 C}. \quad \text{(Equation 29)}$$

In a differential length dz at a position z along a cylindrical antenna the effective distributed series parameters are:

$$L_{TEM} = \frac{\mu_0}{\pi}\ln\left(\frac{2z}{a}\right),\ L_{int} = \frac{\mu_0\mu_r}{4\pi}\left[1-\left(1-\frac{\delta}{a}\right)^4\right],$$
$$\frac{1}{\omega^2 C_{int}} = \frac{1}{\omega^2\frac{\pi a^2}{2}\varepsilon_0(\varepsilon_r-1)\left[1-\left(1-\frac{\delta}{a}\right)^2\right]},$$
(Equation 30)

The position, z, dependent TEM inductance is used to model the cylindrical antenna as a series of sections of biconical antenna. Because the series internal parameters were determined assuming a uniform flux density inside a cylindrical rod (and not a biconical rod) from the outset normalization is used to provide normalization relative to the TEM line parameters. For example, additional terms are normalized to the mean TEM inductance of a cylindrical antenna defined by:

$$L_{mean} = \frac{\mu_0}{\pi}\ln\left(\frac{2l}{ae}\right).$$
(Equation 31)

Therefore, $$L_{trans} = \left[1+\frac{L_{int}}{L_{mean}}-\frac{1}{\omega^2 C_{int} L_{mean}}\right]L_{TEM}.$$
(Equation 32)

This is the effective position dependent series inductance of the line. The shunt capacitance per unit length is then defined by:

$$C_{tran} = \frac{\pi\varepsilon_0}{\ln\left(\frac{2z}{a}\right)}.$$
(Equation 33)

Similarly, the impedance and propagation constant of the pseudo-conductor transmission line are defined by:

$$Z_{ps} = \sqrt{\frac{L_{trans}}{C_{trans}}},\ \text{and}$$
(Equation 34)

$$k_{ps} = \frac{1}{\sqrt{L_{trans}C_{trans}}}.$$
(Equation 35)

Schelkunoff's terminating impedance concept can further be applied to calculate properties of the antennas. Two subtleties in relation to Schelkunoff's work are further taken into account. The first is that Schelkunoff made approximations to reduce the exact equations to closed form under the assumption of slender antennas. The most fundamental of those simplifying assumptions is the assumed sinusoidal shape of the principal guided wave current. Since this assumption holds best for the biconical antenna, this antenna is used as a baseline. Other antenna shapes may, at least in some instances, be modeled as variations on this theme. The factor of e in the denominator of Equation 31 is an example of one of those "variations" where Schelkunoff shows that for a cylindrical antenna the mean antenna impedance is related to the impedance of the biconical antenna of equal terminating radius by this simple modification.

The other common modification or correction factor is the concept of the dipole's apparent excess length due to end effects. This quantity is calculated by first using the actual physical length in Equation 18 and setting:

$$\delta_1 = \frac{1}{k}\operatorname{atan}\left(\frac{X_a}{Z_0}\right)+\frac{aZ_0}{60\pi},$$
(Equation 36)

where $Z_0$ is the impedance of the biconical line of same length and terminating radius of the antenna in question. The terminating impedance of Equation 18 can then be recalculated using as the antenna length the original length plus this frequency dependent excess length. This excess length can be significant in relatively thick or fat dipoles and can have the effect of rendering the current distribution on the antenna more uniform near the ends, which can raise the radiation resistance and increase the bandwidth of the antenna.

The terminating admittance and impedance are then calculated according to Equation 20 above. For Schelkunoff's closed form solutions $Z_0$ in Equation 20 is taken to be the mean impedance of the antenna. For biconical antennas impedance is approximately defined by $\mathbf{120}ln(\mathbf{2}l/a)$, while for cylindrical antennas the impedance is approximately defined by $\mathbf{120}ln(\mathbf{2}l/ae)$.

The input impedance is then the terminating impedance "rolled" through the transmission line using the input impedance equation. For biconical antennas this can be done in one step as in Equation 21. For cylindrical antennas this is typically performed through infinitesimal steps assuming that at every position z from the feed, the antenna has a local impedance $\mathbf{120}ln(\mathbf{2}z/a)$. Schelkunoff has approximated this continuous impedance transformation for the cylindrical antenna by using his M and N functions giving for the input admittance:

$$Yin_{Cy} = Y_{0Cy}\left[\frac{Y_{term}\cos kl + jY_{0Cy}\sin kl + j\frac{N}{Z_{0cy}^2}\cos kl + j\frac{M}{Z_{0cy}^2}\sin kl}{Y_{0Cy}\cos kl + jY_{term}\sin kl - \frac{M}{Z_{0cy}^2}\cos kl + \frac{N}{Z_{0cy}^2}\sin kl}\right].$$
(Equation 37)

With the use of fast computational resources, the continuous impedance transformation can be directly performed in discrete steps. In performing the computations, the segments into which the cylindrical antenna is divided are relatively much shorter near the feed where the impedance changes more rapidly than near the ends where the impedance changes more slowly. In this case the $Z_0$ in the terminating impedance is applied as the ordinary $Z_0$ of the biconical antenna because the last segment of the antenna in contact with this impedance is assumed to be a biconical line.

Figure 8A:
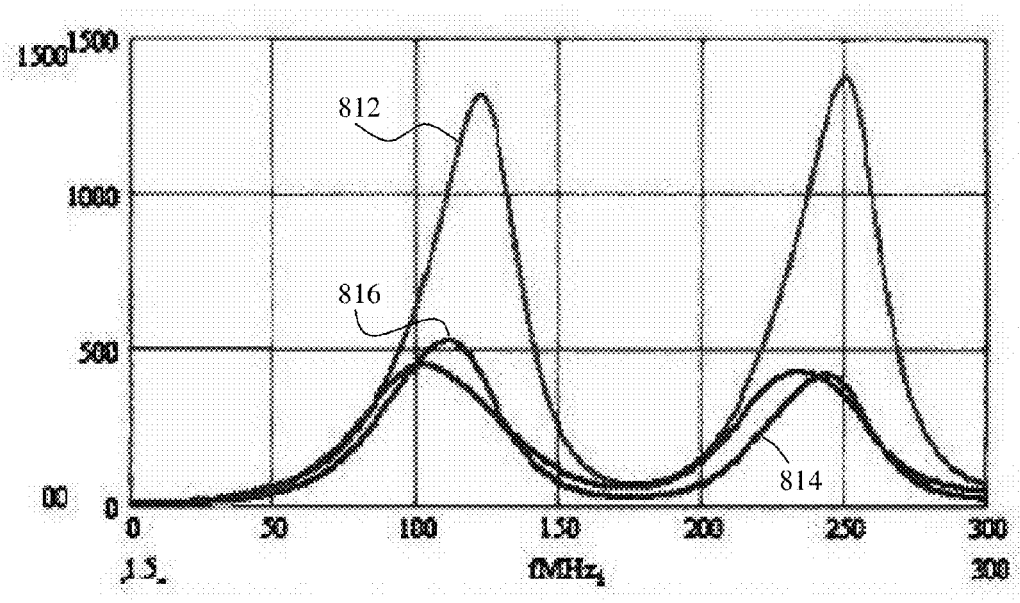
FIGS. 8A-8B depict graphic representations of the real and imaginary parts, respectively, of the impedance versus frequency of a metal antenna.
Figure 8B:
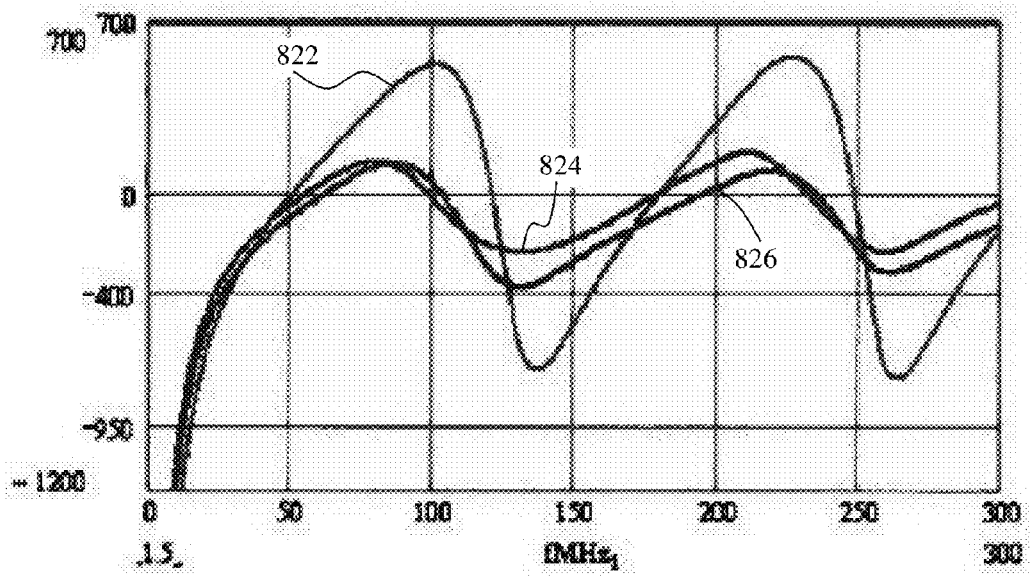

FIGS. 8A-8B depict graphic representations of the real and imaginary parts, respectively, of the impedance versus frequency of a metal antenna of total length 2l=2.18 m, and terminating radius a=0.043 m. The curves identified by reference numbers 812 and 822 correspond to the biconical antenna, curves identified by reference numbers 814 and 824 correspond to the cylindrical antenna assuming the approximation of Equation 37, and curves identified by reference numbers 816 and 826 correspond to the cylindrical antenna using the discrete transformation with 20 segments. The significant difference between biconical and cylindrical antennas for relatively large radii (e.g., where 0.043 m radius for approximately a 2 m long antenna is typically considered large in classic antenna theory) is evident in the peak of the antiresonant impedance when the antenna is approximately one wavelength long. The cylindrical antenna has a much lower antiresonant resistance (the first peak in the real part of Z) than the biconical antenna. The approximate nature of Equation 37 is evident in the slight difference between curves 814 and 816. It should be noted that all three antennas have the half-wave resonance (when the imaginary part of the impedance crosses zero) at approximately the same frequency (e.g., near 55 MHz).

The level of detail in the above model is provided to show that the antiresonance can have, in at least some implementations, a significant effect on the performance of pseudo-conductor antennas, such as some pseudo-conductor antennas fed using a shorted loop in accordance with some embodiments, as is further described below. The degree of agreement in FIGS. 8A and 8B between the discrete transformation (curves 816 and 826) and Schelkunoff's closed form result (curves 814 and 824) provides some confirmation that the identified working model is an accurate model to understand cylindrical antennas that are not slender.

Figure 9A:
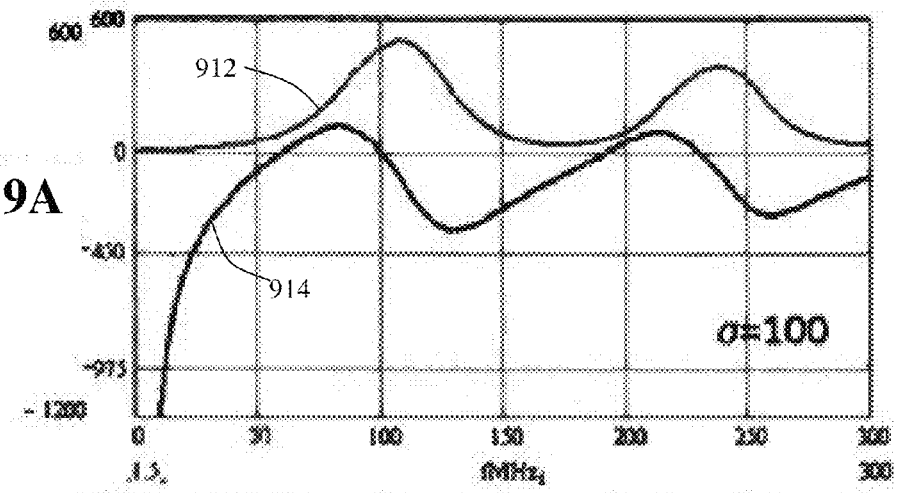
FIGS. 9A-9C each shows a graphic representation of the real and imaginary input impedance of a resistor antenna.
Figure 9B:
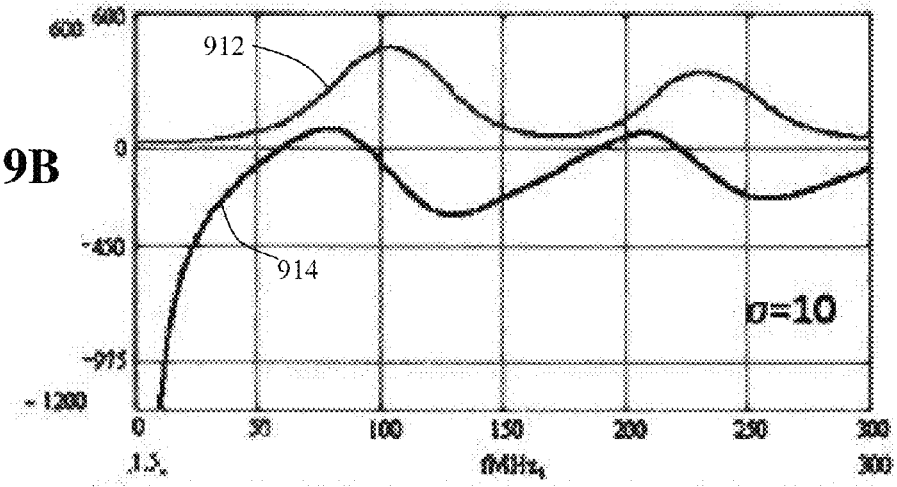
Figure 9C:
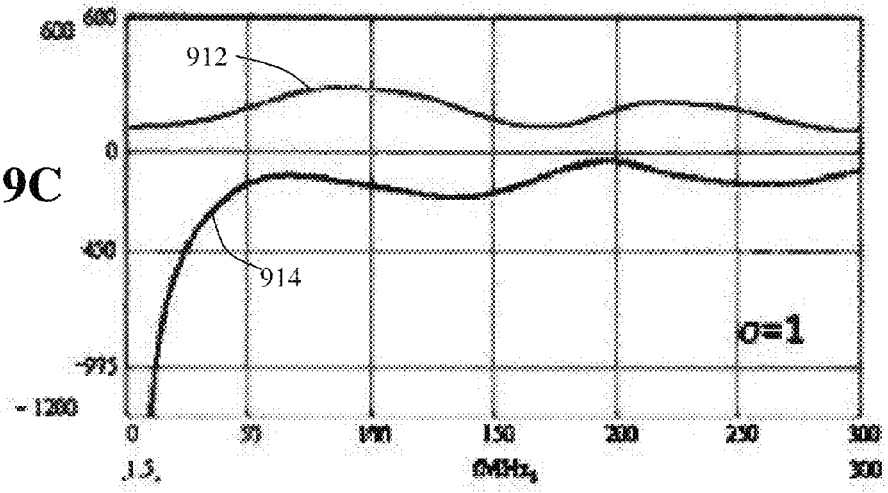
Figure 10A:
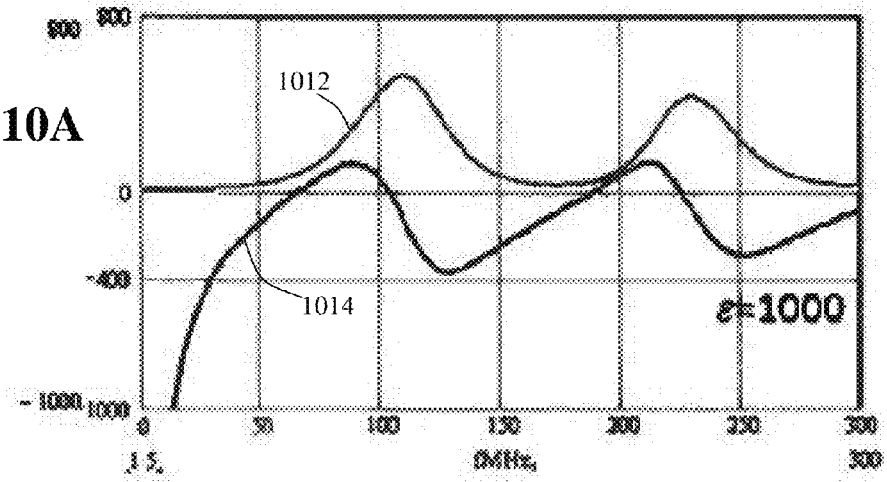
FIGS. 10A-10C show the result for the real curve and imaginary curve when there is minimal or no conductivity, and $\in r$ is varied.
Figure 10B:
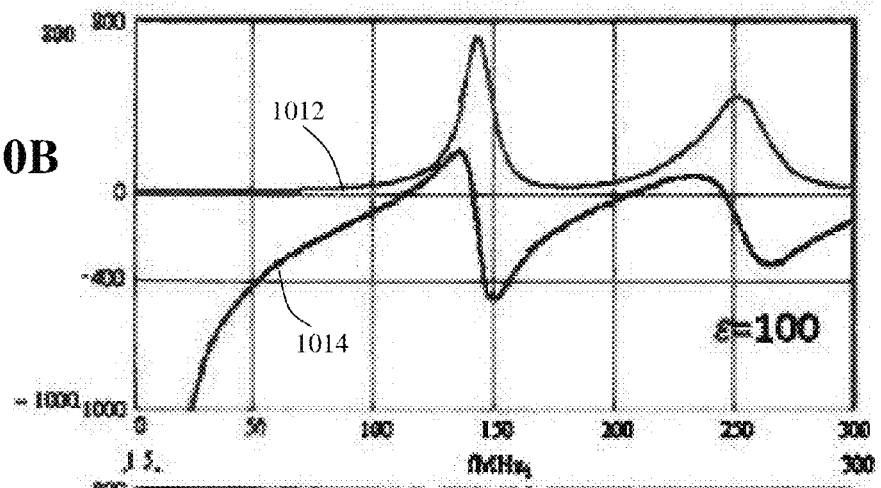
Figure 10C:
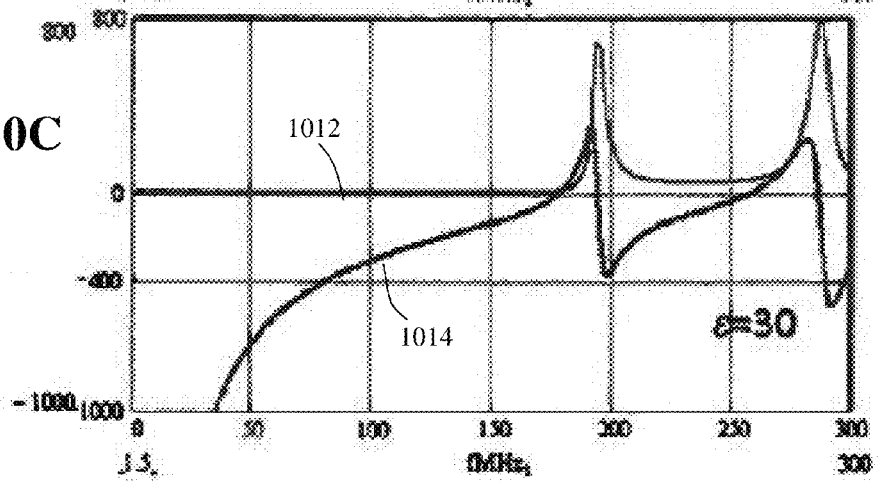

Using the model of the cylindrical pseudo-conductor antenna it can be seen how the behavior changes as the material changes from a conductor to a resistor and then to a dielectric. FIGS. 9A-C each show a graphic representation of the real and imaginary input impedance of a resistor antenna with $\mu r=1$, and $\in r=(1-j\sigma/\omega\in 0)$, for s=100, 10 and 1 S/m, respectively. As can be seen in FIG. 9A, the real curve 912 and imaginary curve 914 show negligible differences from the curves 816 and 826 of FIGS. 8A and 8B. The effects of increasing the resistance, however, become evident in FIGS. 9B and 9C with a more consistent impedance. FIGS. 10A-10C show the result for the real curve 1012 and imaginary curve 1014 when there is minimal or no conductivity, and $\in r$ is varied from 1000 to 100 to 30, respectively. As can be seen, FIGS. 10A-10C demonstrate a shift upwards in frequency expected from the electrically small antenna model. This shift in frequency is one of the differences between pseudo-conductor antennas and electrical conductor antennas or metal antenna.

The pseudo-conductor antenna conformal to a conducting surface can be designed based on the above duality and the proper selection of the materials of construction. Some embodiments may utilize an anisotropic material with relative permeability that is high along a first axis and relatively low in transverse directions. The relative permittivity in those transverse directions can be configured to range from 2.0 to as high as 100.

Similarly, some embodiments utilize an electric pseudo-conductor material comprising an anisotropic relative permittivity that is high along a first axis and controlled to be relatively low in transverse directions, while in some instances, the relative permeability in those transverse directions can be controlled by the manufacturing process and the selection of constituent materials.

The high permeability of a pseudo conductor material along the first axis, in some embodiments, can allow a magnetic pseudo-conductor antenna to carry "magnetic currents." When such high permeability antennas are configured as conformal antennas and positioned conformal to an electrically conductive surface or ground plane, the magnetic currents are supported or sustained by the nearby electrically conducting surface. In an electrically conducting conformal antenna, a current carried by the antenna tends to be shorted out by a nearby electrically conducting surface. Therefore, the pseudo-conductor material in a magnetic pseudo-conductor antenna can be in direct contact with and conform to an electrically conducting surface to support and sustain a magnetic current in the antenna.

Figure 11:
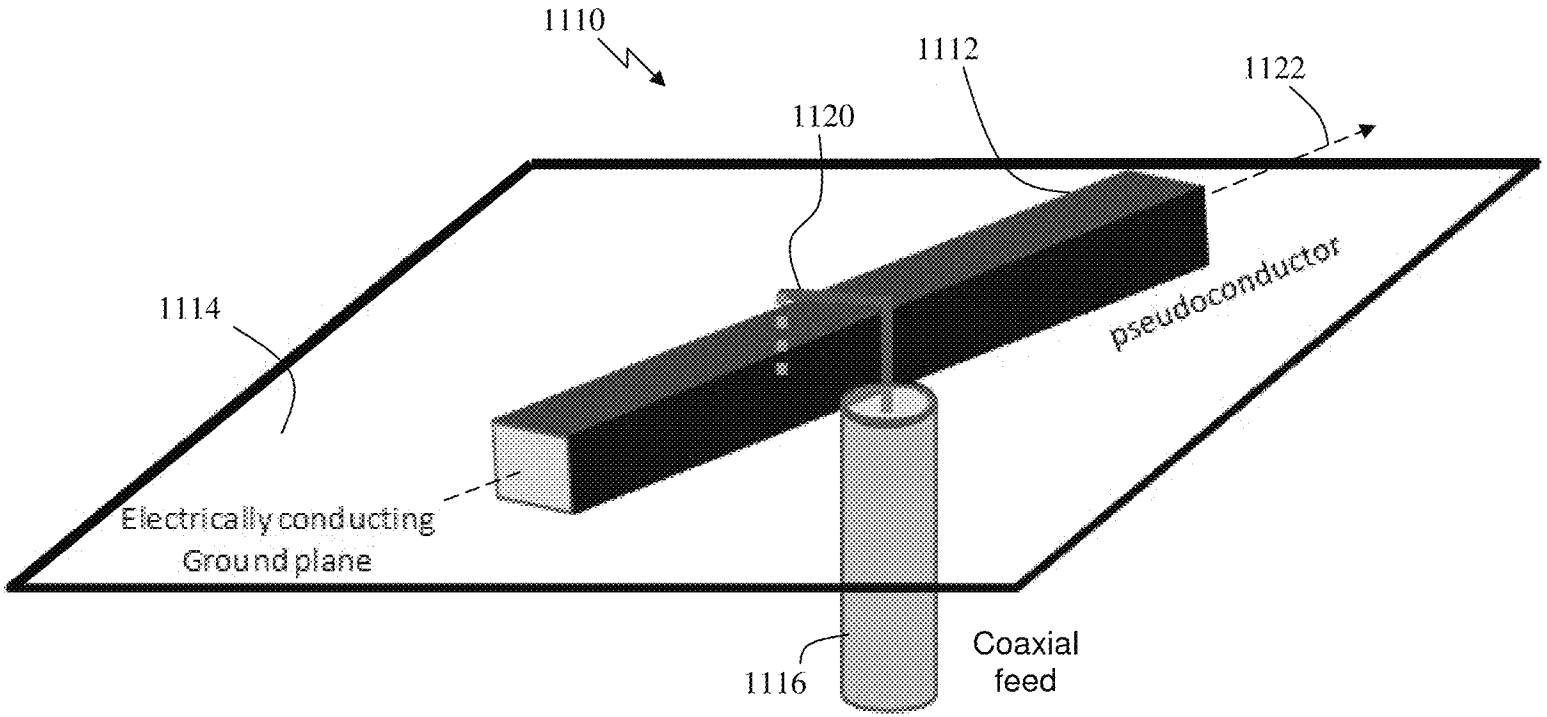
FIG. 11 depicts a simplified perspective view of a conformal pseudo-conductor dipole antenna in accordance with some embodiments.
Figure 13A:
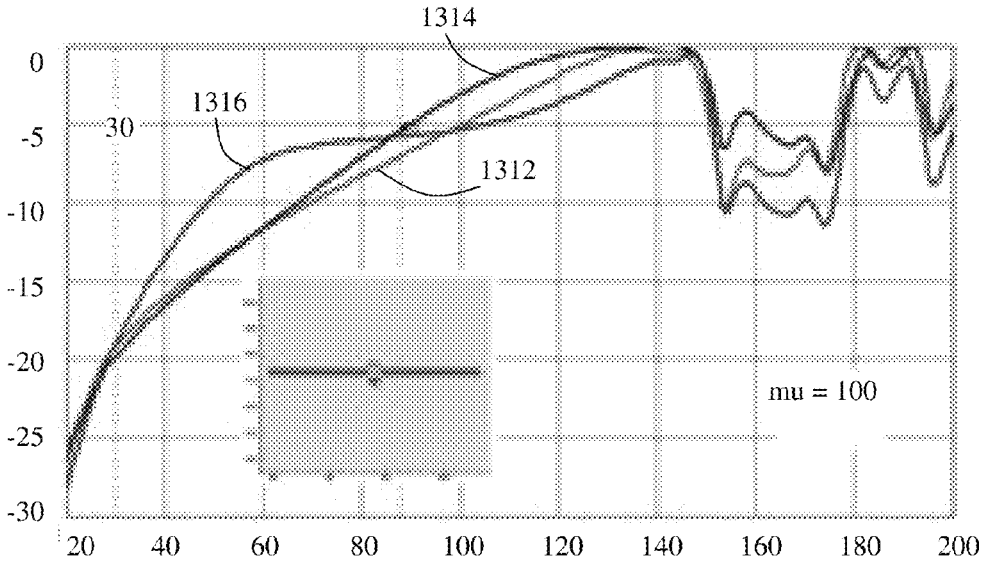
FIGS. 13A-13D show graphs of the efficiency relative to frequency from a full physics simulation of a conformal magnetic pseudo-conductor linear dipole antenna substantially identical to the conformal antenna modeled relative to FIGS. 12A-D.
Figure 13B:
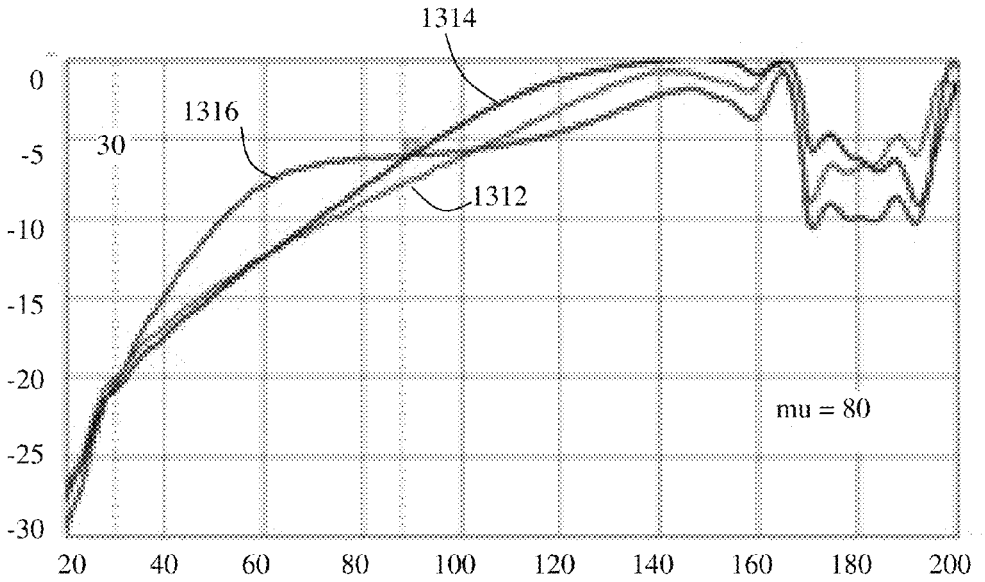
Figure 13C:
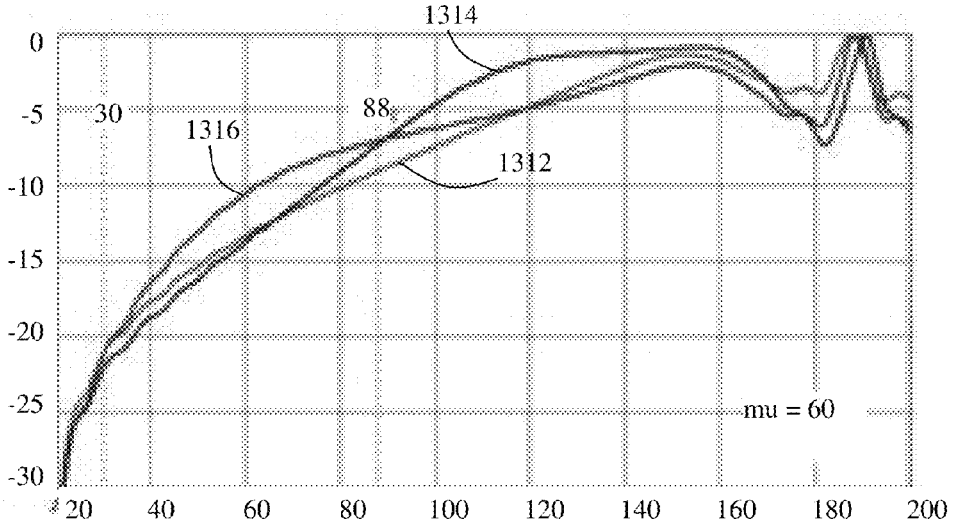
Figure 13D:
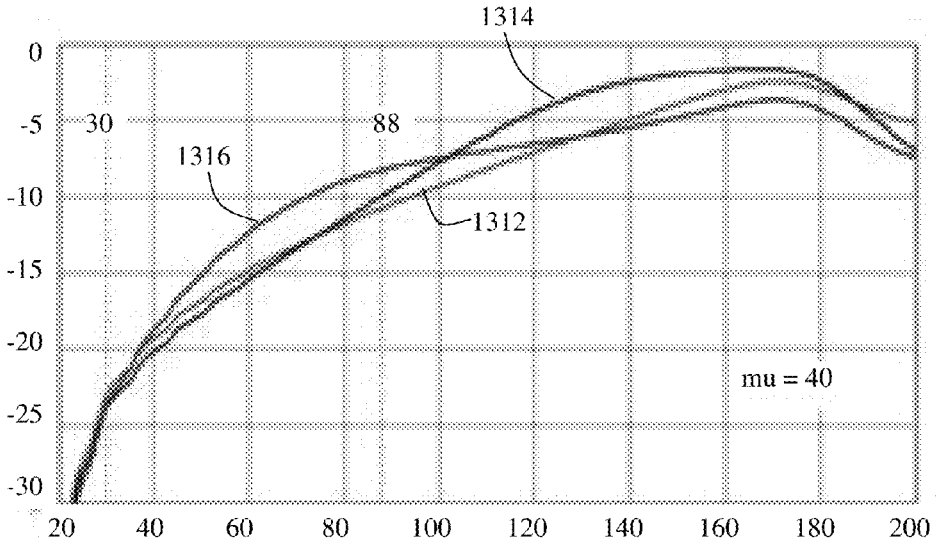

FIG. 11 depicts a perspective view of an example of a conformal pseudo-conductor dipole antenna 1110. The dipole antenna 1110 includes a pseudo-conductor object or structure 1112 positioned proximate to and in some instances directly on an electrically conducting surface or ground plane 1114. In this example, the pseudo-conductor structure 1112 is fed by a coaxial cable 1116 (e.g., a 50 ohm coax) through a shorted loop 1120 which is an extension of the center conductor of the coaxial cable 1116 and forms a conductive loop with a first end connected to coaxial feed 1116 located on one side of the pseudo-conductor object or structure 1112 and a second end that is connected to the electrically conducting surface or ground plane 1114 so that the loop 1120 and the plane 1114 encloses the pseudo-conductor object or structure 1112 as illustrated.

In some implementations the tangential electric field effectively vanishes with respect to the dipole antenna 1110 when mounted proximate to and/or on such conductive surfaces. As such, the permittivity ($\in$) of the metamaterial of the pseudo-conductor structure 1112 has relatively little or substantially no effect and can be configured or chosen to be a relatively low value (e.g., less than 5). Additionally, the anisotropic permeability ($\mu$) along the axis 1122 generally parallel with an intended direction of wave propagation is configured or selected large enough to guide an electromagnetic wave, at least in part, due to the "depression" of the external field tangent to a "wire" that supplies the boundary condition to guide a wave. This latter observation combined with the lack of a substantial transverse permeability allows pseudo-conductor antennas to be designed and configured using one or more segments (where in some instances the one or more segments of the antenna have a length that is greater than their mean cross section) aligned in the direction in which the guided wave is to travel.

The radiation efficiency for a pseudo-conductor dipole antenna in some embodiments is calculated below for a dipole antenna having a magnetic pseudo-conductor dipole structure 1112, with a length l of approximately 2.2 m, positioned conformal to the conductive surface or ground plane 1114 and fed by the 50 ohm coaxial cable 1116 through the shorted loop feed 1120 extending from beneath the conductive plane 1114 and positioned at about a center of the dipole along its length. In modeling the magnetic pseudo-conductor linear dipole antenna 1110, the above derived input impedance and/or Schelkunoff's equations for the input impedance of a dipole are initially modified by adding the internal susceptance and inductance of the circuit model of FIG. 6 as "per unit length" quantities in the expression for the TEM principle mode. Then, invoking duality the input impedance is transformed into a dual magnetic admittance which can be define in some implementations by:

$$Y_m = \frac{377^2}{Z_{in}}, \qquad \text{(Equation 38)}$$

As such, an effective magnetic capacitance of the magnetic pseudo-conductor antenna at the feed can be defined by:

$$C_m = Y_m/(j\omega).$$

The magnetic capacitance has the units of Henries and is seen by the electric feeding circuit as an inductance.

The conventional shorted feeding loop in the absence of the pseudo-conductor antenna has the following circuit parameters: the self-inductance of the loop feed 1120 can be defined by:

$$L_{bare} = \mu_0 a \cdot \ln\left(\frac{a}{\rho}\right),$$

where ρ is the radius of the shorted loop 1120; the parasitic or radiation capacitance of the loop 1120 can be defined by:

$$C_{rad} = \frac{\pi a}{3} \cdot \left(\frac{\pi \varepsilon_0}{\ln\left(\frac{a}{\rho}\right)}\right); \text{ and}$$

the radiation conductance of the shorted loop 1120 can be defined by:

$$G_{rad} = \frac{\pi}{377} \cdot \left(\frac{a}{\lambda}\right)^2.$$

Utilizing these parameters, the input impedance of the loop 1120 in the presence of the pseudo-conductor structure 1112 can be defined by:

$$Z_{loop} = \left[\frac{2}{j\omega(L_{bare} + C_m)} + 2j\omega C_{rad}\left(\varepsilon_{pc}\frac{\delta_{eff}}{a}\right) + 2G_{rad}M_{eff}\right]. \quad \text{(Equation 39)}$$

The factor of 2 in Equation 39 multiplying every term accounts for the metal ground plane images of the pseudo-conductor and the loop. The quantity $\delta_{eff}$ is defined as the smallest of either the skin depth in the pseudo-conductor structure 1112 or the cross sectional radius, a, of the pseudo-conductor structure. The transverse relative permittivity of the pseudo-conductor is $\in_{pc}$. The quantity $M_{eff}$ is the effective permeability seen by the radiation conductance of the loop 1120. In some instances, this radiation conductance is the same as the effective permeability seen at the feed including a "demagnetization effects," which can be defined by:

$$D - \left(\frac{a}{l}\right)^2\left(\ln\left(\frac{2l}{a}\right) - 1\right); \text{ and} \quad \text{(Equation 40)}$$

$$M_{eff} = \frac{|C_m|^{2l}_{\mu_0 \pi a^2}}{1 + D\left(|C_m|\frac{2l}{\mu_0 \pi a^2} - 1\right)}. \quad \text{(Equation 41)}$$

With the loop 1120 fed from the 50 ohm coaxial line 1116 from under the conductive surface 1114, a reflection coefficient at the feed can be defined as Γ=(Zloop−50)/(Zloop+50). In the absence of material loss, an effective maximum radiation efficiency can be obtained for this pseudo-conductor antenna 1110 (omitting the benefit from possible matching circuitry and other such antenna enhancement theories) by calculating: $Eff=1-|\Gamma|^2$.

FIGS. 12A-D show graphs of the efficiency relative to frequency of the conformal magnetic pseudo-conductor linear dipole antenna 1110, having in this example a length of about 2.18 m and cross sectional radius, a, of about 0.052 m, for each of the cases where μr=100, 80, 60 and 40, respectively. FIGS. 13A-D show graphs of the efficiency relative to frequency from a full physics simulation of a conformal magnetic pseudo-conductor linear dipole antenna substantially identical to the conformal antenna modeled relative to FIGS. 12A-D, using a finite difference time domain (FDTD) computational electromagnetics method, where μr=100, 80, 60 and 40, respectively. FIGS. 12A-D and 13A-D show that apart from a feed resonance artifact (e.g., the loss in efficiency between 150 and 180 MHz seen in the μ=100 case) the relatively simple, thin linear dipole antenna 1110 is a good candidate to cover a large percentage, if not all, of the VHF band and possibly beyond.

As can be seen, through a comparison between the modeling and simulation of FIGS. 12A-D and FIGS. 13A-D, the modeling exhibits similar behavior to the magnetic pseudo-conductor antenna 1110. More specifically, curve 1312 is generated as a baseline case with no matching circuit. Curves 1314 and 1316 show the results of incorporating relatively simple matching circuits to slightly vary the low end input impedance. For example, curve 1314 is generated based on an addition of a series inductance to the 50 Ohm feed, and curve 1316 is generated based on an input impedance raised using a 3:1 transformer. It is noted that the simulations of the pseudo-conductor dipole antenna 1110 provides about a −20 dB efficiency at about 30 MHz and about a −5 dB at about 88 MHz are attained and the antenna, in this implementation and even without matching circuitry, operates up to about at least 150 MHz.

Although the agreement between the results of the closed-form model of FIGS. 12A-D and the simulation results of FIGS. 13A-D are not exact, the model and the simulation exhibit very similar behavior including the shift to the right along the frequency axis with dropping material permeability and the fact that efficiencies of the order of about −10 dB are expected near about 80 MHz, and almost 0 dB are attainable around 140 MHz for the <1" thick antenna on a conducting surface. Further, the similarities between the model and the simulation demonstrate that the model effectively represents the fundamental physical mechanisms involved in the radiation behavior of pseudo-conductor antennas, which allows for the design of potentially an endless variety of embodiments.

It is additionally noted that should the results achieved through the pseudo-conductor material with μ=80 satisfy a predefined antenna performance, the use of a pseudo-conductor material with μ=100 can similarly be used while the material can be made thinner (e.g., 20% thinner) and still achieve the antenna performance. Additionally, the pseudo-conductor dipole antenna 1110, when 1 inch thick, uses approximately 225 cubic inches of μ=100 material. It is calculated that should the material have had a permeability of about 200 it could be made with a 0.5 inch thickness to achieve substantially the same results and using just 112 cubic inches of material. Further still, if the pseudo-conductor material attained a μ=400 the dipole antenna 1110 could have been constructed using about 56 cubic inches of material while still achieving substantially the same results. In comparison, a fragmented electrically conducting antenna using substrate material that is 24 inches by 24 inches by 0.9 inches uses 518 cubic inches of substrate material, which would result in significant increase in weight and size needed to implement the structure.

Therefore, the pseudo-conductor antenna 1110 of FIG. 11 is a conformal radiator of vertically polarized waves (relative to the conducting surface 1114) and uses pseudo-conductor structure 1112 as the radiating element.

The pseudo-conductor antennas described in this document can be configured to have various advantages. For example, some other antenna devices, such as polyrod antennas, use a surface waveguide to propagate a bound wave from the feed region to the end of the structure and radiate a directive beam. A magnetically permeable polyrod antenna would tend to be finite in the transverse direction, such as half a cylinder on the electrically conductive surface, and, in such devices, the guided mode with the E field being perpendicular to the metal is the HE11 hybrid mode. The tight binding of the HE11 mode to the material and the tangential as opposed to radial distribution of the magnetic field would make such permeable polyrods inefficient low frequency radiators. The ability of the pseudo-conductor to weakly guide the TE01 mode allows a pseudo-conductor antenna to be configured as a conformal permeable low frequency antenna.

The pseudo-conductor structure 1112 as the radiating element is not an electrically conducting material like a metal and an insulator layer is not required between the as the radiating element and the conducting surface 1114.

Figure 14:
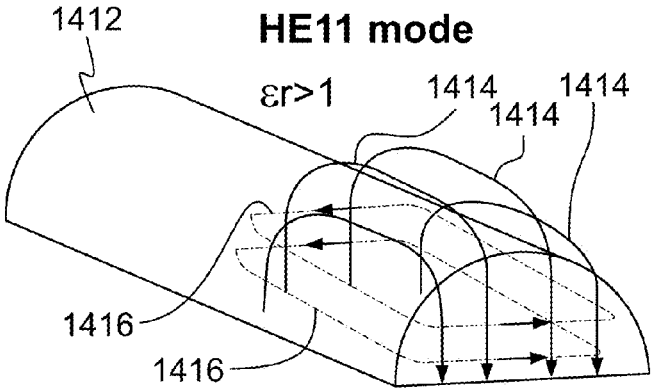
FIG. 14 depicts a simplified block diagram of a dielectric or magnetically permeable half cylinder structure carrying and/or propagating an electromagnetic wave in accordance with an HE11 mode with resulting magnetic and electric field lines.
Figure 15:
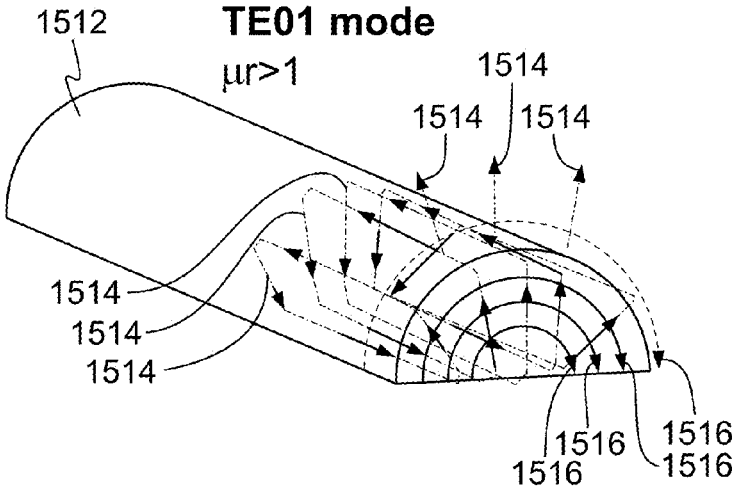
FIG. 15 depicts a simplified block diagram of a magnetically permeable pseudo-conductor half cylinder structure carrying and/or propagating an electromagnetic wave in accordance with a transverse electric TE01 mode with resulting magnetic and electric field lines.

FIG. 14 depicts a simplified block diagram of a dielectric or magnetically permeable half cylinder structure 1412 positioned adjacent an electrically conductive surface (not shown) carrying an HE11 mode with resulting magnetic field lines 1414 and electric field lines 1416. FIG. 15 depicts a simplified block diagram of a magnetically permeable half cylinder structure 1512 positioned adjacent an electrically conductive surface (not shown) carrying a transverse electric TE01 mode with resulting magnetic field lines 1514 and electric field lines 1516. As shown in FIGS. 14 and 15, a magnetically permeable half cylinder on an electrically conductive surface can carry both an HE11 mode and the TE01 mode. The HE11 mode has a transverse magnetic field 1414.

Alternatively, the TE01 mode, which is supported in at least a magnetically permeable structure with high axial permeability, contains both a longitudinal and radial magnetic field (H) 1514, which in some implementations is the mode that might be excited by a loop feed 1120 of FIG. 11. Further, the TE01 mode provides a circulating electric field (E) 1516. Similarly, an electric pseudo-conductor can be configured to provide wave propagation in the first transverse magnetic mode (TM01) and established a longitudinal and radial electric field with a circulating magnetic field.

Further, regarding the TE01 mode's electromagnetic field, the electromagnetic field outside a highly permeable cylinder carrying the TE01 mode is dominated by a radial magnetic (H) field and a circulating electric (Eϕ) field 1516. The longitudinal magnetic (H) field 1514 outside cylinder structure is relatively weak because of the high axial permeability of the material (as suggested by the dashed arrows in FIG. 15). We note that this is similar to the field structure that would exist outside a theoretically ideal perfect magnetic conductor (PMC) wire carrying a magnetic current $I_m$.

Figure 16:
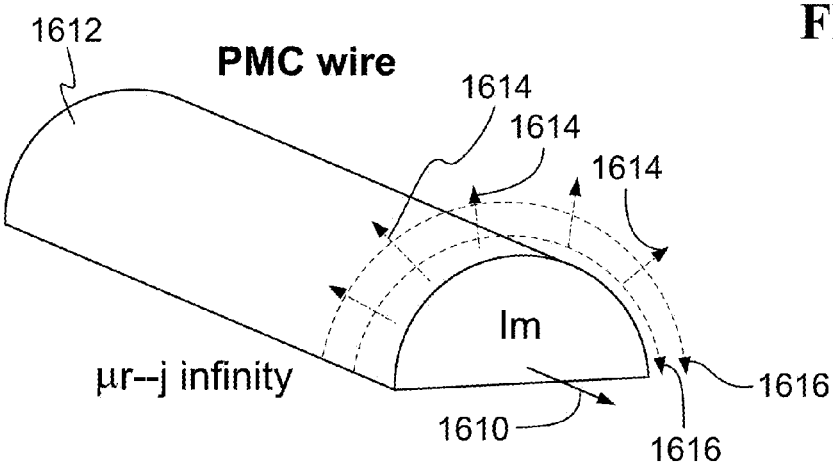
FIG. 16 depicts a simplified block diagram of a theoretical perfect magnetic conductor (PMC) wire carrying a magnetic current Im with resulting magnetic and electric field lines.

FIG. 16 depicts a simplified block diagram of a theoretical perfect magnetic conductor (PMC) wire carrying a current $I_m$ 1610 with resulting magnetic field lines 1614 and electric field lines 1616. In contrast, the external magnetic field 1414 of the HE11 surface wave mode is not radial but "linearly polarized," similar to the field that would exist outside a pair of parallel PMC wire transmission line carrying a TEM wave. Two-wire TEM lines are typically poor radiators whereas substantially all wire antennas rely on the "single-wire" wave guiding mechanism to shape the radiating electromagnetic field.

Furthermore, the HE11 mode has no hard cutoff and the TE01 has a cutoff. Therefore, when the cross section of the material is smaller than about half a wavelength in the material, the wave is not trapped in the magneto-dielectric structure 1512 but actually is loosely guided as a leaky wave at approximately the speed of light. When the pseudo-conductor material weakly guides an electromagnetic wave on the pseudo-conductor material using a leaky mode that is below cutoff to establish a field structure it can readily radiate the emissions. Alternatively, when the wave is well guided or effectively trapped by the dielectric it would be difficult to radiate or "shed" the wave at discontinuities resulting in at best a poor antenna and instead a more effective resonator. This is an additional similarity between the pseudo-conductor TE01 mode and the wave guided by a theoretical PMC wire. Both travel at about the speed of light in free space and both radiate off at discontinuities.

As such, magnetic pseudo-conductor strips (e.g., magnetically permeable structure 1512) can be used as magnetic wires, as demonstrated above and supported by the FDTD simulations as described above, to guide the magnetic field on a metal surface in a way similar to or analogous to the way that metal wires guide the electromagnetic field in a free space environment. Similarly, the use of electric pseudo-conductor materials can be utilized to operate in the TE01 modes providing in duality similar fields.

In view of the above, magnetic pseudo-conductors can be configured as to achieve effective and practical realization of conformal antennas relative to conducting platforms, and to provide conformal antennas for conducting platforms implemented from theoretical "PMC wires," which by duality would have the properties of a metal wire antenna in free space except for the fact that it can lay in intimate contact with a electrically conductive surface. Additionally, such an antenna as further demonstrated above is able to approximate the 2D FCh GBWP performance limit that governs conformal antennas.

Electric pseudo-conductors can be used to provide similar effects in weakly guiding electromagnetic waves in the TM01 mode. The electromagnetic field outside an electric pseudo-conductor carrying the TM01 mode is dominated by a radial electric (E) field and a circulating magnetic (H) field. The longitudinal electric field outside a cylindrical electric pseudo-conductor structure is relatively weak because of the high axial permittivity of the material.

There are several consequences to the utilization of a partially guided mode for an antenna. A first, as described above, is that when the material is relatively highly permeable the material can be positioned proximate to or even directly on an electrically conductive surface to provide a conformal antenna without being shorted out. A second consequence is that an electrical thickness of the material of the antenna is not determined by the typical surface wave guidance factors because the use of the guided mode does not need to trap the wave. As illustrated in FIGS. 12A-D and 13A-D, even a permeability as low as 40 is sufficient to obtain antenna behavior for a relatively wide band such as at least from HF through VHF or more. In a material having a permeability of 40 and permittivity of 5, the wavelength at 30 MHz is of the order of 70 cm. In the embodiment of the antenna used relative to FIGS. 12A-D and 13A-D, the antenna's effective radius was about 1/14th of this, well below the cutoff of the trapped mode.

A third consequence is derived from the second consequence that an electrical thickness of the material is not determined by the surface wave guidance requirements, and can have significant implications on the affordability of pseudo-conductor antennas, as well as effectiveness of implementation because of the reduced amounts of material at least in some implementations. The results of FIGS. 12A-D and 13A-D and other numerical experiments have shown, at least for some embodiments, for a given cross section of the pseudo-conductor, increasing the permeability may eventually reach a point of diminishing returns. That is, for particular designs in at least some embodiments, the behavior of a pseudo-conductor antenna with $\mu=100$ material typically differs negligibly from that using a theoretical PMC (i.e., $\mu=$infinity). Therefore, as higher permeability materials are utilized and/or become available the cross-sectional area of the pseudo-conductor can actually be reduced.

A fourth consequence is related to the third consequence described above. The high impedance material is not being used as a substrate to hide the electrically conducting ground plane from a nearby conformal electrically-conducting antenna but is actually making effectively "magnetic wire" antennas out of the pseudo-conductive metamaterial. As a result, the use of the pseudo-conductive material moves away from the area paradigm to a perimeter paradigm, which obviously can have at least significant weight and cost savings.

Additionally, in some implementations, pseudo-conductor materials can be configured to possess anisotropic constitutive properties, and such an anisotropic pseudo-conductor can be used to support a cutoff, e.g., a cutoff TE01 mode with a magnetic pseudo-conductor material, and a cutoff TM01 mode with an electric pseudo-conductor material. For example, in some implementations magnetic pseudo-conductors are selected, configured and/or constructed having the high permeability that is axial and along the axis of wave propagation or axis of the "wire-like" structure, with the relative permeability being lower in the other two orthogonal orientations (e.g., in some applications a ratio of about 5 to 1, 10 to 1 or even greater). Similarly, in some implementations electric pseudo-conductors are selected, configured and/or constructed having the axial permittivity along the axis of wave propagation that is the highest with the permittivity being lower along the other two orthogonal axes.

Further, the use of pseudo-conductor material, where the dominant electromagnetic constitutive property is in general larger than the complementary electromagnetic constitutive property provides a cross-section of the pseudo-conductor (generally perpendicular to the wave propagation) such that the cross-sectional area does not support internal resonances. This configuration provides, at least in part, the operation below cutoff. In this respect, one axis of the complementary electromagnetic constitutive property may exhibit relatively large values (at least with respect to the other complementary constitutive property) without violating operation below cutoff. When the axis of the high complementary constitutive property points in the transverse direction to a long slender "wire-like" structure, "depolarization" effects at the surface of the structure diminish the ability of the complementary constitutive to bind guided modes.

Based on various antenna design and engineering techniques, other embodiments can be derived that utilize the pseudo-conductor material based on the above descriptions, including the pseudo-conductive dipole antenna embodiment 1110 described above, that are analogous in shape and function to various electrically conductive antennas (e.g., conductor wire antennas, cone, biconical and other relevant configurations). These and other antenna configurations can be difficult to achieved by using electrically conducting metal antennas in part because the proximate electric ground plane surface generally shorts out the radiated electric field tangent to that surface, whereas a magnetic pseudo-conductor antenna radiates a magnetic field tangent to the surface. Additionally, a conducting surface enhances the strength of a tangential magnetic field and in some instances such enhancement can be significant, e.g., doubling the strength of a tangential magnetic field.

Further, various antenna design, theory and engineering techniques that are typically applied to designing electrically conductive antennas can be used to guide the designs of pseudo-conductor antennas in conditioning, tuning, modifying and/or otherwise controlling performance of pseudo-conductor antennas. For example, metal antenna design techniques, such as but not limited to shaping the wave guiding structure and/or by inserting circuit elements, can similarly be utilized in designing and implementing pseudo-conductor antennas to achieve predefined or desired performance of the pseudo-conductor antennas (e.g., modifying frequency response, gain, bandwidth, efficiency and/or other such performance factors of the antenna) and/or enhance performance.

With an electrically conductive antenna that is relatively electrically small, a series inductor or a top hat capacitor can be utilized to lower resonance frequency of the conductive antenna. Similarly, with some pseudo-conductor antennas one or more circuit elements can be inserted to achieve similar results to lower the resonance frequency of the pseudo-conductor antenna (e.g., a discrete split-ring resonator, which in some implementations operates with the pseudo-conductor antenna similar to an inductor or capacitor in an electrically conductive antenna).

Figure 17:
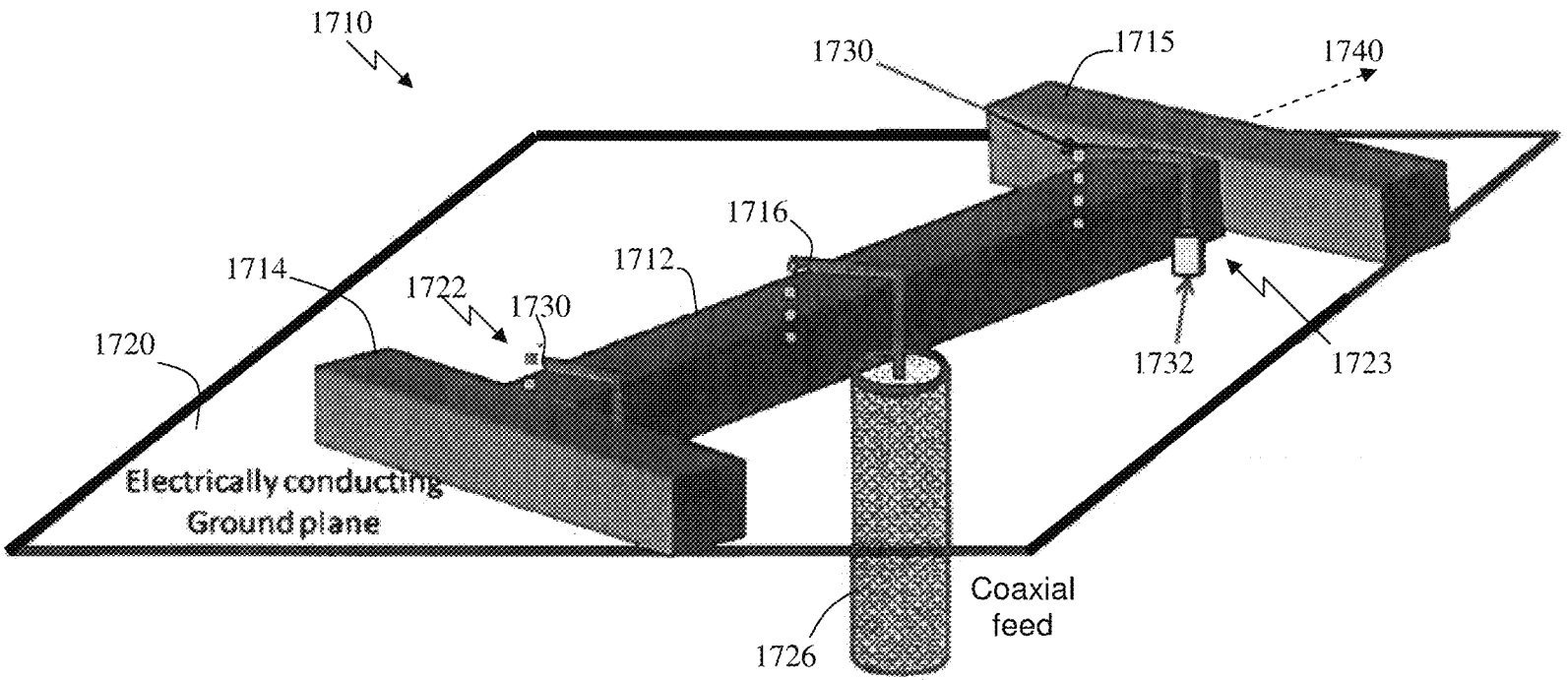
FIG. 17 depicts a simplified isometric view of a top-loaded linear dipole pseudo-conductor antenna in some embodiments.

FIG. 17 depicts a simplified isometric view of an example of a top-loaded linear dipole pseudo-conductor antenna 1710. The end-loaded dipole antenna 1710 includes a dipole 1712, the end-loads or "top-hats" 1714-1715 and a feed 1716. Additionally, in some embodiments, the end-loaded linear dipole antenna 1710 incorporates circuit and/or terminating elements 1722-1723 as fully described below. Further, in some implementations, the end-loaded linear dipole antenna 1710 can be positioned adjacent to and/or directly on an electrically conductive surface or plane 1720, such as positioned conformal to and directly on an electrically conductive ground plane.

Further this same dipole can be embedded within a channel or the like in the conducting surface that is equal shape to and conformal to three sides of the dipole "wire" and leaves exposed the upper face of the pseudo-conductor cross-section. In applications where the magnetic pseudo-conductor material contains electrically conducting elements, further steps can be taken to prevent those elements from being shorted to the supporting ground plane in such a way as to form closed current loops since the resulting circulating eddy currents would then choke the magnetic material.

The feed 1716, in some implementations, is a shorted loop feed from a coaxial cable 1726 (e.g., a 50 Ohm coaxial feed cable) extending through the electrically conductive surface 1720. This is similar to what is described in FIG. 11. Other feeds can alternatively be implemented. In some embodiments a through loop with each side terminating in a coaxial cable, such as a 50 Ohm coaxial cable, is utilized as a feed.

With at least some conventional metal antennas, a "top hat" added to an electrically, relatively small radiator serves to make the current over the conductor more uniform and can in some instances effectively quadruple the radiation resistance. An analogous effect can be elicited with pseudo-conductors through the use of the terminating and/or lumped elements 1722-1723 at positions different from the feed loop 1716. For example, in some embodiments the terminating elements 1722-1723 can be implemented through split ring resonators such that the top loads 1714-1715 of the pseudo-conductor incorporate the split ring resonators. The use of a termination follows from the fact that the pseudo-conductor is guiding a displacement current instead of a conduction current. Conduction currents carried by material with a high imaginary part of the permittivity (or permeability) can see a relatively very large discontinuity at a terminating capacitive top hat, which creates the desired current distribution on the conductor. To cause a similar effect with displacement currents it is not enough, in some implementations, to terminate the pseudo-conductor into air (unless the pseudo-conductor has an arbitrarily high permeability). To force a strong end discontinuity to the displacement current, a barrier with apparent infinite permeability can be utilized. The split ring resonators 1722-1723 exhibit a highly dispersive effective permeability along the axis 1740 of the dipole 1712 that near resonance swings up to large values and then drops abruptly to negative large values before approaching zero asymptotically.

In some embodiments, the split ring resonators 1722-1723 are implemented with a metal loop 1730 shorted on one side, extending over the dipole 1712 and connected to the conductive surface 1720 on the other side through a capacitive element or termination 1732 (where only one capacitive element 1732 is depicted in FIG. 17 as the second capacitive element is not visible through the end-load 1714). Circuit elements, in some implementations, have similar effects as inductors or capacitors with electrically conducting antennas, and can lower a resonance frequency of the pseudo-conductor antenna.

Figure 18A:
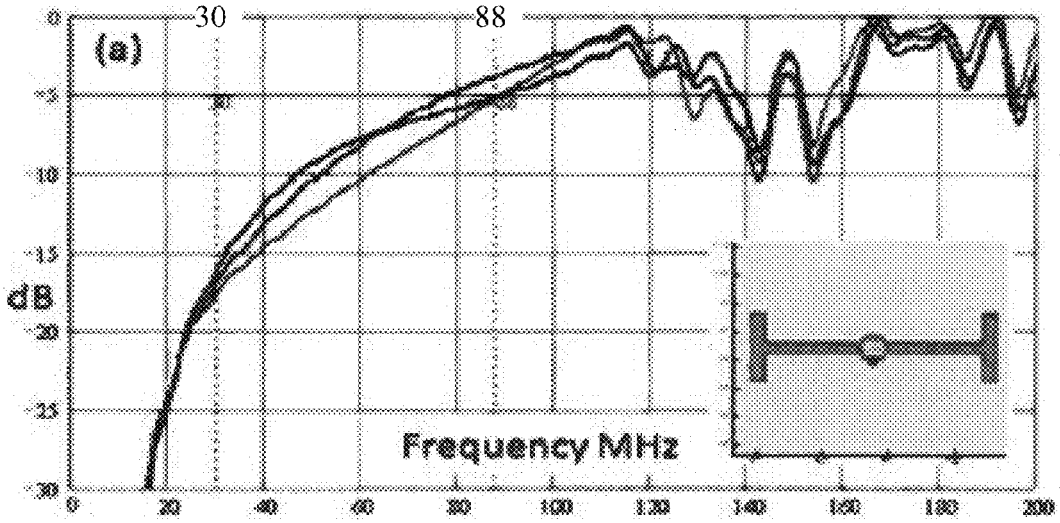
FIG. 18A shows a graphical representation of efficiency relative to frequency of a top-loaded dipole pseudo-conductor antenna without terminating elements (e.g., split-ring resonator elements) in some embodiments.
Figure 18B:
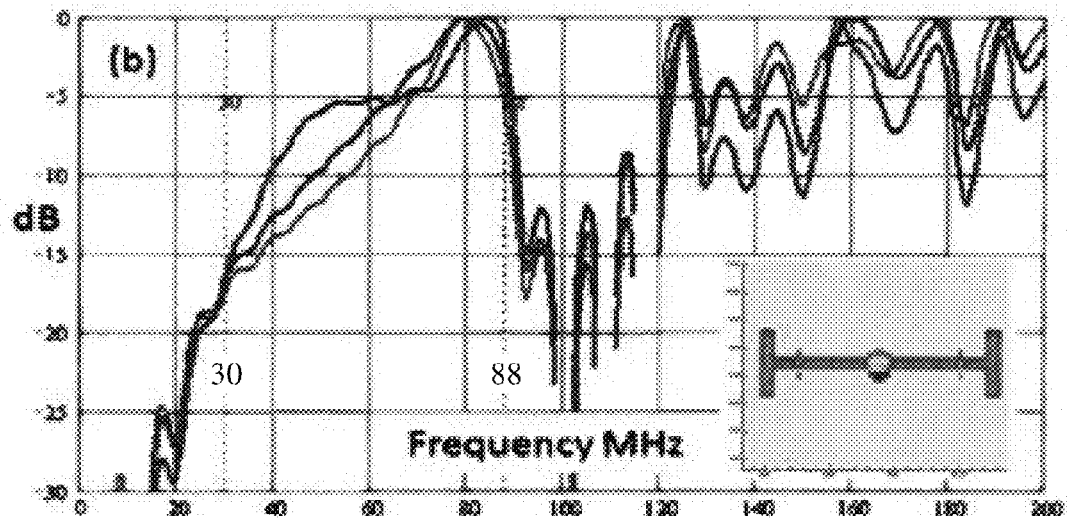
FIG. 18B shows graphical representation of efficiency relative to frequency of a top-loaded dipole pseudo-conductor antenna with tuned terminating split-ring resonator elements in some embodiments.

FIGS. 18A-B show graphical representations of efficiency relative to frequency of a top-loaded dipole pseudo-conductor antenna without terminating elements in some embodiments, and a top-loaded dipole pseudo-conductor antenna with tuned terminating split-ring resonator elements 1722-1723 in some embodiments, respectively. These results are obtained from FDTD simulations of these antennas when fed from shorted loop feeds (e.g., feed 1716).

More specifically, the antenna design simulated relative to FIG. 18B includes split ring resonators tuned (e.g., by selecting the capacitive element(s) 1732) to resonate around 90 MHz. The change in the efficiency observed between FIGS. 18A and 18B, particularly the high efficiency attained at about 80 MHz shows accurate and effective top loading of a pseudo-conductor antenna design.

The line impedance of the coaxial feed 1726 can further be selected to provide a desired or optimum match to the input impedance of the dipole antenna 1710, where the value of this impedance, in some implementations, has been found to be between about 50 ohms and 300 ohms. Although top loaded antennas (e.g., with or without terminating elements) of FIGS. 17 and 18A-B have been described as being fed by a shorted loop feed 1716, the loop may also be terminated into a transmission-line-matching impedance. Simulations bear out that in broadband applications, without special matching circuit(s), both top loaded pseudo-conductor configurations (i.e., with terminating elements 1722-1723 and without terminating elements) perform substantially the same except that with the shorted loop feed the non-radiated power is reflected back into the source whereas with the matched termination feed the non-radiated power is dumped into the load. The latter is preferable at least in some applications where a matched input to the source is desired over a broad band (e.g., high power transmitting antenna applications).

As illustrated in FIGS. 18A-B, resonant antenna designs attaining relatively large efficiency over a relatively narrow band of frequencies (e.g., in the case where the pseudo-conductor antenna includes top loading and/or terminating elements 1722-1723; embodiment of FIG. 18B providing efficiency of greater than about −5 dB from about 70 to 90 MHz) are examples of some possible implementations of the pseudo-conductor antenna. Similarly, broadband efficiencies as seen in the simulations of FIGS. 13A-D are other possible implementations of the pseudo-conductor antenna. Similar design and engineering techniques can be utilized with other pseudo-conductor antenna configurations to achieve desired results and/or to provide antennas that generate emissions that at least meet predefined antenna performance and/or parameters.

Figure 18C:
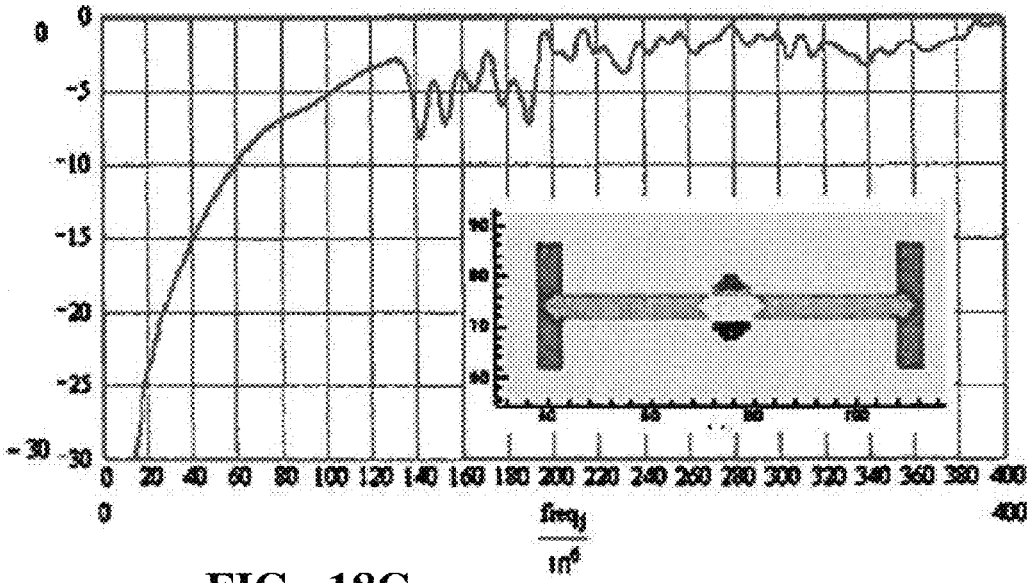
FIGS. 18C-18D show efficiency and input matching, respectively, of a top-loaded pseudo-conductor antenna similar to that of FIG. 17 that is fed with a through loop terminating at both ends in a 50 Ohm coaxial cable.
Figure 18D:
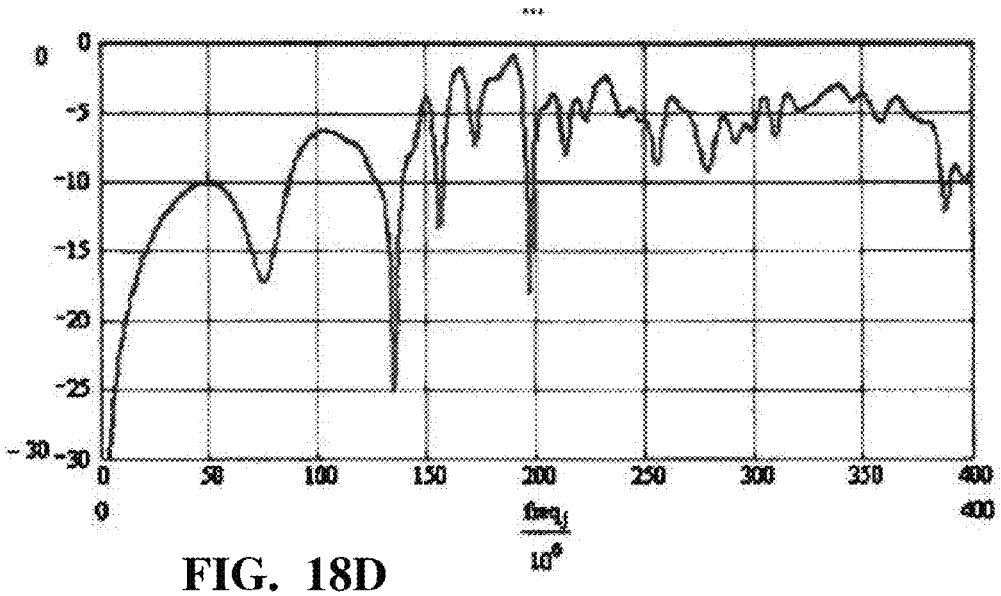

FIGS. 18C-D similarly show efficiency and input matching, respectively, of a top-loaded pseudo-conductor antenna similar to that of FIG. 17 that is fed with a through loop terminating at both ends in a 50 Ohm coaxial cable instead of a shorted loop feed 1716. As can be seen, the efficiency is very close to the results of FIG. 18A above, with relatively accurate input matching. In some implementations, the end-loaded pseudo-conductor 1710 fed through a shorted loop feed 1716 may additionally include matching networks (possibly switchable), employing a corresponding antenna, such as feeding two substantially identical antennas through a 90 degree hybrid. The through loop pseudo-conductor antenna configuration is substantially matched over at least the entire VHF band (e.g., 30 MHz to 300 MHz).

Although the feed has not been optimized, the application of further antenna design techniques and/or the additional of one or more elements to adjust and/or focus performance a −10 dB band input match should be achieved that extends from about DC to at least about 130 MHz. The 130 MHz limit show in FIG. 18D is believed to be due to a feed resonance artifact. As such, it is further predicted that this −10 dB match region may be extended further, such as at least up to 180 MHz, thus covering both the VHF low and VHF high bands through one antenna.

Other embodiments of the pseudo-conductor antennas can similarly be constructed. Again, the antenna performance of substantially any conductive antenna can be effectively duplicated or improved upon, at least depending on environment, through the design of an antenna constructed of pseudo-conductive material as the radiating element where the real part of the electromagnetic constitutive property ($\mu'$ or $\in'$) of the pseudo-conductive material is greater than a corresponding imaginary part of the electromagnetic constitutive property. As described above, in many applications an antenna structure typically constructed of an electrically conductive material can be implemented through the use of pseudo-conductive material, and typically with a similar shape. Further, the performance of the pseudo-conductor antenna can be tuned, focused, adjusted and/or conditioned using typical engineering and antenna design techniques such as loading and the like.

Figure 19:
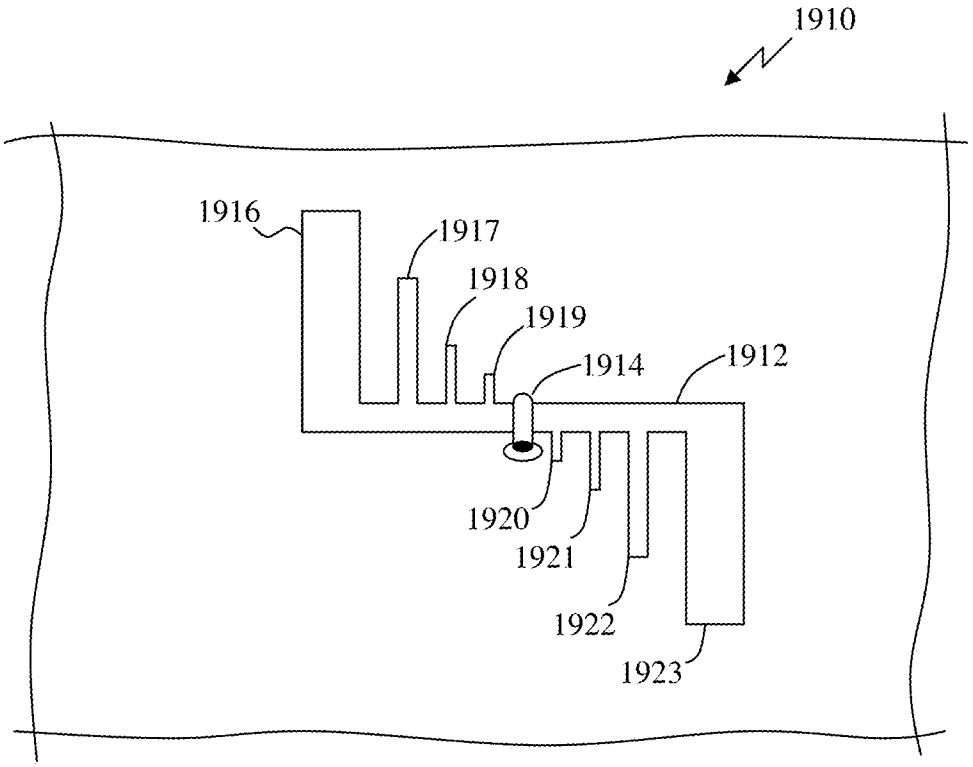
FIG. 19 depicts a simplified block diagram top view of a log-periodic pseudo-conductor antenna in some embodiments.

As a further example of utilizing pseudo-conductor material as a radiating element of an antenna system, FIG. 19 depicts a simplified top view of an example of a log-periodic pseudo-conductor antenna 1910. The log-periodic pseudo-conductor antenna 1910 comprises a pseudo-conductor feed line 1912 extending from a feed 1914, and is directly or electromagnetically coupled to a multiplicity of other pseudo-conductor dipoles 1916-1923 to create a log periodic structure. Other embodiments may provide a dual polarized design where the log periodic antenna 1910 is duplicated and rotated 90 degrees relative to the log periodic antenna 1910. As such, the log periodic antenna 1910 can be considered as one half of a dual polarized antenna design.

Figure 20:
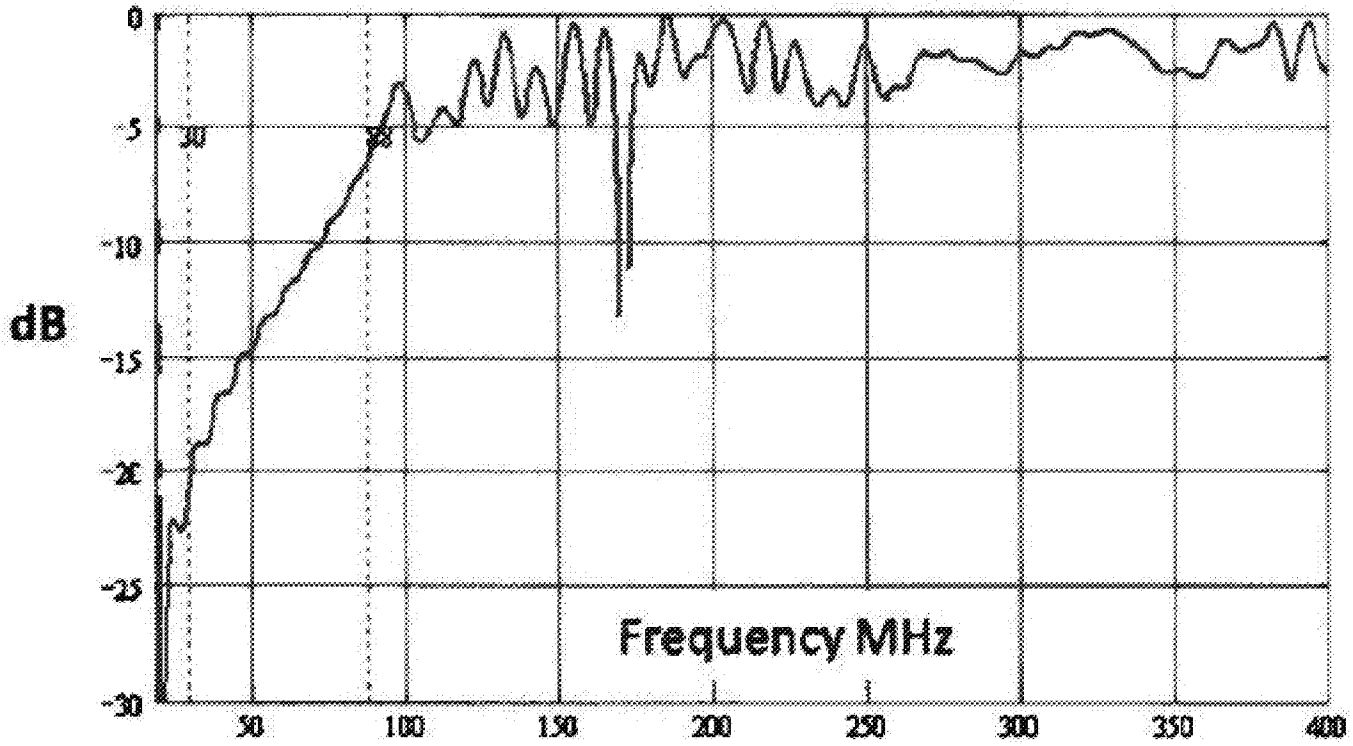
FIG. 20 shows a graphic representation of efficiency as a function of frequency of the log periodic antenna as generated through FDTD simulations.

FIG. 20 shows a graphic representation of efficiency as a function of frequency of the log periodic antenna 1910 as generated through FDTD simulations. In this simulation, the log periodic antenna 1910 is about 2 m along the pseudo-conductor feed line 1912 and the permeability of the material of the log periodic pseudo-conductor antenna 1910 was about μr=100. As can be seen from FIG. 20, the simulation of the log periodic antenna 1910 is relatively broadband exhibiting an efficiency of −5 dB or higher from about 90 MHz past 400 MHz.

The log-periodic pseudo-conductor antenna 1910 provides a relatively linear efficiency response from about 30 MHz to about 88 MHz, which generally meets many blade antenna performance standards, and suggests that the low end efficiency is a function of the area occupied by the log periodic antenna 1910. Apart from the feed mismatch artifact at about 165 MHz, the log-period pseudo-conductor antenna provides an average efficiency on the order of approximately −3 dB from about 130 MHz through at least 400 MHz. Taking into account the directive gain of the antenna pattern it is anticipated that the log periodic antenna 1910 should be able to meet a 0 dB gain specification from about 150 MHz to 400 MHz and beyond.

As such, some embodiments utilize pseudo-conductor materials in implementing antennas as the radiating element of the antenna where the electromagnetic wave is weakly guided using a leaky mode that is below cutoff to establish a field structure to radiate emissions from the pseudo-conductor material that meet predefined antenna performance. Referring back to FIG. 1, in designing a pseudo-conductor antenna and in selecting the pseudo-conductor material in step 114 one or more factors can be taken into account. For example, the selection of the pseudo-conductor material depends on whether the antenna is to be conformal to an electrically conductive surface. In those instances where the antenna is to be conformal to a conductive surface a magnetic pseudo-conductor material is typically utilized. Other considerations include a size and/or weight of an intended antenna when selecting a pseudo-conductor material.

It has been demonstrated above that the guidance properties provided by pseudo-conductors at least in part is a function of the permeability (or permittivity) and cross sectional area of the pseudo-conductor object. Again as described above, in general as the real constitutive property increases typically the amount of pseudo-conductor material can be reduced (e.g., thickness can be reduced) while still achieving similar emission results as a pseudo-conductor material having a larger volume but a lower real constitutive property. As such, when attempting to limit or minimize the amount of pseudo-conductor material being utilized, pseudo-conductor materials with relatively large real electromagnetic constitutive properties are considered (e.g., in many implementations the higher the permeability (or permittivity) generally the thinner the structure can be). Additional considerations in selecting a pseudo-conductor material can include how the pseudo-conductor material is to be excited and/or whether the pseudo-conductor material is in effect exciting another pseudo-conductor structure, antenna or other antenna structure. Further in considering size and/or weight an effect of adjacent and/or conformal materials can be considered. Again, an electrically conductive surface can aid and/or enhance the effects of a conformal magnetic pseudo-conductor antenna in some implementations. As such, the size of the antenna may be reduced in some embodiments as a result of the enhancing effects to be provided by the conformal electrically conductive surface.

Still other factors include the environment that a resulting antenna is intended to operate, the excitation and/or control of the antenna, the design and engineering techniques available in the intended implementation and/or environment where the antenna is intended to operate that can be employed with the resulting pseudo-conductor antennas in conditioning, tuning, modifying and/or otherwise controlling performance of pseudo-conductor antennas, and other such relevant factors can be considered in selecting a pseudo-conductor material. Additionally, a ratio of permeability to permittivity can be taken into consideration as well as an orientation of permeability to permittivity ratios in utilizing anisotropic pseudo-conductor materials.

Furthermore, the selection of the material in step 114 and the configuring of the pseudo-conductor material in step 116 typically take into consideration intended modes of wave propagation (for example, transverse electric, TE01, mode for magnetic pseudo-conductors and the transverse magnetic, TM01, mode for electric pseudo-conductors). Intended electric and/or magnetic fields induced through and/or about the pseudo-conductor antenna shape are often also taken into consideration (e.g., in many embodiments the pseudo-conductor material is selected and shaped to establish a longitudinal and radial magnetic field with a circulating electric field with magnetic pseudo-conductor materials; and in other embodiments, the pseudo-conductor material is selected and shaped to establish a longitudinal and radial electric field with a circulating magnetic field with electric pseudo-conductor materials). Some embodiments utilize dielectric pseudo-conductors at frequencies where conventional conductors have too much loss and/or where relatively high permittivity materials with low loss may be found, such as ceramics with a permittivity of about 30 or higher.

Referring back to FIG. 1, the design of the antenna depends at least in part on the intended or predefined antenna performance and/or characteristics. The antenna performance typically includes an intended antenna operation bandwidth and a gain within that intended bandwidth. In some instances, one or more of the antenna characteristics and/or parameters can be met as a function of an antenna shape and/or configuration. Further, as described above, a pseudo-conductor antenna can be used in place of an electrically conductive antenna while still achieving the antenna performance, and in some instances exceeding the antenna performance.

Some embodiments utilize the configurations of electrically conductive antennas and utilize those configurations for generating pseudo-conductive antennas utilizing pseudo-conductive material as the emitting structure. Additionally, in some implementations, the shape and/or structure of electrically conductive antennas can be substantially duplicated using pseudo-conductive material to achieve similar radiation results when properly excited as described above. As such, other embodiments can be derived using the techniques and examples described herein that are analogous in shape and function to conventional conductor wire antennas. Further, at least some resulting pseudo-conductor radiating structures can be directly mounted to the conductive surface or embedded within a channel, groove, indentation, or other such structure in the conductive surface, and in some cases without the need of any intermediary layer or structure. This is generally not possible with conventional electrically conductive antennas because the proximate electric ground plane surface effectively shorts out the radiated electric field tangent to that surface whereas the magnetic pseudo-conductor antenna radiates a magnetic field tangent to the surface. In addition, a proximate conducting surface can effectively double the strength of a tangential magnetic field. Further, known antenna design and engineering techniques can be utilized with pseudo-conductor antennas in conditioning, tuning and/or otherwise adjusting performance of the antenna.

Figure 21:
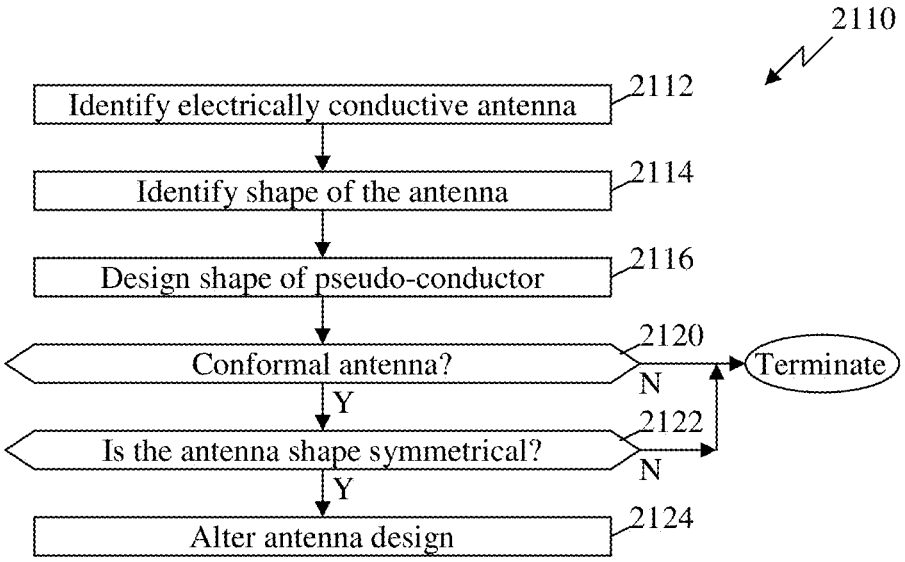
FIG. 21 depicts a simplified flow diagram of a process in some embodiments of identifying an antenna shape or configuration that can be used as a basis for shaping and/or configuring the pseudo-conductor material to provide an antenna that meets the intended antenna performance.

FIG. 21 depicts a simplified flow diagram of a process 2110 in some embodiments of identifying an antenna shape or configuration that can be used as a basis for shaping and/or configuring the pseudo-conductor material to provide an antenna that meets the intended antenna performance. In some embodiments, the process 2110 can be utilized as part of one or more of steps 112, 114 and/or 116 of the process 110 of FIG. 1.

In step 2112, an electrically conductive antenna or an antenna with one or more electrically conductive emitting surfaces is identified. In some implementations, the identified electrically conductive antenna emits radiation that is similar to or that satisfies the antenna performance attempting to be met by the pseudo-conductor antenna. In step 2114, a shape and/or configuration of the electrically conductive antenna is identified and selected as a basis for the shape or configuration of the pseudo-conductor material in forming the pseudo-conductor in step 116. In step 2116, a shape of the pseudo-conductor is designed from the identified shape of the conventional electrically conductive antenna to achieve the intended antenna performance.

Some embodiments further include step 2120 where it is determined whether the antenna is to be implemented as a conformal antenna and positioned adjacent to or on a conductive surface. Again, as described above, a magnetic pseudo-conductor material can be positioned conformal to and on or adjacent to an electrically conductive surface, and image currents will be induced in the electrically conductive surface in response to the pseudo-conductor antenna being excited such that the image currents induced in the electrically conductive surface enhance the performance of the antenna and allow the antenna size to be reduced by half. Therefore, in some embodiments, the process 2110 may be implemented as at least part of step 114 with the condition that a magnetic pseudo-conductor material is selected. In those instances where the antenna is not to be conformal to an electrically conductive surface the process terminates.

Step 2122 is entered when the antenna is to be positioned conformal to and adjacent to an electrically conductive surface where it is determined whether the antenna shape comprises two symmetrical or substantially symmetrical halves along an axis that is to be parallel with or substantially parallel with the conductive surface. In those instances where the symmetry does not exist the process 2110 terminates. Alternatively, when the symmetry exists, step 2124 is entered where the antenna design is reduced along the axis by eliminating half of the antenna at the point of symmetry providing a subsequent antenna shape or design.

Figure 22:
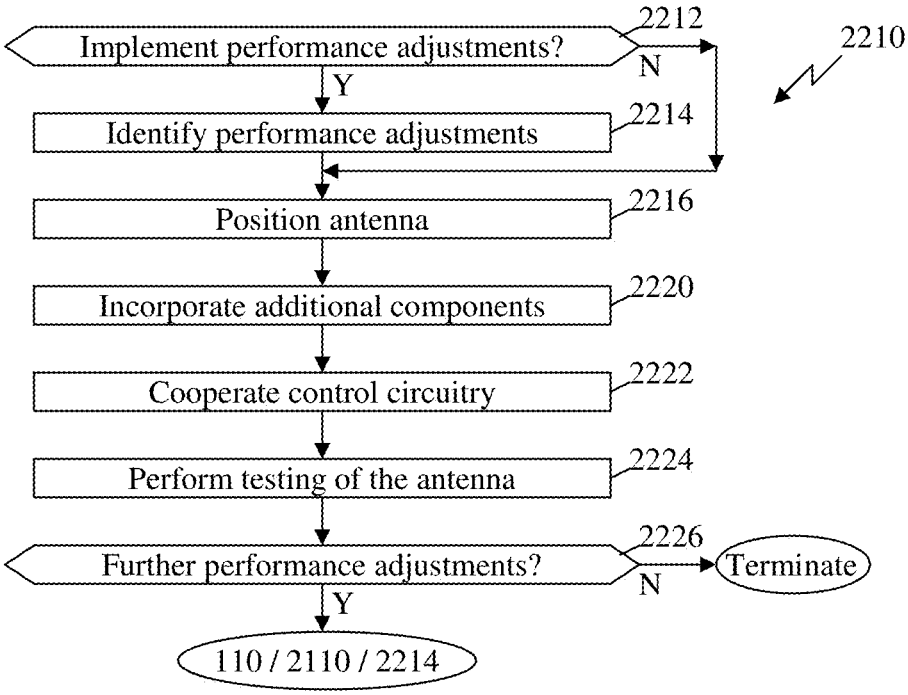
FIG. 22 depicts a simplified flow diagram of a process in some embodiments that can be employed as part of one or both of the processes of FIGS. 1 and/or 21 to enhance, improve and/or optimize antenna performance.

FIG. 22 depicts a simplified flow diagram of a process 2210 in some embodiments that can be employed as part of one or both of processes 110 and/or 2110 to enhance, improve and/or optimize antenna performance. As described above, the utilization of circuit, load and/or terminating elements and/or other such devices within the antenna design can aid in meeting or exceeding the intended antenna performance. In step 2212, it is determined whether performance adjustments could be utilized to improve and/or optimize antenna performance. As described above, the performance of pseudo-conductor antennas can be tuned, focused, adjusted and/or conditioned using circuit, load and/or terminating elements, and/or other such devices within the antenna design and/or other engineering and antenna design techniques such as loading and the like. In those instances where it would be beneficial to incorporate performance adjustments, step 2214 is entered where performance adjustments are evaluated, designed and identified for the configured pseudo-conductor antenna. The identification and implementation of these performance adjustments may include testing, adjusting and retesting to achieve desired results and/or eliminate undesired effects. In some instances the identification of performance adjustments may include an iterative process returning to one or more of steps 112, 114, 116, 2112-2126 to make additional adjustments or alternative selections. In step 2216, the pseudo-conductor antenna is positioned in its intended location or a simulated location.

In step 2220, additional components and/or elements to achieve the tuning, focusing and/or conditioning are incorporated when relevant. In step 2222, control circuitry is coupled with the antenna (e.g., a feed is positioned relative to the pseudo-conductor material and coupled with the control circuitry). Again the control circuitry can include a transmitter, receiver, transceiver or the like coupled with one more devices supplying the signal to be transmitted and/or receive signals, computers, processors, tuners, modulators, demodulators, filters, amplifiers, encoders, decoders and/or other such devices or combinations of such devices that can be cooperated with and/or utilize an antenna. In operation a power source is further coupled at least with the control circuitry. In step 2224 testing of the antenna is performed. In step 2226 it is determined whether further adjustments are needed. When further adjustments are needed the process returns to process 110, process 2110 and/or step 2114 to reevaluate the antenna design. Alternatively, the process terminates and the antenna is put into service.

Figure 23:
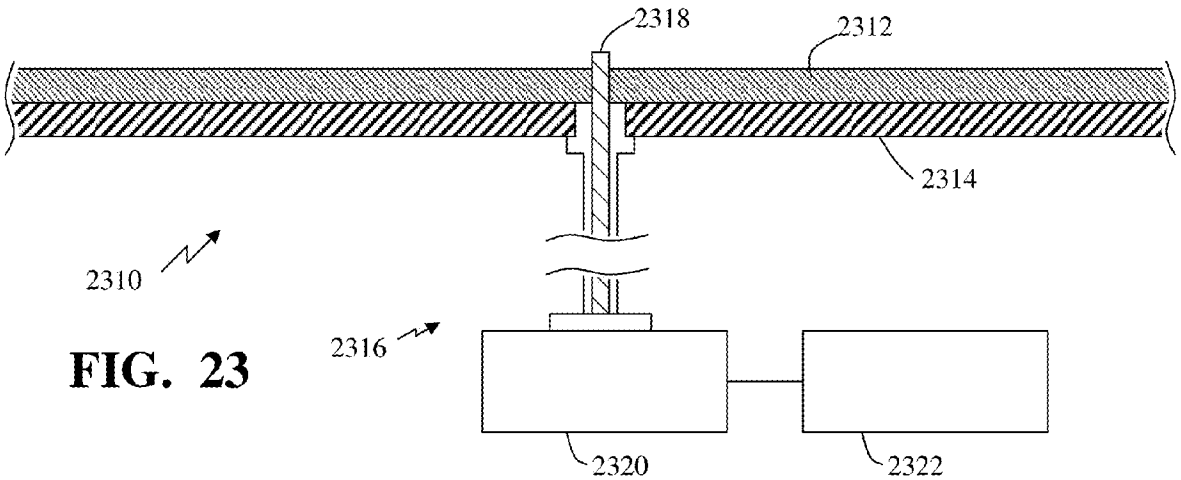
FIG. 23 depicts a simplified block diagram, cross-sectional view of a portion of a pseudo-conductor antenna in some embodiments.

FIG. 23 depicts a simplified block diagram, cross-sectional view of a portion of a pseudo-conductor antenna 2310 in some embodiments. For example, the pseudo-conductor antenna 2310 could be antenna 1110 in FIG. 11, antenna 1710 in FIG. 17, antenna 1910 in FIG. 19 or another antenna. The pseudo-conductor antenna 2310 includes a pseudo-conductor material 2312 positioned conformal to an electrically conductive surface 2314. One or more feed circuits 2316 are positioned relative to the pseudo-conductor material to excite the pseudo-conductor material when the antenna is in operation. The feed circuit 2316 comprises a control system and/or circuitry 2320 coupled with one or more feeds 2318 where a feed 2318 can be a loop, e.g., the loop 1120 in FIG. 11. A power source 2322 is further coupled with the control system 2320.

The control system 2320 can includes one or more components to generate signals to be transmitted from and/or to receive signals through the antenna 2310. In some embodiments, the control system 2320 includes one or more computers, processors, computer and/or processor readable memory, modulators, demodulators, filters, amplifiers, encoders, decoders, tuners and/or other such devices or combinations of such devices. Further, the control system 2320 can be implemented through hardware, software or a combination of hardware and software. Other components may cooperate with the control system such as one or more microphones, speakers or other audio systems, networks (e.g., local area network (LAN), distributed network such as the Internet, wireless network, and/or other such networks or combination thereof), other control systems, guidance systems, global positioning systems, and/or other relevant systems that can utilize an antenna.

The pseudo-conductor material 2312 in the embodiment of FIG. 23 is positioned on top of the conductive surface 2314. It is noted, however, that the pseudo-conductor material can be shaped and/or positioned to reduce drag, such as being positioned within a depression in the conductive surface 2314.

Figure 24:
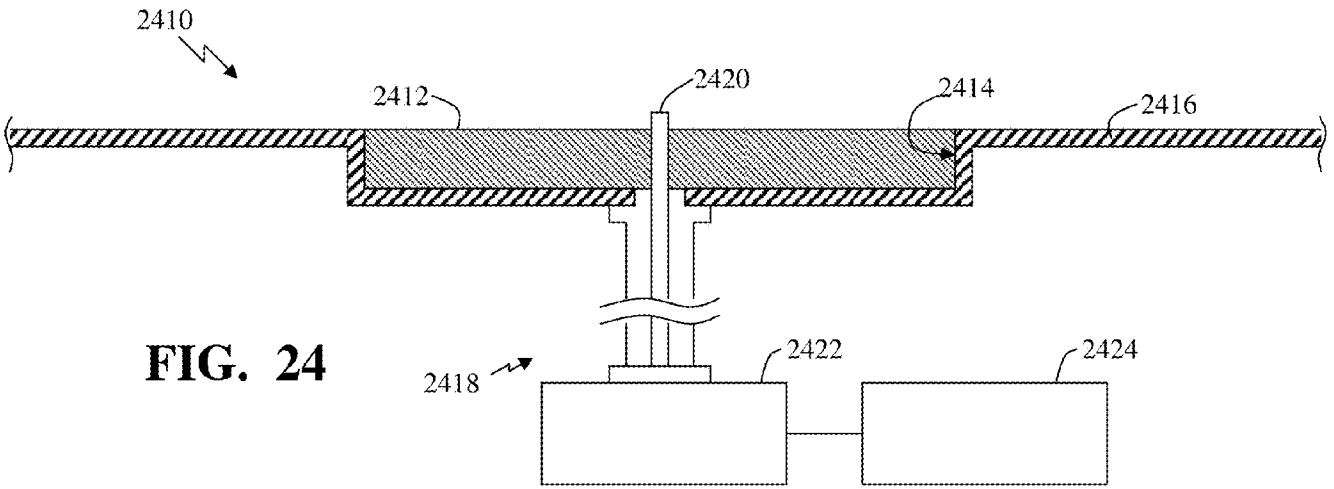
FIG. 24 depicts a simplified block diagram, cross-sectional view of a pseudo-conductor antenna system in some embodiments.

FIG. 24 depicts a simplified block diagram, cross-sectional view of a pseudo-conductor antenna system 2410 in some embodiments. The pseudo-conductor antenna system 2410 includes a pseudo-conductor material 2412 positioned within a depression or a well 2414 of a surface 2416 upon which the pseudo-conductor material is mounted. In some implementations the surface 2416 may be electrically conductive. As a result of the positioning of the pseudo-conductor material within the depression 2414 below the top surface of the surrounding electrically conductive material, the drag induced by the antenna system 2410 can be reduced. The antenna system 2410 further includes one or more feed circuits 2418. The feed circuit 2316 comprises a control system and/or circuitry 2422 coupled with one or more feeds 2420. A power source 2424 is further coupled with the control system 2422. The one or more feeds 2420 are controlled by the control system 2422 and are positioned relative to the pseudo-conductor material 2412 to excite the pseudo-conductor material as controlled by the control circuitry when the antenna system 2410 is in operation.

Other antenna configurations and/or antenna design embodiments can be implemented through the use of pseudo-conductor material that typically cannot be implemented through the use of electrically conductive materials. Similarly, the use of pseudo-conductor antennas allow for conformal topology, and can further allow for different and/or previously unavailable feeding strategies. Further, some of these embodiments can simultaneously provide near theoretical radiation efficiency with near theoretical input match behavior while minimizing matching circuit requirements.

Figure 25:
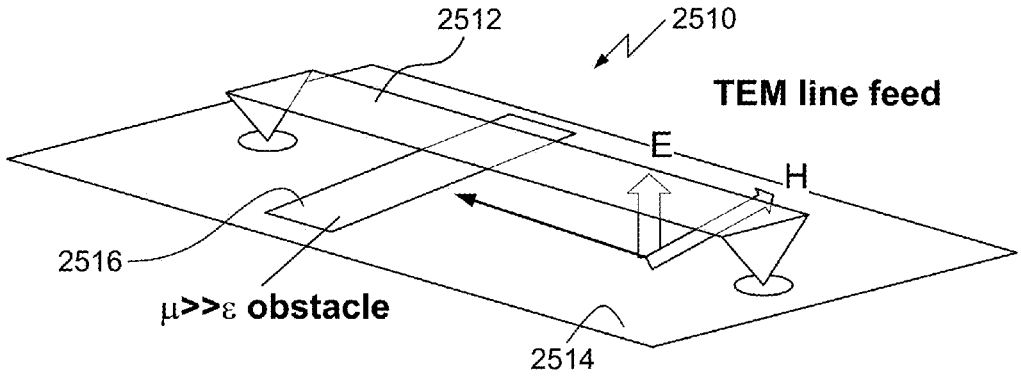
FIG. 25 depicts a simplified block diagram of a conformal antenna in some embodiments.

FIG. 25 depicts a simplified block diagram of an example of a conformal antenna 2510 based on a pseudo conductor material antenna design. The conformal antenna 2510 comprises a electrically conductive microstrip 2512 or other electric conductor positioned over and substantially conformal to an underlying electrically conductive surface or plane 2514. In some implementations, the microstrip 2512 is separated from the conductive surface 2514. In this example, the electrically conductive microstrip 2512 span over the surface 2514 and has two end terminals coupled to a feed circuit. Notably, a pseudo-conductor dipole or strip 2516 is formed in or over the electrically conductive surface or plane 2514 and is elongated along a direction that crosses with and forms an angle with respect to the elongated direction of the electrically conductive microstrip 2512, e.g., perpendicular to the microstrip 2512. For example, the pseudo-conductor dipole 2516 can be oriented and positioned perpendicular to the microstrip 2512 and is structured to form a magnetic pseudo-conductor dipole. The pseudo-conductor dipole, in part, operates as a scatterer for waves on the microstrip 2512. Further, in some implementations, the pseudo-conductor dipole 2516 can define one or more shaping boundaries for the conductive surface 2514.

In operation, a feed, such as a coaxial feed and load that connects to either end terminals of the microstrip 2512, injects a propagating transmission line wave into the microstrip 2512. The pseudo-conductor dipole 2516, with its high impedance (e.g., due to the high permeability to permittivity ratio of the material), defines an obstacle under the microstrip 2512 that is perpendicular to the direction of travel of the wave (and ground plane currents), and acts effectively as a magnetic conductor that tends to prevent the transmission line wave currents from crossing the boundary. As a result, the transmission line wave is scattered as it induces magnetic current flow inside the pseudo-conductor. Thus the guided wave on the microstrip 2512 is converted to a radiating wave at the pseudo-conductor obstacle formed by the pseudo-conductor dipole 2516.

Figure 26:
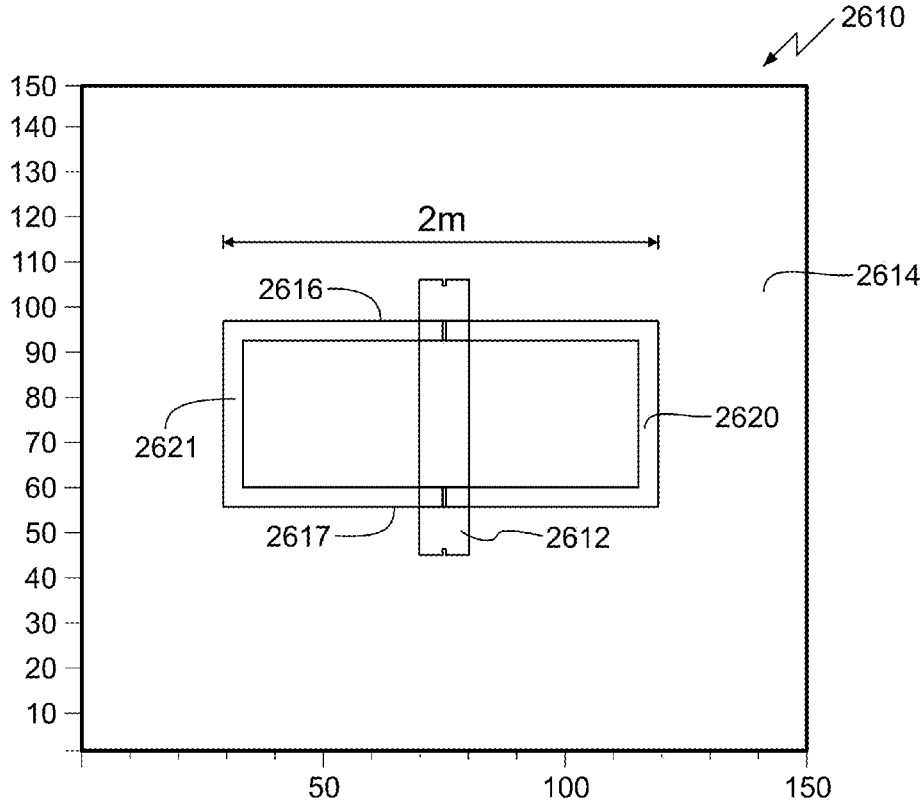
FIG. 26 depicts a simplified overhead top view of a conformal antenna in some embodiments.

FIG. 26 depicts a simplified overhead top view of an example of a conformal antenna 2610 based on another pseudo conductor material antenna design. Similar to the microstrip 2516 in the conformal antenna 2510 of FIG. 25, the conformal antenna 2610 comprises an electrically conductive microstrip 2612 positioned over, conformal to and separated from an electrically conductive surface 2614. Pseudo-conductor strips 2616-2617 are positioned substantially perpendicular to and crosses the microstrip 2612 as pseudo-conductor scattering strips. In some embodiments, pseudo-conductor closing strips or sides 2620-2621 extend between the two pseudo-conductor scattering strips 2616-2617. The pseudo-conductor scattering strips 2616-2617 and/or closing strips 2620-2621 and can be implemented through substantially any magnetic pseudo-conductor material, including the materials as described above.

In this particular example, two scatterers are implemented by the pseudo-conductor scattering strips 2616-2617 are positioned substantially perpendicular to the microstrip to achieve efficient radiation from the microstrip 2612. It has further been discovered that by closing the boundary defined by the pseudo-conductor scattering strips 2616-2617 electric currents can be inhibited from and/or prevented from circulating around the perpendicular pseudo-conductor scattering strips 2616-2617 and reattaching to the transmission line wave. Therefore, some embodiments of the conformal antenna 2610 further comprise the pseudo-conductor closing strips 2620-2621. In some implementations the closing strips 2620-2621 extend from the perpendicular pseudo-conductor scattering strips 2616-2617 to define a pseudo-conductor rectangle or square. By incorporating the closing sides 2620-2621 and/or closing the rectangle (establishing a pseudo-conductor frame) an increase of efficiency (e.g., by a couple of dB in some implementations) may be obtained through the inhibiting of electric currents from circulating around the perpendicular pseudo-conductor scattering strips 2616-2617 and reattaching to the transmission line wave.

In some implementations, the perpendicular pseudo-conductor scattering strips 2616-2617 can be contiguous stripes crossing the microstrip 2612 in a way similar to the pseudo-conductor scattering strip 2516 in FIG. 25. In other implementations, the pseudo-conductor scattering strips 2616-2617 in regions under the microstrip 2612 may be structured to include a gap that splits the pseudo-conductor scattering strips at approximately the center and adding a dielectric fin (see FIG. 27) or other structure generally perpendicular to the conductive surface 2614 at the gap. Such a fin can extend between the electrically conductive surface 2614 and the microstrip 2612. In some implementations, a fin can have a relative permittivity of about 10, while in other embodiments the permittivity may be greater, such as 40 or more. Further, a fin may be constructed to be smaller than a line width of the microstrip 2612, and in some instances to be less than about ⅕ the line width of the microstrip.

Figure 27:
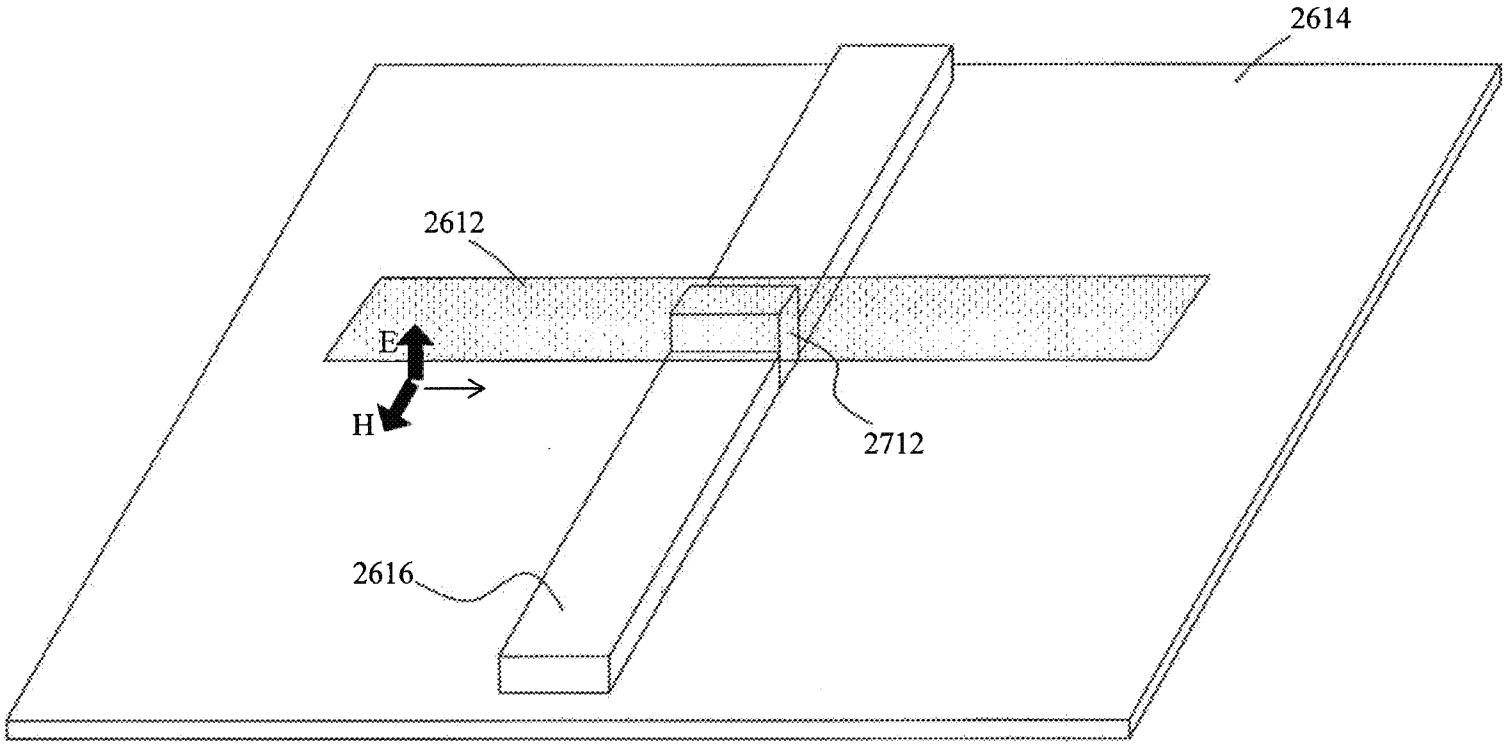
FIG. 27 depicts a simplified block diagraph of a portion of the conformal antenna of FIG. 26 with the microstrip shown partially transparent so that a fin is visible.

FIG. 27 depicts a simplified block diagraph of a portion of the conformal antenna 2610 with the microstrip 2612 shown partially transparent so that a dielectric fin 2712 is visible. The magnetic pseudo-conductor strip 2616 (with a relatively high μ) is split or cut at a center of the strip creating a gap in the pseudo-conductor strip, which can reduce the magnetic echo. The dielectric fin 2712 is inserted in the gap between the conductive surface 2614 (e.g., ground plane) and the conductive microstrip 2612 providing a dielectric echo. With the magnetic pseudo-conductor strip 2612 added as an obstacle to induce radiation from the microstrip 2612, the pseudo-conductor strip reflects energy into the microstrip 2612. As such, in many implementations there is a trade-off between how strong a scatterer the pseudo-conductor strip 2616 is and how good a match is achieved. In some embodiments, the system is configured such that the H-field is eased into the pseudo-conductor strip 2616 by a taper of the shape of the pseudo-conductor, which can in some instances minimize the scattering from it.

Based on the principle of complementary scatterers, a magneto-dielectric sphere with $\mu=\in$ generally does not backscatter when hit by a plane wave because the electric and magnetic dipole moments induced by the wave are effectively identical and such a combination of dipoles constitute a Huygen's source that does not radiate backwards. The wave guided by an air microstrip 2612 is a plane wave but of different field structure and of finite extent. It follows that a magnetic pseudo-conductor strip 2616 tangent to an incident H-field will develop an effective magnetic dipole moment relative to the wave. As such, some embodiments are configured to alter that dipole moment so it does not radiate back into the microstrip 2616, and to create an additional electric dipole moment using permittivity that has substantially the same strength.

The size and/or permittivity of the fin 2712 can depend on the implementation, the size and parameters of the pseudo-conductor strip 2616, the intended implementation and other such factors. As a specific example, with the magnetic pseudo-conductor strip having a thickness of about ½ inch, the fin can similarly have a thickness of about ½ inch.

Figure 28A:
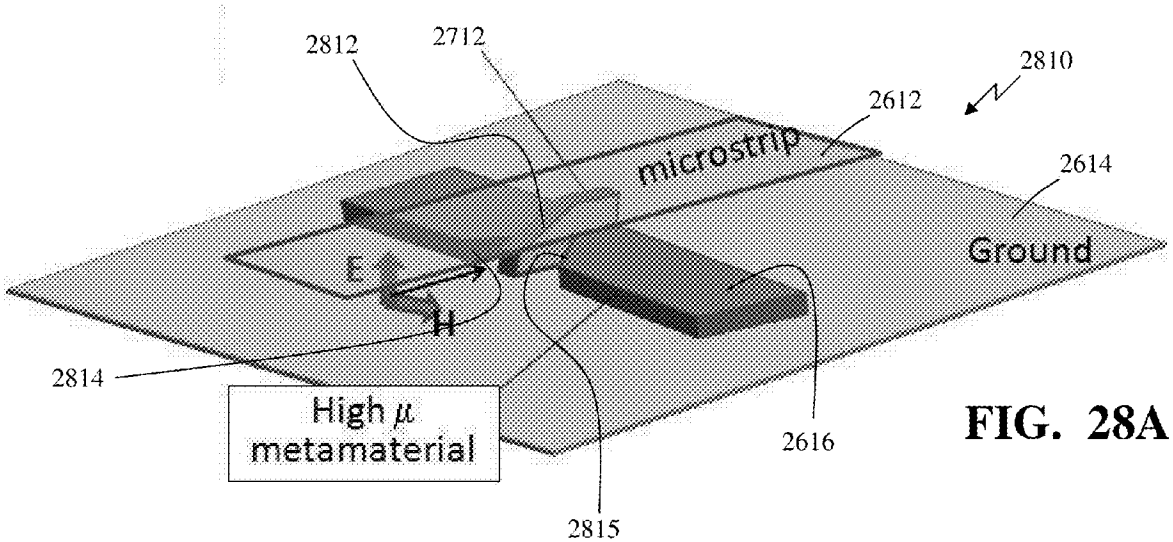
FIG. 28A depicts a simplified perspective block diagraph view of an electrically conductive antenna, in some embodiments, with a microstrip positioned relative to a fin and the pseudo-conductor strip.
Figure 28B:
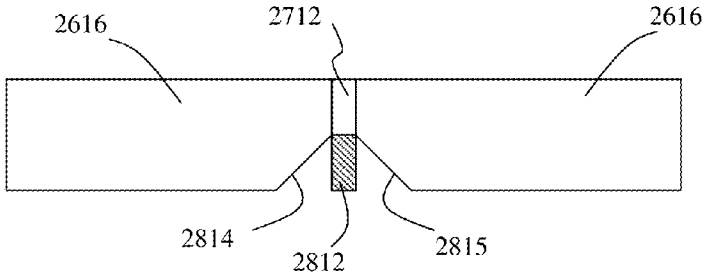
FIG. 28B shows an overhead view of the fin and the pseudo-conductor strip of FIG. 28A.

Further in some embodiments, one or both the pseudo-conductor and the fin may be tapered, for example, from a full width to about half-width over the length of the region under the microstrip 2612. FIG. 28A depicts a simplified perspective block diagraph view of a portion of a conformal antenna 2810 in some embodiments, which is similar to the conformal antenna 2610 of FIG. 26. The conformal antenna comprises an electrically conductive microstrip 2612 positioned relative to a fin 2712 and a pseudo-conductor strip 2616. FIG. 28B shows an overhead view of the fin 2712 and the pseudo-conductor strip 2616 of FIG. 28A. In this configuration, the fin 2712 is tapered or mitered 2812 as it extends toward the microstrip 2612 reducing the area of the fin most proximate the microstrip 2612. Similarly, the pseudo-conductor strip 2616 is also tapered or mitered 2814, 2815 as it approaches the fin 2712 and microstrip 2616 establishing a partial gap proximate the fin 2712. The mitering of the edges of the fin 2712 and/or pseudo-conductor strip 2616 can enhance matching. The dielectric fins 2712 can be selected, in some instances, to be the same thickness as the magnetic pseudo-conductor 2616 and with a dielectric constant essentially equal to the permeability of pseudo-conductor. Thus, if the pseudo-conductor permeability is 80 then fins of permittivity of between about 60 to 90 can be utilized in many applications.

The dielectric fins add an additional scattering obstacle to the microstrip wave that is locally complementary to the scattering of the pseudo-conductor scatter strips 2616-2617. Additionally, the fins can be constructed such that a fin echo substantially matches and effectively cancels the pseudo-conductor echo enhancing and/or optimizing the input impedance of the microstrip 2612. In some implementations the fins are designed through a full physics simulation of the structure so that the echo due to the fin alone and that due to the pseudo-conductor, as seen at the feed, are substantially equal and opposite. This design detail limits or minimizes the amount of energy scattered by the pseudo-conductor into a transmission line wave traveling towards the feed but it leaves the scattering of the pseudo-conductor into free space radiation essentially unchanged.

Figure 29A:
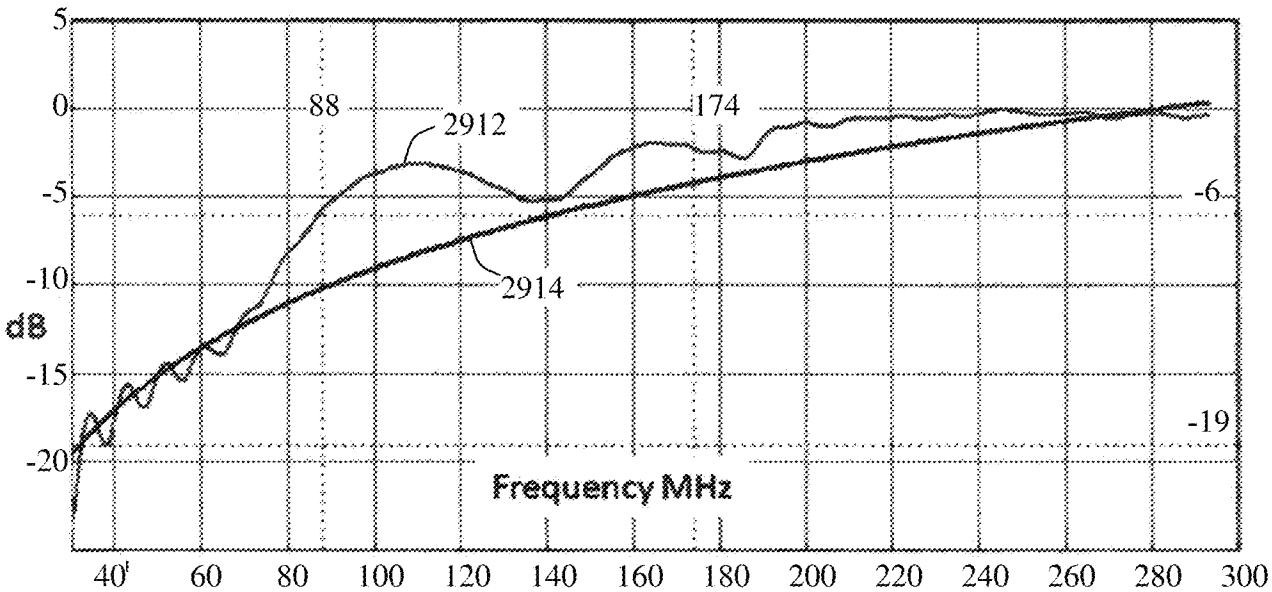
FIG. 29A shows a graphical representation of radiated efficiency (dB) relative to frequency calculated in an embodiment of the conformal antenna of FIG. 26.

FIG. 29A shows a graphical representation of radiated efficiency (dB) relative to frequency calculated in an embodiment of the conformal antenna 2610 of FIG. 26 when fed by a 50 Ohm system, with the pseudo-conductor scattering strips 2616-2617 having a length of about 2.18 m, a thickness of approximately 1 inch, and the pseudo-conductor material forming the pseudo-conductor scattering strips 2616-2617 and closing sides 2620-2621 having a permeability of about $\mu r=80$. In the calculations no matching circuit was used. The efficiency in dB is shown by the curve identified by reference number 2912. For reference, a baseline efficiency curve 2914 is shown assuming the input impedance is purely a radiation resistance proportional to the square of the frequency to demonstrate the non-resonant nature of the performance of the conformal antenna 2610 and the broad bandwidth of performance attained. Even though the simulation was stopped at about 300 MHz it is clear that this antenna 2610 continues to perform well into the UHF range. The conformal antenna 2610, again with pseudo-conductor scattering strips 2616-2617 with $\mu r=80$, having a thickness or height above the conductive surface 2614 that is about 2 inches thick can be used to operate substantially over VHF to UHF ranges, and can be used to replace an 18 inch tall blade antenna.

Figure 29B:
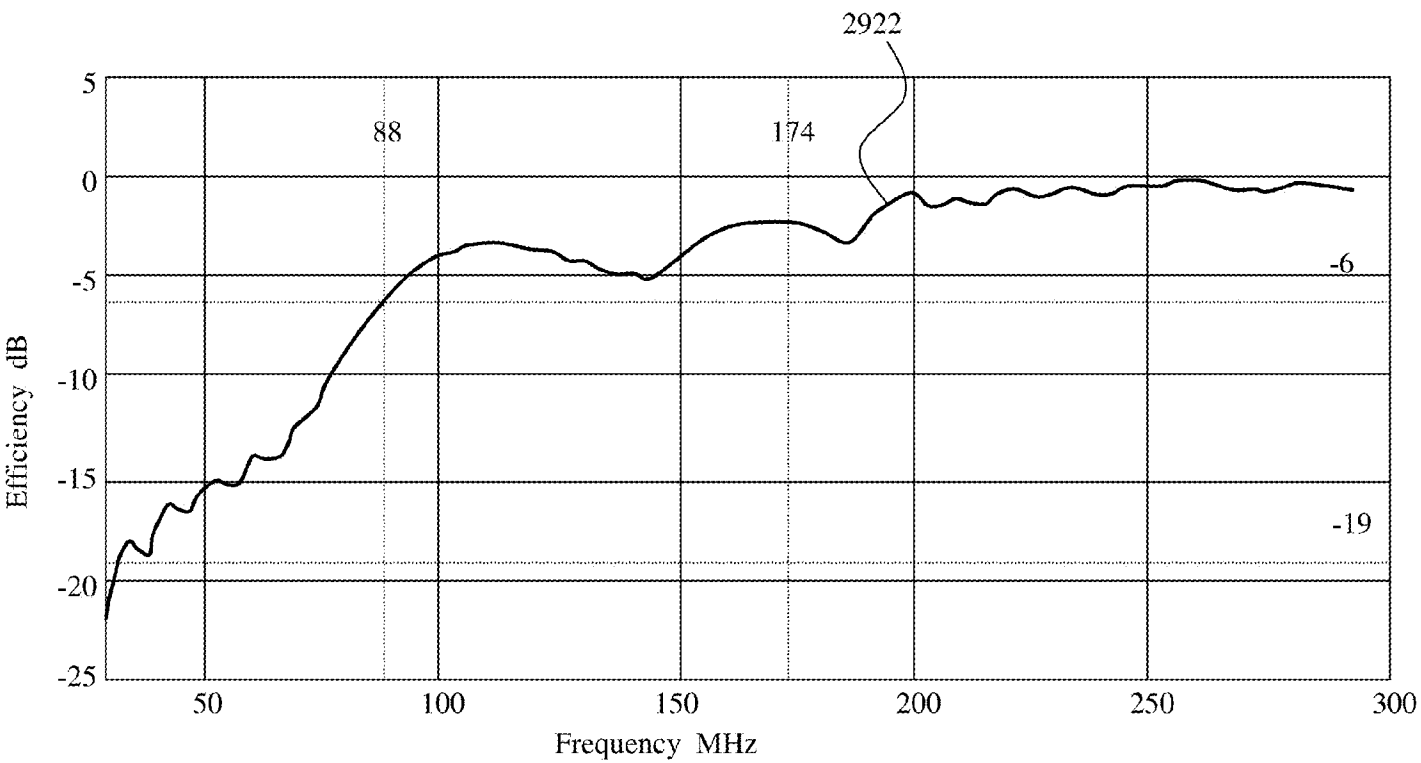
FIG. 29B shows a similar graphical representation of efficiency (dB) relative to frequency in an embodiment of the conformal antenna of FIG. 26, a specification defined efficiency of a typical 18 inch tall HF-VHF blade antenna, and a desired efficiencies in some intended implementations.

FIG. 29B shows a similar graphical representation of efficiency (dB) relative to frequency in an embodiment of the conformal antenna 2610 of FIG. 26. The efficiency results calculated and plotted in FIG. 29B were again generated based on a configuration of the antenna 2610 being fed by a 50 Ohm system, with the pseudo-conductor scattering strips 2616-2617 have a length of about 2.18 m, a thickness of approximately 1 inch, and the pseudo-conductor material forming the pseudo-conductor scattering strips 2616-2617 and closing sides 2620-2621 have a permeability of about $\mu r=80$.

The curve identified by reference number 2922 shows the radiated efficiency results calculated for the above defined conformal antenna 2610.

Figure 30:
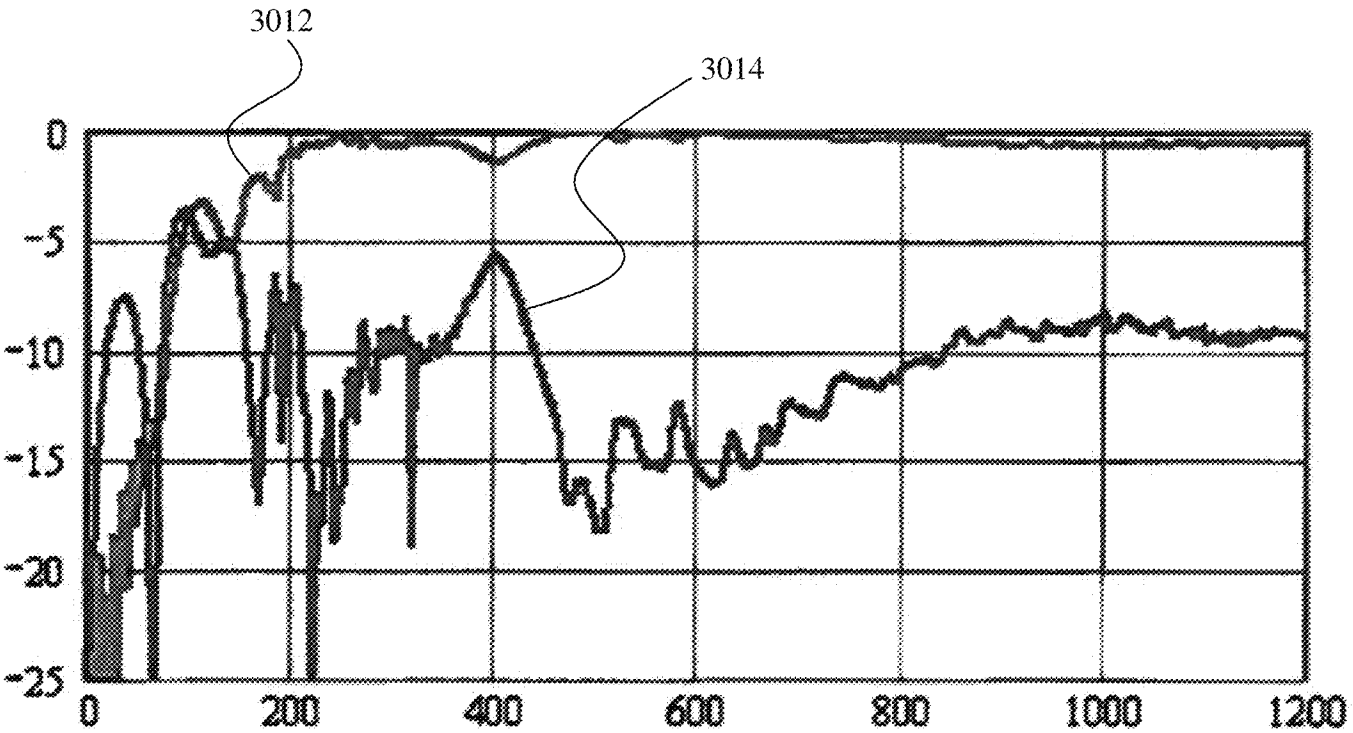
FIG. 30 shows a graphical representation of efficiency and input matching of the conformal antenna of FIG. 26.

FIG. 30 shows a graphical representation of efficiency 3012 and input matching 3014 of the conformal antenna 2610. Without attempts at using a matching circuit, the antenna 2610 has a −6 dB average reflection coefficient from DC to about 400 MHz and then an average of −10 dB out to about 1.2 GHz. Further, in some implementations the antenna 2610 provides a relatively broad bandwidth, essentially attaining about 100% efficiency above approximately 200 MHz, which in some instances may be attributed at least in part to the traveling wave feed being intrinsically matched. It is further noted that in the simulated embodiment the pseudo-conductor material used, having a permeability of about 80, had a thickness of about 1 inch. When using such a pseudo-conductor material as a high-impedance boundary, however, its thickness is typically not dictated by the reflection coefficient phase shift parameters and/or requirements.

Further, some embodiments utilize a pseudo-conductor antenna or object as a feed or actuator of another antenna structure or another pseudo-conductor antenna or structure. These embodiments provide, in effect, a compound pseudo-conductor antenna. For example, some embodiments provide a compound pseudo-conductor antenna where a conducting or dielectric object is used as an antenna that is fed by a loop made of a magnetic pseudo-conductor material that is excited by a feed (e.g., a shorted metal loop fed by a coax transmission line or other feeds). Examples include but are not limited to the magnetic pseudo-conductor material wrapped around a pole, a tree or another object (e.g., $\in'=40$ and conductivity $\sigma=0.4$ S/m).

Figure 31:
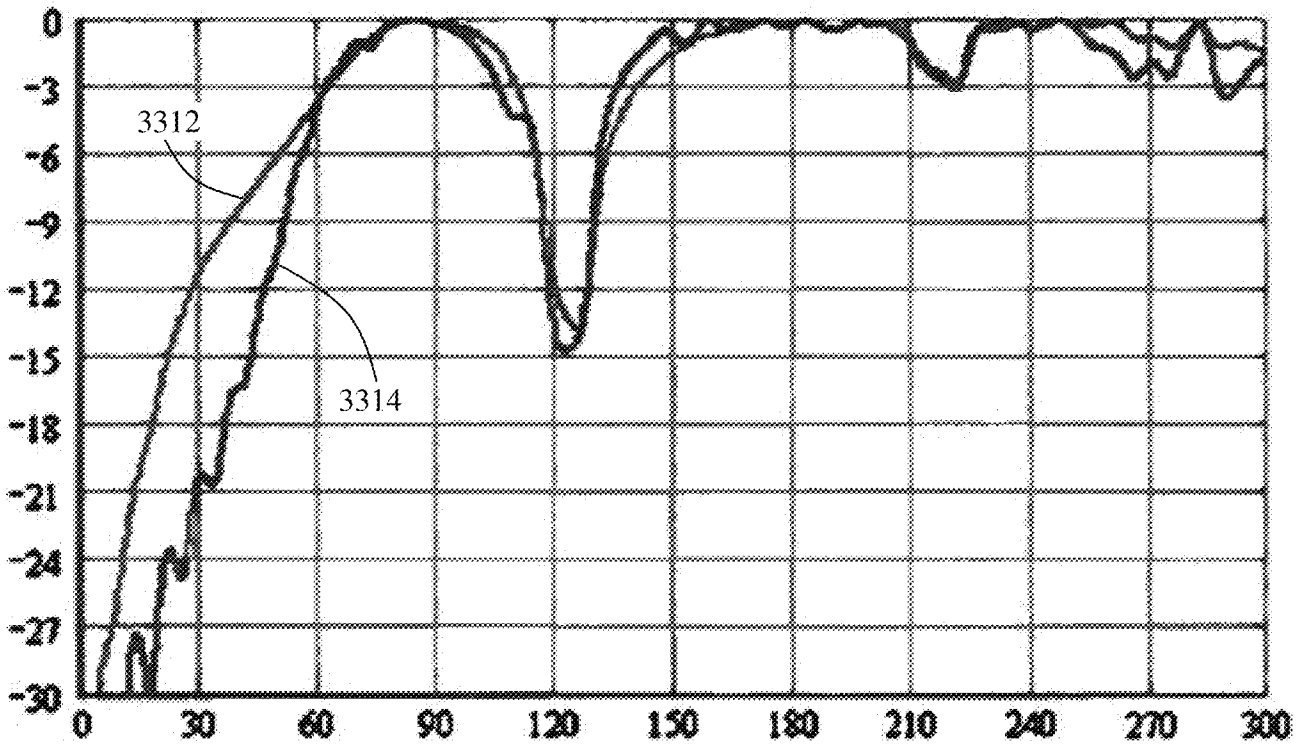
FIG. 31 shows a graphical representation of radiated efficiency (dB) relative to frequency calculated in an embodiment of the compound pseudo-conductor antenna.

FIG. 31 shows a graphical representation of radiated efficiency (dB) relative to frequency calculated in an embodiment of the compound pseudo-conductor antenna system with pseudo-conductor wrapped around an object. The efficiency of the compound antenna system is expected to lie between the two curves identified by reference numbers 3312 and 3314 based on the FDTD calculated total radiated power. As can be seen, the compound antenna system operates in the frequency ranges of from at least about HF through UHF or more. It is noted that the dip in efficiency at about 120 MHz can be moved, minimized and/or potentially eliminated using a proper matching circuit and/or other such antenna engineering techniques.

As described above, antenna design and engineering techniques can be utilized with the compound antenna system to potentially improve performance, tune and/or focus the operation of the system. For example, just as conventional antennas use "lumped element" features to shape the antenna currents and introduce desirable frequency dependent properties (e.g., in impedance or match), similar uses of similar elements or "lumped elements" can be used with pseudo-conductor antennas and the compound pseudo-conductor antenna system. Similarly, in some implementations additional parasitic magnetic and/or electric pseudo-conductor loops (e.g., in the forms of cuffs, collar, seams, bracelets, boarders or the like) can additionally be utilized that can serve as local chokes to limit, inhibit and/or prevent the propagation of the induced displacement currents in the object from reaching parts of the object where it may be undesirable for currents to flow. In some implementations the system control further couples with one or more additional parasitic electric pseudo-conductor loops to provide additional control over the compound pseudo-conductor antenna system.

Some other antenna systems utilize an electrically conductive structure, as an antenna structure excited by a primary structure, such as a wire wound toroid clamped around the electrically conductive structure using the mutual coupling between the toroid and the wire as a transient current sensor. Further, some systems use a toroid with a ferrite permeable core. Such clamps can, in some instances, excite a large electrically conductive structure to provide high frequency transmissions. These systems, however, rely on low frequency mutual inductance (transformer) concepts and the electrically conductive structure having high imaginary permittivity. This is different than using a dielectric pseudo-conductor structure, and the use of a dielectric pseudo-conductor structure as the antenna structure cannot be understood in the conventional terms of mutual inductance between conductors coupled through a transformer.

Further, in designing these other antenna systems engineers assumed that the conductivity of the electrically conductive structure is essential to the operation of the antenna. Furthermore, consideration of wave guidance properties of a magnetic material, such as a magnetic core of a toroid, have not been analyzed, considered or disclosed relative to these other systems. The present pseudo-conductor design approach and embodiments, however, recognize that a dielectric body can be used, similar to an electrically conductive structure. Further, through the use of pseudo-conductor antennas and at least the closed-form models and full physics simulation it has been shown that pseudo-conductor materials can be utilized as antenna elements that radiate electromagnetic waves that meet and/or exceed predefined antenna performance, and with the disclosed approach engineers are able to design the radiating properties of pseudo-conductor antennas to obtain or exceed these predefined and/or desired antenna performance, such as bandwidth and efficiency.

The pseudo-conductor design of the compound pseudo-conductor antenna system recognizes that a dielectric element can be used as a transmitting dielectric. Further, the closed-form models and full physics simulations show that through the use of pseudo-conductors and/or compound pseudo-conductor systems antennas can be designed with radiating properties of the antenna to obtain predefined antenna performance, including for example desired bandwidth and efficiency.

Additionally, some of the above embodiments and descriptions demonstrate that the pseudo-conductor antenna designs and systems of the present embodiments go beyond the mere idea of choking or guiding current on an electrically conductive line or surface. Instead, as described and demonstrate above pseudo-conductor material can be used, in some implementations, as a generalized high impedance current blocking boundary as shown in the discussion of at least FIGS. 25-30, and the concept of chokes. Some embodiments may include the applications of pseudo-conductor chokes, where the pseudo-conductor chokes may be excited directly by a loop feed, parasitically through mutual coupling from another antenna, or as in the microstrip transmission line example, excited by a traveling wave. Other dielectric objects might similarly be used in a compound pseudo-conductor system and/or as a radiating element. For example, a fluid being carried by an insulating tube could be excited into becoming a pseudo-conductor antenna by wrapping a magnetic pseudo-conductor around the tube. For example, a water-hose full of water or a ceramic plasma confinement tube in which case the plasma inside becomes the second conductor fed by a magnetic pseudo-conductor outside.

Again, the pseudo-conductor antenna loosely guides the wave to generate emissions that satisfy one or more predefined antenna performances, such as but not limited to: gain, bandwidth, efficiency, pattern and/or other such factors or parameters and/or combinations of such factors or parameters. In some embodiments, pseudo-conductor antennas can be configured in shapes that are similar to corresponding conductive antennas, and can emit radiations that are similar to or the same as those emitted from the corresponding conductive antennas. Although some embodiment provide pseudo-conductor antennas (e.g., magnetic conductor antennas) that are analogues to free space wire antennas, the conformal topology allows further consideration of different, alternative and/or new feeding strategies that can provide near theoretical radiation efficiency with near theoretical input match behavior while minimizing matching circuit requirements.

Some pseudo-conductor antennas and their designs utilize line segments of pseudo-conductor material, for example to provide top loading. Further, some embodiments augment, focus and/or otherwise control the behavior of the antennas through the use of circuit elements, terminating elements and other such structures that are effectively coupled with and/or interact with the electromagnetic wave and/or current on the pseudo-conductor.

Some embodiments, as described above, implement antenna systems utilizing pseudo-conductor material, having real part of the electromagnetic constitutive property that is greater than a corresponding imaginary part of the electromagnetic constitutive property, effectively as a high impedance boundary to reshape the currents on an electrically conductive material, such as a metal ground plane, and thus effectively creating a dual of conventional antennas (e.g., antennas that behave as if they were made from substantially perfect magnetic conductors). Such antenna systems can be made relatively thin and lightweight, while still achieving broadband versions that outperform conventional antennas. In some specific implementations, such antenna systems achieve vertical polarization from a horizontal conformal antenna on an electrically conductive surface by combining two such pseudo-conductor antenna systems with a 90 degree hybrid coupler.

Pseudo-conductor antennas, designs and techniques described in this document can be used for both receiving antennas and transmitting antennas. In some embodiments relative to cases of high power transmission, the pseudo-conductor materials and feed are selected and/or designed not to arc and not to burn when very large currents and voltages (e.g., resulting in large powers in about the 600 W and higher range) are fed into the antenna.

It will be appreciated that, in some embodiments, an antenna device includes a pseudo-conductor material having an electromagnetic constitutive property which has a real part of the electromagnetic constitutive property greater than a corresponding imaginary part of the electromagnetic constitutive property. In some designs, the pseudo-conductor material configured to weakly guide displacement currents on the pseudo-conductor material to radiate or receive electromagnetic energy. The antenna device further includes antenna circuit coupled to the pseudo-conductor material and configured to excite the pseudo-conductor material to radiate the electromagnetic energy or to receive the electromagnetic energy received by the pseudo-conductor material. In some embodiments, the pseudo-conductor material is shaped as a pseudo-conductor loop that is configured to enclose a conductive or a dielectric or a lossy dielectric object and is coupled to the antenna circuit. The pseudo-conductor loop is structured to operate with the conductive or the dielectric or the lossy dielectric object to radiate the electromagnetic energy from the antenna circuit or to receive the electromagnetic energy and to direct the received electromagnetic energy to the antenna circuit. In some embodiments, the antenna device includes an electrically conductive loop engaged to inner side of the pseudo-conductor loop to provide an electrically conductive interface between the conductive or the dielectric or the lossy dielectric object and the pseudo-conductor loop.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Thus, particular embodiments have been described. Variations and enhancements of the described embodiments and other embodiments can be made based on what is described and illustrated.

What is claimed is:

1. A method of configuring an antenna, comprising:

selecting a pseudo-conductor material having an electromagnetic constitutive property having a real part greater than a corresponding imaginary part of the electromagnetic constitutive property; and forming the pseudo-conductor material into an antenna to be directly on an electrically conducting surface without an insulator between the pseudo-conductor material and the electrically conducting surface, upon being excited, to radiate emissions that satisfy a predefined antenna performance.

2. The method of claim 1, wherein the pseudo-conductor material formed in the antenna weakly guides an electromagnetic wave on the pseudo-conductor material using a leaky mode that is below cutoff to establish a field structure to radiate the emissions from the pseudo-conductor material that satisfy the antenna performance.

3. The method of claim 1, wherein the selecting the pseudo-conductor material comprises selecting the pseudo-conductor material where the electromagnetic constitutive property includes permeability, such that a real part of the permeability is greater than an imaginary part of the permeability and such that the relative permeability is greater than the relative permittivity of the material.

4. The method of claim 1, wherein the selecting the pseudo-conductor material comprises selecting the pseudo-conductor material where the electromagnetic constitutive property includes permittivity, such that a real part of the permittivity is greater than an imaginary part of the permittivity and such that the relative permittivity is greater than the relative permeability of the material.

5. The method of claim 1, wherein the forming the pseudo-conductor material into the antenna comprises forming the pseudo-conductor material into the antenna such that the formed pseudo-conductor material formed in the antenna is configured to provide wave propagation in a TE01, transverse electric, mode below cut-off.

6. The method of claim 5, wherein the formed pseudo-conductor material formed in the antenna is configured to provide the wave propagation in the TE01 mode and establish a longitudinal and radial magnetic field with a circulating electric field.

7. The method of claim 6, wherein the forming pseudo-conductor material comprises forming the pseudo-conductor material in the antenna such that the pseudo-conductor material formed in the antenna is configured, upon being excited, to establish an electromagnetic field outside the pseudo-conductor material formed in the antenna dominated by the radial magnetic field and the circulating electric field.

8. The method of claim 6, wherein the forming the pseudo-conductor material into the antenna comprises forming the pseudo-conductor material into the antenna having one or more discontinuities such that at least some of the emissions radiate off at the one or more discontinuities.

9. The method of claim 1, wherein the forming the pseudo-conductor material into the antenna comprises forming the pseudo-conductor material into the antenna such that the formed pseudo-conductor material formed in the antenna is configured, upon being excited, to provide wave propagation in a TM01, transverse magnetic, mode below cut-off.

10. The method of claim 9, wherein the formed pseudo-conductor material formed in the antenna is configured to provide the wave propagation in the TM01 mode and establish a longitudinal and radial electric field with a circulating magnetic field.

11. The method of claim 10, wherein the forming the pseudo-conductor material comprises forming the pseudo-conductor material in the antenna such that the pseudo-conductor material formed in the antenna is configured, upon being excited, to establish an electromagnetic field outside the pseudo-conductor material formed in the antenna dominated by the radial electric field and the circulating magnetic field.

12. The method of claim 1, further comprising:

positioning the formed pseudo-conductive material in the antenna adjacent an electrically conductive plane such that the electrically conductive plane is configured in cooperation with the pseudo-conductive material in the antenna such that image currents are excited in the electrically conductive plane in response to the formed pseudo-conductive material being excited, where the image currents enhance the emissions from the pseudo-conductive material in meeting the antenna performance.

13. The method of claim 12, wherein the positioning the formed pseudo-conductive material in the antenna comprises positioning the formed pseudo-conductive material conformal to the electrically conductive plane.

14. The method of claim 13, wherein the positioning the formed pseudo-conductive material in the antenna comprises positioning the formed pseudo-conductive material conformal to the electrically conductive plane and directly on the electrically conductive plane.

15. The method of claim 1, further comprising:

designing an initial antenna where the initial antenna comprises two substantially identical halves;

wherein the forming the pseudo-conductor material comprises forming the pseudo-conductor material into the antenna where the antenna is one half of the two substantially identical halves of the initial antenna design; and positioning the formed pseudo-conductive material in the antenna adjacent an electrically conductive surface, where image currents are excited in the electrically conductive surface in cooperation with the pseudo-conductive material in the antenna and in response to the formed pseudo-conductive material being excited such that the image currents in the electrically conductive surface enhance radiation from the pseudo-conductive material in meeting the antenna performance.

16. The method of claim 15, wherein the pseudo-conductive material in the antenna is a conformal antenna positioned conformal to the electrically conductive surface.

17. The method of claim 15, wherein the pseudo-conductive material in the antenna is a conformal antenna positioned conformal to the electrically conductive surface by embedding it in a channel or indentation.

18. An antenna device, comprising:

a pseudo-conductor material having an electromagnetic constitutive property which has a real part of the electromagnetic constitutive property greater than a corresponding imaginary part of the electromagnetic constitutive property, the pseudo-conductor material configured to weakly guide displacement currents on the pseudo-conductor material to radiate or receive electromagnetic energy; and an antenna circuit coupled to the pseudo-conductor material and configured to excite the pseudo-conductor material to radiate the electromagnetic energy or to receive the electromagnetic energy received by the pseudo-conductor material.

19. The antenna device of claim 18, comprising:

an electrically conductive plane electromagnetically coupled to the antenna circuit and the pseudo-conductor material as part of the antenna device, wherein the pseudo-conductive material is positioned conformal to the electrically conductive plane.

20. The antenna device of claim 19, wherein the pseudo-conductor material is positioned directly on the electrically conductive plane.

21. The antenna device of claim 18, wherein the pseudo-conductor material includes a first pseudo-conductor material piece and a second, separate pseudo-conductor material piece, and wherein the antenna device includes:

first and second metal wires that are separate from each other and positioned relative to each other to form a dipole antenna, wherein the first pseudo-conductor material piece is connected to a distal end of the first metal wire and the second pseudo-conductor material piece is connected to a distal end of the second metal wire in a configuration that the first and second pseudo-conductor material pieces form radiating or receiving elements of the dipole antenna.

22. The antenna device of claim 18, comprising:

an electrically conductive plane to which the pseudo-conductor material is directly engaged, and wherein the electrically conductive plane is configured to include a well in which the pseudo-conductor material is located.

23. An antenna device, comprising:

a pseudo-conductor material having an electromagnetic constitutive property which has a real part of the electromagnetic constitutive property greater than a corresponding imaginary part of the electromagnetic constitutive property, the pseudo-conductor material configured to weakly guide displacement currents on the pseudo-conductor material to radiate or receive electromagnetic energy;

an antenna circuit coupled to the pseudo-conductor material and configured to excite the pseudo-conductor material to radiate the electromagnetic energy or to receive the electromagnetic energy received by the pseudo-conductor material;

an electrically conductive plane to which the pseudo-conductor material is directly engaged; and an electrically conductive loop having a first end connected to the electrically conductive plane at a location on a first side of the pseudo-conductor material without being in contact with the pseudo-conductor material, a loop section that passes over the pseudo-conductor material without being in contact with the pseudo-conductor material and a second end that is located on a second side of the pseudo-conductor material opposing the first side and is connected to the antenna circuit, wherein the antenna circuit includes a coaxial cable that is connected to the second end of the electrically conductive loop.

24. The antenna device of claim 23, comprising:

a first antenna terminating element connected to the electrically conductive plane and located at a first position over the pseudo-conductor material; and a second antenna terminating element connected to the electrically conductive plane and located at a second position over the pseudo-conductor material, wherein the first and second antenna terminating elements are on two opposite sides of the electrically conductive loop.

25. The antenna device of claim 24, wherein:

each of the first and second antenna terminating elements includes an electrically conductive loop having a first end connected to the electrically conductive plane at a location on a first side of the pseudo-conductor material without being in contact with the pseudo-conductor material, a loop section that passes over the pseudo-conductor material without being in contact with the pseudo-conductor material and a second end that is located on a second side of the pseudo-conductor material opposing the first side and is connected to a termination element connected to the electrically conductive plane.

26. The antenna device of claim 25, wherein the termination element is a capacitive element.

27. The antenna device of claim 25, wherein the termination element is a split ring resonator.

28. The antenna device of claim 24, wherein:

the pseudo-conductor material is elongated to form a pseudo-conductor dipole antenna, and the electrically conductive loop is located at a central position of the pseudo-conductor material.

29. The antenna device of claim 28, wherein:

the pseudo-conductor material includes a main elongated section relative to which the electrically conductive loop is located at a central position of the main elongated portion, and two elongated end sections formed at two distal ends of the main elongated section.

30. The antenna device of claim 23, wherein:

the pseudo-conductor material includes a main elongated section relative to which the electrically conductive loop is located at a central position of the main elongated portion, and periodic extensions of different extension lengths formed along the main elongated section and symmetrically located on two sides of the electrically conductive loop.

31. An antenna device, comprising:

a pseudo-conductor material having an electromagnetic constitutive property which has a real part of the electromagnetic constitutive property greater than a corresponding imaginary part of the electromagnetic constitutive property, the pseudo-conductor material configured to weakly guide displacement currents on the pseudo-conductor material to radiate or receive electromagnetic energy;

an antenna circuit coupled to the pseudo-conductor material and configured to excite the pseudo-conductor material to radiate the electromagnetic energy or to receive the electromagnetic energy received by the pseudo-conductor material;

an electrically conductive plane to which the pseudo-conductor material is directly engaged; and an electrically conductive microstrip formed over the pseudo-conductor material and configured to have two terminals that are coupled to the antenna circuit, wherein the pseudo-conductor material includes an elongated section that crosses the electrically conductive microstrip and is located between the electrically conductive microstrip and the electrically conductive plane, and wherein the electrically conductive plane, the pseudo-conductor material and the electrically conductive microstrip form the antenna to radiate or receive the electromagnetic energy.

32. The antenna device of claim 31, wherein:

the elongated section that crosses the electrically conductive microstrip includes a first pseudo-conductor material section and a second, separate pseudo-conductor material section that are spaced from each other to form a gap underneath the electrically conductive microstrip, and the antenna device includes a dielectric fin structure formed in the gap between the first and second pseudo-conductor material sections and between the electrically conductive microstrip and the electrically conductive plane.

33. The antenna device of claim 32, wherein:

the dielectric fin structure has a tapered edge.

34. The antenna device of claim 32, wherein:

ends of the first and second pseudo-conductor material sections that face each other are tapered.

35. An antenna device, comprising:

a pseudo-conductor material having an electromagnetic constitutive property which has a real part of the electromagnetic constitutive property greater than a corresponding imaginary part of the electromagnetic constitutive property, the pseudo-conductor material configured to weakly guide displacement currents on the pseudo-conductor material to radiate or receive electromagnetic energy; and an antenna circuit coupled to the pseudo-conductor material and configured to excite the pseudo-conductor material to radiate the electromagnetic energy or to receive the electromagnetic energy received by the pseudo-conductor material, wherein:

the pseudo-conductor material is shaped as a pseudo-conductor loop that is configured to enclose a conductive or a dielectric or a lossy dielectric object and is coupled to the antenna circuit; and the pseudo-conductor loop is structured to operate with the conductive or the dielectric or the lossy dielectric object to radiate the electromagnetic energy from the antenna circuit or to receive the electromagnetic energy and to direct the received electromagnetic energy to the antenna circuit.

36. The antenna device of claim 35, comprising:

an electrically conductive loop engaged to inner side of the pseudo-conductor loop to provide an electrically conductive interface between the conductive or the dielectric or the lossy dielectric object and the pseudo-conductor loop.

37. An antenna device, comprising:

a pseudo-conductor material that is not electrically conductive and exhibits either (1) a material permeability having a real part greater than a corresponding imaginary part and a relative permeability greater than a relative permittivity, or (2) a material permittivity having a real part greater than a corresponding imaginary part and having the relative permittivity greater than the relative permeability;

an electrical conductor positioned relative to the pseudo-conductor material to electromagnetically coupled to the pseudo-conductor material; and an antenna circuit coupled to the pseudo-conductor material and the electrical conductor to supply a signal of electromagnetic energy to (1) excite one or more weakly guided electromagnetic modes in the pseudo-conductor material to cause radiation of the weakly guided electromagnetic energy or (2) receive electromagnetic energy that is received by the antenna circuit.

38. The antenna device of claim 37, wherein the electrical conductor is a conductor plane, wherein the pseudo-conductive material is positioned conformal to the conductor plane.

39. The antenna device of claim 37, wherein the electrical conductor is a conductor plane, wherein the pseudo-conductive material is directly in contact with the conductor plane.

* * * * *